US012179993B2

(12) United States Patent
Sugawara et al.

(10) Patent No.: US 12,179,993 B2
(45) Date of Patent: Dec. 31, 2024

(54) DISCHARGE APPARATUS

(71) Applicant: DAIZO CORPORATION, Osaka (JP)

(72) Inventors: Shinya Sugawara, Kyoto (JP); Kimio Kataoka, Kyoto (JP); Hidetoshi Miyamoto, Kyoto (JP)

(73) Assignee: DAIZO CORPORATION, Osaka (JP)

( * ) Notice: Subject to any disclaimer, the term of this patent is extended or adjusted under 35 U.S.C. 154(b) by 443 days.

(21) Appl. No.: 17/615,696

(22) PCT Filed: Dec. 26, 2019

(86) PCT No.: PCT/JP2019/051302
§ 371 (c)(1),
(2) Date: Dec. 1, 2021

(87) PCT Pub. No.: WO2020/250467
PCT Pub. Date: Dec. 17, 2020

(65) Prior Publication Data

US 2022/0234816 A1 Jul. 28, 2022

(30) Foreign Application Priority Data

Jun. 14, 2019 (JP) ..... 2019-110872
Oct. 18, 2019 (JP) ..... 2019-191572
(Continued)

(51) Int. Cl.
*B65D 83/14* (2006.01)
*B65D 83/48* (2006.01)
(Continued)

(52) U.S. Cl.
CPC ..... *B65D 83/62* (2013.01); *B65D 83/48* (2013.01); *B65D 83/66* (2013.01)

(58) Field of Classification Search
CPC ..... B05B 11/026; B05B 11/0054; B05B 11/1091; B05B 11/1047; B05B 11/0008;
(Continued)

(56) References Cited

U.S. PATENT DOCUMENTS 2,564,163 A * 8/1951 Leperre ..... C12N 1/22 141/2
2,829,801 A 4/1958 Ayres
(Continued)

FOREIGN PATENT DOCUMENTS

JP H10-511065 A 10/1998
JP 2008-542147 A 11/2008
(Continued)

OTHER PUBLICATIONS

International Search Report of PCT/JP2019/051302 mailed on Mar. 24, 2020.
(Continued)

*Primary Examiner* — Charles P. Cheyney
(74) *Attorney, Agent, or Firm* — IP Business Solutions, LLC

(57) ABSTRACT

A discharge device is provided with a pressurized product filling and sealing the concentrate and the pressurizing agent P inside the container, and a discharge member discharging the concentrate by breaking through the pressurized product. The discharge member is provided with a valve which becomes a discharge passage of the concentrate, and a cap which covers the valve and is detachably mounted to the pressurized product. The discharge device is provided with a suppressing means (a maintaining mechanism, a movable lid, pressing to the bottom of the recessed part of the projecting part, a part releasing mechanism, a ratchet mecha-
(Continued)

nism, a thin part and a plurality of coupling parts) for suppressing the leakage of the concentrate caused by removing the valve.

4 Claims, 27 Drawing Sheets

(30) Foreign Application Priority Data

Oct. 18, 2019 (JP) ..... 2019-191573
Dec. 19, 2019 (JP) ..... 2019-229748
Dec. 19, 2019 (JP) ..... 2019-229749

(51) Int. Cl.
*B65D 83/62* (2006.01)
*B65D 83/66* (2006.01)

(58) Field of Classification Search
CPC ..... B67D 1/0462; B65D 83/62; B65D 83/48; B65D 83/66
USPC ..... 222/82, 105, 95, 386.5
See application file for complete search history.

(56) References Cited

U.S. PATENT DOCUMENTS 3,648,899 A * 3/1972 Lukesch ..... B65D 83/687 222/82
4,162,030 A * 7/1979 Capra ..... B67D 1/0462 239/323
4,821,923 A * 4/1989 Skorka ..... B65D 81/3222 222/129
5,613,622 A * 3/1997 Surrena ..... B65D 90/046 222/105
6,988,496 B1 * 1/2006 Eicher ..... B05B 11/0044 128/200.14
7,213,593 B2 * 5/2007 Hochrainer ..... B05B 7/24 128/200.14
8,413,857 B2 * 4/2013 Johnson ..... B65D 75/5877 222/105
10,005,654 B2 * 6/2018 Kraenzle ..... B67D 1/0462
10,427,927 B2 * 10/2019 Leibinger ..... B67C 3/06
2003/0062383 A1 * 4/2003 Meike ..... B67D 1/0437 222/386.5
2011/0290243 A1 * 12/2011 Bach ..... A61M 15/0065 128/200.21
2016/0251209 A1 * 9/2016 Standaert ..... B67D 1/0801 222/95

FOREIGN PATENT DOCUMENTS

JP 2012-017129 A 1/2012
JP 2012-148802 A 8/2012
JP 2013-189218 A 9/2013
JP 2017-019514 A 1/2017
WO 2015/080252 A1 6/2015

OTHER PUBLICATIONS

Written Opinion of the International Searching Authority of PCT/JP2019/028379 mailed on Mar. 24, 2020.

* cited by examiner

DISCHARGE APPARATUS

CROSS-REFERENCE TO RELATED APPLICATIONS

This is the U.S. National Phase under 35 U.S.C. 371 of International Application No. PCT/JP2019/051302, filed on Dec. 26, 2019, which in turn claims the benefit of Japanese Patent Application Nos. 2019-110872, filed on Jun. 14, 2019, 2019-191572, filed on Oct. 18, 2019, 2019-191573, filed on Oct. 18, 2019, 2019-229748, filed on Dec. 19, 2019, and 2019-229749, filed on Dec. 19, 2019, the disclosures of which are incorporated by reference herein.

BACKGROUND OF THE INVENTION

Field of the Invention

The present invention relates to a discharge device. Particularly, the present invention relates to the discharge device provided with a pressurized product in which a concentrate and a pressurizing agent are filled and sealed inside a container, and a discharge member which is detachable from the pressurized product.

Description of the Related Art

International Patent Publication Application No. WO2015/080252 shows a discharge device configured with a discharge member provided with a valve to the container in which a concentrate and a pressurizing agent are filled. In this discharge device, the discharge member is detachable from the container. Specifically, the discharge member is provided with a valve and a cap covering the valve. Then, by screwing the cap to a screw provided in a neck part outer periphery of the container, the discharge member is mounted to the container. Thus, the discharge member is removed from the container after the concentrate is completely discharged, and it is possible for a recycle of the discharge member so as to be replaced to a new container.

Note that in the discharge device of International Patent Publication Application No. WO2015/080252, the discharge member is simply screwed to the container. Therefore, it is possible to remove the discharge member before the discharge is completed. If the cap is removed in a remaining state of the concentrate, there is a chance to spray the concentrate out.

The description herein of advantages and disadvantages of various features, embodiments, methods, and apparatus disclosed in other publications is in no way intended to limit the present invention. For example, certain features of the preferred described embodiments of the invention may be capable of overcoming certain disadvantages and/or providing certain advantages, such as, e.g., disadvantages and/or advantages discussed herein, while retaining some or all of the features, embodiments, methods, and apparatus disclosed therein.

SUMMARY OF THE INVENTION

The disclosed embodiments of the present invention have been developed in view of the above-mentioned and/or other problems in the related art. The disclosed embodiments of the present invention can significantly improve upon existing methods and/or apparatuses.

A technical object in the present invention is to provide a discharge device which can suppress the leakage of the concentrate due to the removal of the valve.

In some embodiments of the present disclosure, a discharge device is characterized to include a suppressing means (a maintaining mechanism, a movable lid, pressing to the bottom of the recessed part of the projecting part, a part releasing mechanism, a ratchet mechanism, a thin part and a plurality of coupling parts) for suppressing the leakage of the concentrate caused by removing the valve.

In some embodiments of the present disclosure, a discharge device is provided with a pressurized product filling and sealing the concentrate and the pressurizing agent in the container, and a discharge member discharging the concentrate by breaking through the pressurized product. The discharge member is provided with a valve, and a cap which covers the valve and is detachably mounted to the pressurized product. In addition to the mounting of the valve by the cap, it is preferable to provide a maintaining mechanism in order to maintain the state in which the valve is mounted to the pressurized product.

In such discharge device, the maintaining mechanism is provided to any one of the valve and the pressurized product, and it is preferable to provide an engaging means to maintain the state in which the valve is mounted to the pressurized product against the pressure of the pressurizing agent.

Further, in some embodiments of the present disclosure, the engaging means is provided in any one of the valve and the pressurized product, and is preferably provided with an engaging projection for engaging to the other one. Further, the engaging projection may be a screw-shape. Further, the engaging projection is provided in the valve, and the valve breaks through the pressurized product, and it is preferable to engage the engaging projection to an edge of a through hole made by the breaking through. The valve is provided with a housing, and is preferably provided with a seal opening part which has the engaging projection and is detachable from the housing. Further, the valve may be engaged with or disengaged from the pressurized product. Specifically, the engaging projection is provided in the valve and the pressurized product, and by engaging the engaging projection of the valve and the engaging projection of the pressurized product, the valve and the pressurized product are engaged. It is preferable to provide an engagement releasing part R positioned adjacent to the engaging projection of any one of the valve and the pressurized product to release the engagement of the engaging projections each other.

Further, in some embodiments of the present disclosure, the maintaining mechanism may be provided with an inner cylindrical part positioned at the outer periphery of the cap so as to make the inner diameter smaller by interlocking with the contraction of the container due to the reduction of the internal pressure. Further, in this case, it is preferable to provide an engaging projection at any one of the inner cylindrical part and the cap to firstly engage with the other one when the inner diameter of the inner cylindrical part becomes small.

In some embodiments of the present disclosure, a discharge device is provided with a pressurized product filling and sealing the concentrate and the pressurizing agent in the container, and a discharge member discharging the concentrate by breaking through the pressurized product. The discharge member is provided with a valve and a cap which covers the valve and is detachably mounted to the pressurized product. The container is provided with a container body and a lid sealing an opening of the container body. It is preferable that the lid is provided with a closing part which is broken through by the discharging member, and a movable lid which maintains an open state by covering the closing part and mounting the discharge member and which becomes a close state by removing the discharge member.

In some embodiments of the present disclosure, a discharge device is provided with a pressurized product filling and sealing the concentrate and the pressurizing agent in the container, and a discharge member discharging the concentrate by breaking through the pressurized product. The discharge member is provided with a valve and a cap which covers the valve and is detachably mounted to the pressurized product. A recessed part is provided in any one of the cap and the container, and a projecting part inserting into the inside of the recessed part formed in the other one is provided. By engaging the projecting part to the recessed part, the cap and the container are detachably mounted, and it is preferable to press the projecting part against the bottom of the recessed part by the pressure of the pressurizing agent.

In some embodiments of the present disclosure, a discharge device is provided with a pressurized product filling and sealing the concentrate and the pressurizing agent in the container, and a discharge member discharging the concentrate by breaking through the pressurized product. The discharge member is provided with a valve, and the container is provided with a container body and a lid which seals the opening of the container body. The lid is provided with a closing part which is broken through by the discharge member, and a fitting cylindrical part in order to form a sealing with the valve positioned further downstream than the closing part. A seal member is positioned between the outer surface of the valve and the inner surface of the fitting cylindrical part, and the discharge member is provided with a cap covering the valve. The valve is integrally provided with the cap, and it is preferable to provide a part releasing mechanism which releases a part of the sealing of the seal member by moving the valve due to the operation in which the cap starts removing.

Further, in some embodiments of the present disclosure, the part releasing mechanism is provided with the seal member mounted on any one of the outer surface of the valve and the inner surface of the fitting cylindrical part, and a recessed groove provided on the other one and communicating with the outside. It is preferable that the recessed groove is provided in a position shifting in a moving direction of the valve from a position of the seal member before the cap starts removing.

Specifically, in some embodiments of the present disclosure, the part releasing mechanism is provided with the seal member mounted on the outer surface of the valve and a recessed groove provided on the inner surface of the fitting cylindrical part and communicating with the outside. It is preferable that the recessed groove is provided further downstream than the position of the seal member before the cap starts removing.

In some embodiments of the present disclosure, a valve assembly including the valve and the cap is provided. It is preferable that the valve assembly is provided with the projections which are not configured to contact with the projections of the container before the cap starts removing, and which are configured to contact with the projections of the container when the cap starts removing.

In some embodiments of the present disclosure, it is preferable that the removing condition of the cap when the part releasing mechanism operates and the removing condition of the cap when the projections contact with the projections of the container are equal.

The discharge member is further provided with a cover part covering the cap. It is preferable that a ratchet mechanism is formed on the inner surface of the cover part and the outer surface of the cap so as to perform idling when the cover part is rotated in the removing direction of the cap.

In some embodiments of the present disclosure, alternatively, it is preferable that the discharge member is further provided with the cover part covering the cap, and the cover part is engaged with the pressurized product.

In some embodiments of the present disclosure, alternatively, it is preferable that the discharge member is further provided with the cover part covering the cap, and the cover part is provided with an engaging part, so that the cover part is rotatably engaged to the cap around the axis of the cap.

In some embodiments of the present disclosure, the container body is provided with an outer container and an inner container having flexibility to be stored inside the outer container. It is preferable that the inside of the inner container is a concentrate chamber filling the concentrate, and a space between the outer container and the inner container is a pressurizing agent chamber filling the pressurizing agent. Alternatively, it is preferable that the inside of the inner container is a pressurizing agent chamber filling the pressurizing agent, and a space between the outer container and the inner container is a concentrate chamber filling the concentrate.

In some embodiments of the present disclosure, it is preferable that the lid is provided with an annular disk part covering the upper end surface of the outer container, a lid part closing the opening of the inner container, a fitting cylindrical part provided at the central part of the annular disk part, a closing part provided at the bottom part of the fitting cylindrical part, and a concentrate passage communicating between the inside of the fitting cylindrical part and the concentrate chamber when opening the closing part.

In some embodiments of the present disclosure, discharge device is provided with a pressurized product filling and sealing the concentrate and the pressurizing agent in the container, and a discharge member discharging the concentrate by breaking through the pressurized product. The discharge member is provided with a valve, the cap which covers the valve and detachably mounts the valve to the pressurized product, and a cover part covering the cap. The container is provided with a container body, and a lid sealing the opening of the container body. The lid is provided with a closing part which is broken through by the discharge member, and a fitting cylindrical part in order to form a sealing with the valve positioned further downstream than the closing part. It is preferable that a ratchet mechanism is formed on the inner surface of the cover part and the outer surface of the cap so as to perform idling when the cover part is rotated in the removing direction of the cap.

Further, in some embodiments of the present disclosure, it is preferable that the valve and the cap are integrated. Further, it is preferable that the cover part is provided with an engaging part, so that the cover part is rotatably engaged to the cap around the axis of the cap.

The container is provided with the container body, and the lid sealing the opening of the container body. It is preferable that the lid is provided with the closing part pushing down by the mounting of the discharge member, a thin part provided around the closing part and forming a through hole by the mounting of the discharge member, and a plurality of coupling parts restricting the falling-off from the lid of the closing part.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims. In the drawings, the size and relative sizes of layers and regions may be exaggerated for clarity. Like numbers refer to like elements throughout. The terminology used herein is for the purpose of describing particular embodiments only and is not intended to be limiting of the invention. As used herein, the singular forms "a", "an" and "the" are intended to include the plural forms as well, unless the context clearly indicates otherwise. As used herein, the term "and/or" includes any and all combinations of one or more of the associated listed items and may be abbreviated as "/". It will be understood that, although the terms first, second, etc. may be used herein to describe various elements, these elements should not be limited by these terms. Unless indicated otherwise, these terms are only used to distinguish one element from another. For example, a first object could be termed a second object, and, similarly, a second object could be termed a first object without departing from the teachings of the disclosure. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. It will be understood that when an element is referred to as being "connected" or "coupled" to or "on" another element, it can be directly connected or coupled to or on the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.). However, the term "contact," as used herein refers to direct contact (i.e., touching) unless the context indicates otherwise. Terms such as "same," "planar," or "coplanar," as used herein when referring to orientation, layout, location, shapes, sizes, amounts, or other measures do not necessarily mean an exactly identical orientation, layout, location, shape, size, amount, or other measure, but are intended to encompass nearly identical orientation, layout, location, shapes, sizes, amounts, or other measures within acceptable variations that may occur, for example, due to manufacturing processes. The term "substantially" may be used herein to reflect this meaning. Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

BRIEF DESCRIPTION OF THE DRAWINGS

The disclosed embodiments of the present invention are shown by way of example, and not limitation, in the accompanying figures.

DETAILED DESCRIPTION

Figure 1:
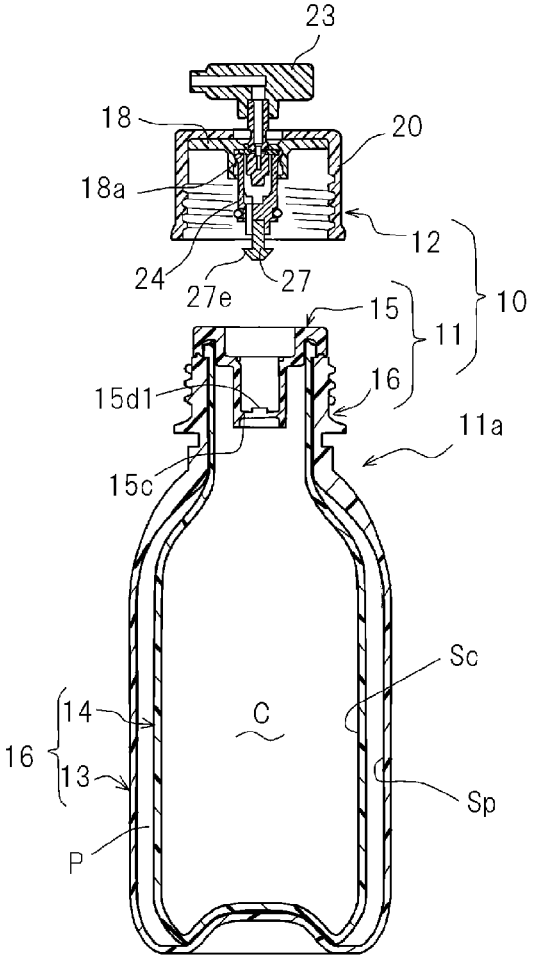
FIG. 1(A) is a cross-sectional view showing a discharge device of the present invention.
FIG. 1(B) is a cross-sectional view of a container body used in the discharge device.
Figure 1:
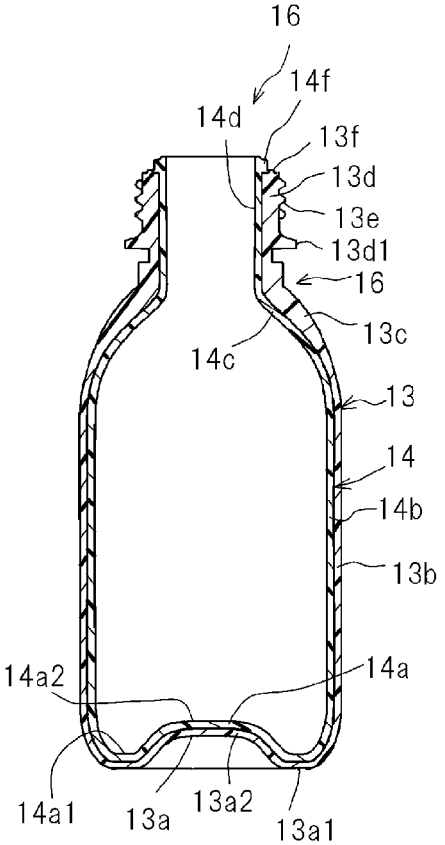

In the following paragraphs, some embodiments of the invention will be described by way of example and not limitation. It should be understood based on this disclosure that various other modifications can be made by those in the art based on these illustrated embodiments.

A discharge device 10 shown in FIG. 1A is provided with a double pressurized container (container) 11, a discharge member 12, and concentrate (contents) C and pressurizing agent P filled in the double pressurized container 11. The double pressurized container 11 in which the concentrate C and the pressurizing agent P are filled is a pressurized product 11*a*. It is sold as a set of products before assembling the pressurized product 11*a* and the discharge member 12 (see FIG. 1A), or an unopened state in which it is half-assembled (see FIG. 3A). The pressurized product 11*a* is sold with the discharge member 12, and it is also sold individually as a replacement. Accordingly, the pressurized product 11*a* is sealed in order not to leak the concentrate C or the pressurizing agent P until the discharge member 12 is mounted (until it is opened by the discharge member 12). Further, the discharge member 12 may be individually sold.

The double pressurized container 11 is provided with an outer container 13, an inner container 14 having flexibility and stored inside the outer container 13, and a lid (sealing disk) 15 sealing the outer container 13 and the inner container 14. A valve or a pump is not provided. The assembly of the outer container 13 and the inner container 14 is a container body 16 (see FIG. 1B). The inside of the inner container 14 is a concentrate chamber Sc in which the concentrate C is filled, and a space between the outer container 13 and the inner container 14 is a pressurizing agent chamber Sp in which the pressurizing agent P is filled. They are sealed by the lid 15. That is, the double pressurized container 11 separately store the concentrate C and the propellant P and is configured to discharge only the concentrate C, and thus, the leakage of the pressurizing agent P such as compressed gas is prevented.

As shown in FIG. 1B, the outer container 13 is provided with a bottom part 13*a*, a cylindrical-shaped body part 13*b*, a should part 13*c*, and a cylindrical-shaped neck part 13*d*. A male screw 13*e* is formed in the outer periphery of the neck part 13*d*. The upper end surface 13*f* of the neck part 13*d* is substantially flat in order to fix the lid 15. In the embodiment, the bottom part 13*a* of the outer container 13 is provided with an annular contact area 13*a*1 projected downwardly, and a dome part 13*a*2 projected upwardly which is provided at the center of the bottom part 13*a*. With this, the pressure resistance improves and the impact resistance at the time of falling-off, etc. improves. Therefore, it is safe at the time of a distribution as a single item or a delivery by a home delivery. Further, it has a contact area 13*a*1, so that it can be stably and simply placed on a flat table, etc. However, it may be a spherical bottom surface.

Figure 2:
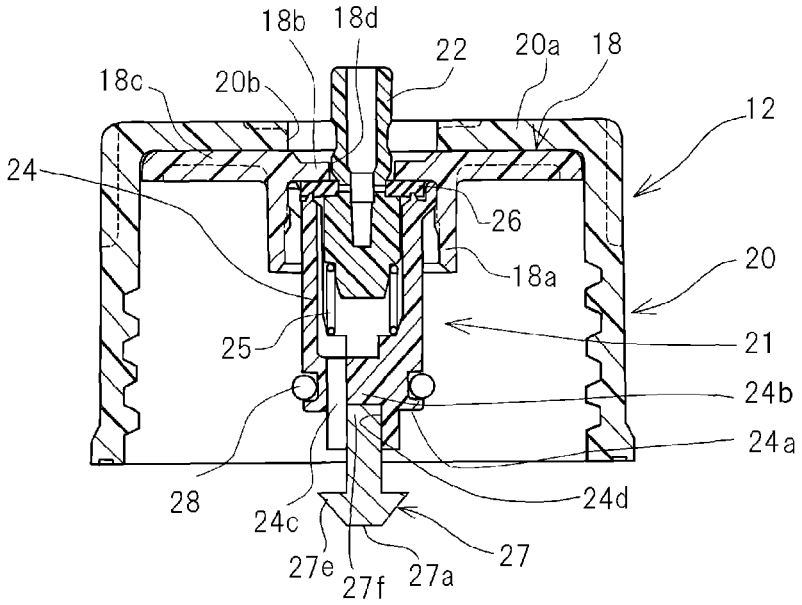
FIG. 2(A) is a cross-sectional view of major parts of the discharge member of FIG. 1(A).
FIG. 2(B) is a cross-sectional view of major parts of the pressurized product.
Figure 2:
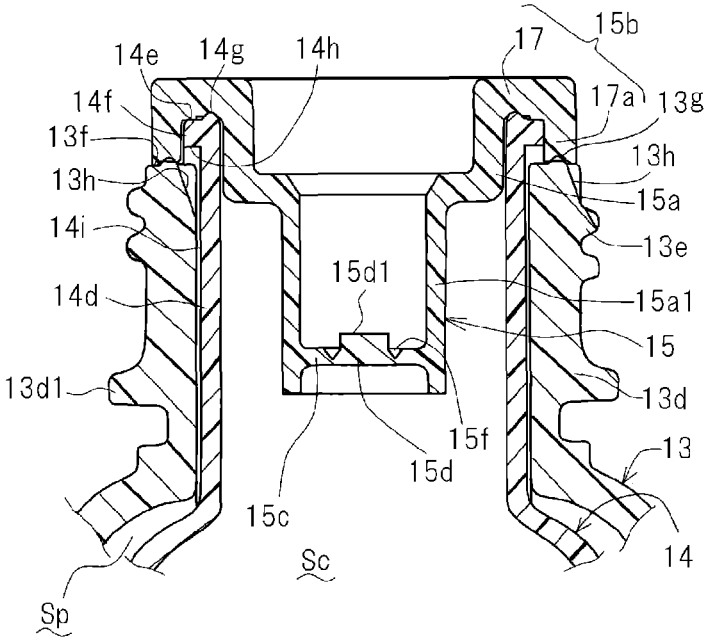

As shown in FIG. 2B, on the upper end surface 13*f* of the neck part 13*d* of the outer container 13, when performing the ultrasonic wave welding, it is easily dissolved with the lid 15 by increasing the contact pressure, and an annular projection 13*g* for making a welding part in order to be integrated with the lid 15 is formed. An annular projection may be provided in the lid 15 side, and it may be provided in both sides. And, at the interior side or the external side of the upper end surface 13*f*, a plurality of inclined parts 13*h* is provided, and it provides a space in which a resin piece made by cooling the melted resin when performing the ultrasonic wave welding is stored. At the outer periphery of the neck part 13*d* of the outer container 13, an annular support part 13*d*1 for hanging at the time of delivery or at the time of welding is provided.

Returning to FIG. 1B, similar to the outer container 13, the inner container 14 is also provided with a bottom part 14*a*, a body part 14*b*, a should part 14*c*, and a neck part 14*d*. Further, at the bottom part 14*a* of the inner container 14, an annular recessed portion 14*a*1 projected downwardly and a dome part 14*a*2 projected upwardly at the center are formed. A small gap is formed between the outer surface of the neck part 14*d* of the inner container 14 and the inner surface of the neck part 13*d* of the outer container 13. The inner surface of the neck part 14*d* of the inner container 14 is a smooth cylindrical surface. The bottom part 14*a* of the inner container 14 abuts on the bottom part 13*a* of the outer container 13, and at the time of filling the pressurizing agent or at the time of fixing the lid 15, etc., it is supported in order not to fall down the inner container 14.

As shown in FIG. 2B, the upper end surface 14*e* of the neck part 14*d* of the inner container 14 projects further than the upper surface 13*f* of the outer container 13, and in its projection part, a flange 14*f* engaging with the upper end surface 13*f* of the outer container 13 is formed. The thickness of the flange 14*f* (dimension in a radial direction) is approximately ⅓ to ½ of the thickness of the neck part 13*d* of the outer container 13. Therefore, when the flange 14*f* is engaged with the upper end surface 13*f* of the neck part 13*d* of the outer container 13, the upper end surface 13*f* of the neck part 13*d* of the outer container 13 remains without covering the outer part. The annular projection 13*g* of the upper end of the outer container 13 is provided at the outer part. Further, at the upper end surface 14*e* of the neck part 14*d* of the inner container 14, an annular projection 14*g* is formed in order to make a welding part with the lid 15 by increasing the contact pressure with the lid 15 at the time of the ultrasonic wave welding.

On the lower surface of the flange 14*f* of the inner container 14, a horizontal groove 14*h* for filling pressurizing agent which is extended in a radial direction is formed at four positions at equal intervals. Further, on the outer peripheral surface of the neck part 14*d* of the inner container 14, a longitudinal groove 14*i* communicating with the horizontal groove 14*h* is formed. The longitudinal groove 14*i* extends to the upper end of the shoulder part 14*c* from the horizontal groove 14*h*, so as to easily fill the pressurizing agent P inside the pressurizing agent chamber Sp.

Both the outer container 13 and the inner container 14 are made of a thermoplastic resin product such as polyethylene terephthalate, polyethylene naphthalate, polyethylene, polypropylene, etc. For example, these containers can be manufactured by inserting a preform for the inner container into a preform for the outer container and performing a blow-molding the part lower than the neck parts 13*d*, 14*d* at the same time. Specifically, it is preferable to use an injection blow molding in which a predetermined shaped preform is formed by performing injection molding and then, performing the blow molding. Further, by raising up the bottom part 13*a* when shaping the dome part 13*a*2, the annular recessed portion 14*a*1 of the inner container can be stretched and made thin, so that the size and weight can be reduced.

As shown in FIG. 2B, the lid 15 is provided with a bottomed cylindrical-shaped seal part 15*a* inserted inside the neck part 14*d* of the inner container 14, and an annular flange 15*b* which continues to the upper end of the seal part. The lower part of the seal part 15*a* is a fitting cylindrical part 15*a*1 which is formed in a diameter smaller than the upper part. At the bottom part of the seal part 15*a*, that is, the bottom part 15*c* of the fitting cylindrical part 15*a*1, a closing part (unsealing part) 15*d* provided with a pressure receiving part 15*d*1 which is made thick as compared with that of the periphery is provided. The closing part 15*d* is normally a circular shape in plane view. Note that other shapes such as a rectangular shape, etc. can be employed.

The periphery of the closing part 15*d* is surrounded by a thin part (break portion, weakening line) 15*f* which is easily breakable such as an annular groove. The pressure receiving part 15*d*1 is approximately entirely provided on the upper surface of the closing part 15*d*, and the thin part 15*f* is formed on the upper surface of the bottom part 15*c*. Note that the thin part 15*f* may be formed on the lower surface. The thin part 15*f* is formed as, for example, a V-groove. The thin part 15*f* is continuously formed as to tear off when the closing part 15*d* is opened, but it may not be continuously formed as long as it is breakable. To prevent the closing part 15*d* from falling-off or disengaging after opening, a coupling part 15*g* extending in a radial direction across the weakening line 15*f* may be provided.

It is preferable that the air inside the inner container 14 can be discharged between the outer peripheral surface of the seal part 15*a* and the inner surface of the neck part 14*d* of the inner container 14 when the lid 15 is mounted to the neck part 14*d* of the inner container, and it is the fitting state in which the concentrate C inside the inner container 14 can be liquid-sealed. Further, it is preferable that the inner peripheral surface of the fitting cylindrical part 15*a*1 forms a smooth cylindrical surface in order not to leak the concentrate C by tightly contacting with the seal member 28 of the valve 21 when opening the closing part 15*d*. It may be a tapered-shape which is reduced downwardly in diameter.

The flange 15*b* of the lid 15 is welded to the upper end surface 13*f* of the neck part 13*d* of the outer container 13 and the upper end surface 14*e* of the neck part 14*d* of the inner container 14 by welding such as the ultrasonic wave welding, the laser welding, the high frequency welding, etc. after filling the concentrate C and the pressurizing agent P, so as to be sealed. In this embodiment, since the annular projection 14*g* is formed on the upper end surface 14*e* of the inner container 14 and the annular projection 13*g* is formed on the upper end surface 13*f* of the outer container 13, the sealing is secured after the welding. Further, it may be adhered for the purpose of which the airtight is enhanced, etc.

The bottom part 15*c* of the fitting cylindrical part 15*a*1 is provided slightly upper position than the lower end of the fitting cylindrical part 15*a*1 because the rigidity of the bottom part 15*c* is enhanced and the thin part 15*f* becomes easily breakable. The dimension of the fitting cylindrical part 15*a*1 is made smaller than the diameter of the upper part of the seal part 15*a* because the molding accuracy of the inner surface of the fitting cylindrical part 15*a*1 is enhanced, so as to miniaturize the area receiving an internal pressure surrounding by the seal member 28 of the discharge member 12 and reduce the upward force applied to the lid 15. Further, this is because the space for storing the valve holding part 18*a* projected downward is secured. The lower end of the fitting cylindrical part 15*a*1 may be a cylindrical shape, but it may be connected by a horizontal groove in order not to accumulate gas between the lower end and the bottom part 15*c*.

The lid 15 is provided with an annular disk part 17 expanding radially outwardly from the upper end of the seal part 15*a*, and an outer cylindrical part 17*a* extending downwardly from the outer edge of the annular disk part 17. The lower surface of the annular disk part 17 is the sealing part by abutting on the upper end surface 14*e* of the neck part 14*d* of the inner container 14 and forming a welding part, and the lower surface of the outer cylindrical part 17*a* is the sealing part by abutting on the upper end surface 13*f* of the neck part 13*d* of the outer container 13 and forming the welding part.

It is preferable that the material of the lid 15 uses a thermoplastic resin which is excellent thermal bondability with the outer container 13 and inner container 14, and in order to enhance the welding strength, it is preferable to use the same material in the outer container 13 and the inner container 14. As shown in FIG. 1A, the concentrate chamber Sc and the pressurizing agent chamber Sp are sealed by the lid 15, and by fixing any one of the inner container 14 and the outer container 13, or both containers, the contents (concentrate C, pressurizing agent P) can be safely stored for a long period of time without any leakage. The thin part 15*f* has sufficient sealing function in the unopened state, and it has a shape so that it is broken easily.

The concentrate C may be skin supplies such as face cleanser, detergent, bath agents, moisturizers, cleansing agents, sunscreen, skin lotions, shaving agents, depilatory agents, antiperspirants, sterilizing disinfectants, pest repellents, etc. human body goods such as hair supplies, etc. of treatment agents, styling agents, hair dyeing agents, etc., foods such as whipped cream, olive oil, etc., household goods such as deodorants, fragrances, insect repellent agents, insecticide, pollen remover, germicide, detergent, etc., and industrial supplies such as lubricants, etc. However, it is not limited to these purposes of use. It is preferable that the concentrate C contacts with the inner surface side of the closing part 15*d*. With this, at the time of welding the lid 15 and the container body 16, the closing part 15*d* is cooled by the concentrate C, and it can solve the problem of melting the closing part 15*d* by heat.

The pressurizing agent P is preferably compressed gas such as nitrogen gas, compressed air, carbon dioxide gas, etc. The pressure inside the double pressurized container 11 by the pressurizing agent is 0.1 to 0.5 MPa (25° C., gauge pressure), and particularly, it is preferably 0.3 to 0.5 MPa (25° C., gauge pressure) which is almost the same pressure as carbonated drink. Further, the capacity of the outer container 13 is preferably 30 to 500 ml. The capacity of the inner container (concentrate chamber Sc) 14 is preferably approximately 20 to 300 ml. The capacity of the pressurizing agent chamber Sp is preferably approximately 10 to 200 ml.

As described above, the pressurized container 11 has less number of components, and the operation part such as a valve, etc. is not provided, so that it can be manufactured inexpensively. Since the pressure of the double pressurized container 11 is low and is almost same as the carbonated drink, etc., it is safe when a consumer carries or when a distributor deliveries. Further, in case, if the outer container 13 cracks, only the pressurizing agent P leaks, but the concentrate C inside the inner container 14 does not leak. Therefore, the safety is further increased.

Further, the outer container 13 and the inner container 14 of the pressurized product 11*a* is made of synthetic resin, and the inner container 14 is surrounded by the pressurizing agent P and is further surrounded by the outer container 13, so that the elasticity of the discharge product 11*a* is high and it is hardly broken. Further, since the closing part 15 is provided inside, it reduces the risk that the closing part 15*d* is erroneously broken. Therefore, the safety is further increased.

As shown in FIG. 2A, the discharge member 12 is provided with a cap (mounting part) 20 screwing the male screw 13*e* of the neck part 13*d* of the outer container 13, the valve 21 covered by the cap 20, and an operation button (actuator, reference numeral 23 in FIG. 1A) provided with a discharge nozzle mounted to the stem 22 of the valve 21. The cap 20 is a bottomed cylindrical shape, and a female screw is formed on the inner peripheral surface. At the center of the upper bottom 20*a* of the cap 20, an opening 20*b* passing through the base part of the operation button 23 is formed. The cap 20 and the valve 21 in which the operation button 23 is not mounted are treated as a valve unit or a valve assembly.

The valve 21 is provided with a bottomed cylindrical shape housing 24, a seal opening part 27 detachably mounted to the housing 24, the aforementioned stem 22 vertically movably stored inside the seal opening part, a spring 25 energizing the stem 22 upwardly, a stem rubber 26, and a valve holder 18 provided with a cylindrical-shaped valve holding part 18*a* holding the upper part of the housing 24, and configures a discharge passage of the concentrate C. The stem 22, the spring 25, the stem rubber 26 configures a valve mechanism for switching a discharge state and a non-discharge state of the concentrate C, and the housing 24 and the valve holder 18 configures a storing space in which the valve mechanism is stored.

In this embodiment, at the lower end of the housing 24, a columnar-shaped seal opening part 27 projecting downwardly is mounted. Further, at the lower part circumference of the housing 24, a seal member 28 such as an O-ring, etc. is mounted. The bottom surface 27*a* of the seal opening part 27 is made flat in order to abut on the upper surface of the pressure receiving part 15*d*1.

In this embodiment, the diameter of the seal opening part 27 is slightly larger than the pressure receiving part 15*d*1. Further, it is same as the diameter of the range surrounding the thin part 15*f* or slightly larger. In the outer periphery of the seal opening part 27, an engaging projection 27*e* for engaging with the lid 15 is provided. The engaging projection 27*e* is arranged, so that it is easily inserted into the lid 15 and it is prevented from coming off, and the lower end of the valve 21 is an arrowhead-shape. Further, the upper part of the seal opening part 27 is provided with a columnar-shaped mounted part 27*f* mounted in the lower end of the housing 24. The mounting part 27*f* is inserted into the insertion hole 24*d* provided in the lower part of the housing 24.

The seal member 28 seals between the inner peripheral surface of the fitting cylindrical part 15*a*1 of the lid 15 and the housing 24 before opening and after closing.

In the housing 24, as a passage communicating between the inside of the housing 24 and the concentrate chamber Sc inside the inner container 14, a vertical hole 24*c* passing through the bottom plate 24*b* of the housing 24 vertically is provided. The planar shape of the vertical hole 24*c* may be, for example, a fan shape. It is preferable to provide a plurality of vertical holes 24*c*. Accordingly, even if one of the vertical holes 24*c* is clogged, other vertical holes 24 can communicate.

Figure 3:
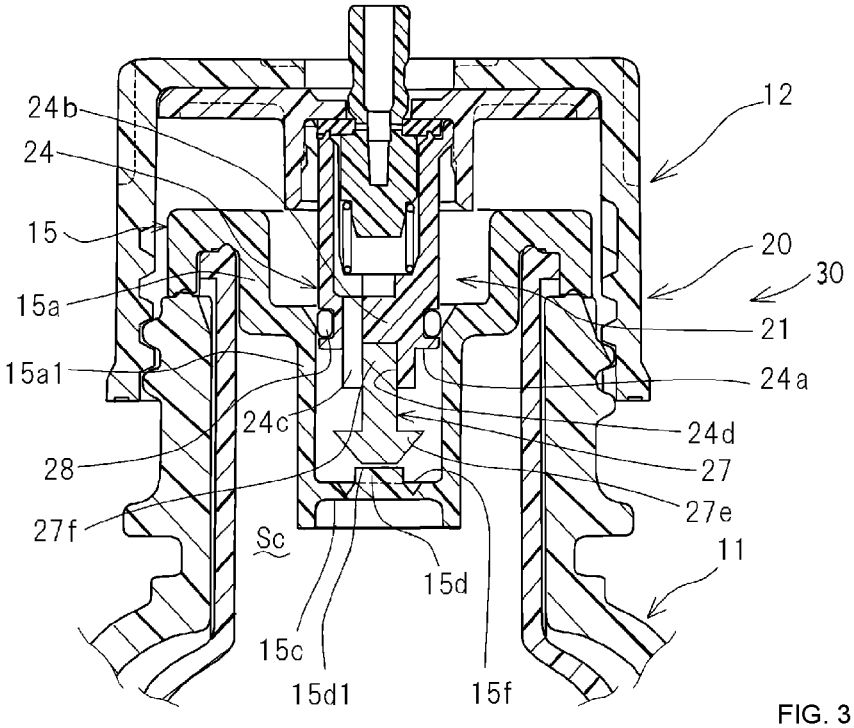
FIG. 3(A) is a cross-sectional view of major parts showing the state before opening the pressurized product.
FIG. 3(B) is a cross-sectional view of major parts showing the state after opening the pressurized product.
FIG. 3(C) is a cross-sectional view of major parts showing the state of removing the discharge member from the pressurized product.
Figure 3:
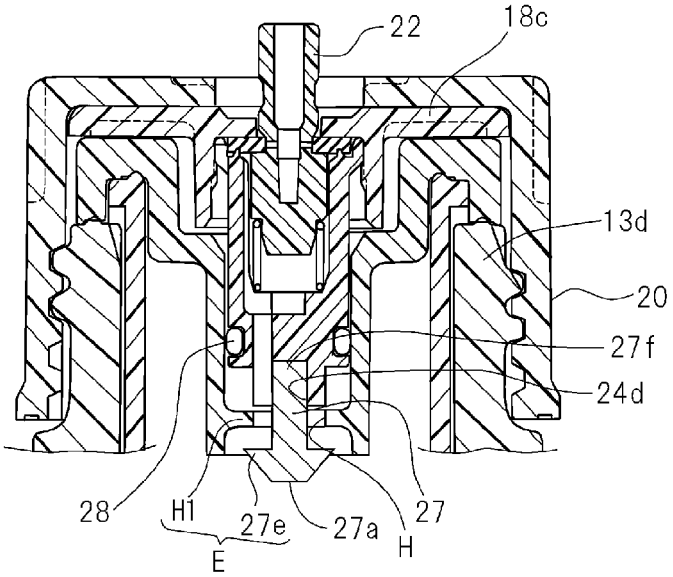
Figure 3:
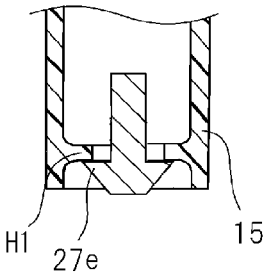

As shown in FIG. 3A, the height direction position of the bottom surface 27*a* of the seal opening part 27 is a position where it abuts to the pressure receiving part 15*d*1 when screwing the cap 20 to the male screw 13*e* of the outer container 13 approximately one time to two times. Therefore, at the time of delivery or at the time of distribution, the closing part 15*d* is not broken by loosely screwing the cap 20, and the discharge member 12 and the double pressurized container 11 can be temporarily connected while keeping the sealing state.

The valve holder 18 is provided with a valve holding part 18*a*, an annular rubber retainer 18*b* extending to the inner side from the upper end of the valve holding part 18*a*, and a flange 18*c* expanding to the outside, and a hole 18*d* passing through the stem 22 to the center of the rubber retainer 18*b* is formed. The valve holder 18 is lightly fitted to the cap 20. Specifically, the outer diameter of the flange 18*c* and the diameter of the inner peripheral surface of the cap 20 are almost equal in size, and it is configured to make slight friction. Therefore, even if the user holds only the cap 20, the valve holder 18 does not come off from the cap 20. On the other hand, when the user removes the valve holder 18 from the cap 20, it is easily removed. Note that the valve holder 18 may not be fitted to the cap 20.

When the user uses the purchased discharge device 10, first, the cap 20 screws into the male screw 13*e* of the outer container. With this, the entire cap 20 and the valve 21 are lowered, and the bottom surface 27*a* of the seal opening part 27 pushes down the closing part 15*d*. With this, the thin part 15*f* is broken, and the closing part 15*d* tears off from the fitting cylindrical part 15*a*1, and it is separated from the bottom part 15*c* and it falls off. And, the seal opening part 27 breaks through the bottom part 15*c* of the fitting cylindrical part 15*a*1, and the inside of the housing 24 and the concentrate chamber Sc which is inside the inner container 14 are connected (see FIG. 3B). The fallen closing part 14*d* is fallen into the bottom of the inner container 14. The lower end of the seal opening part 27 is inserted inside the inner container 14 from the through hole H made by breaking through the bottom part 15*c*. In this case, the engaging projection 27*e* is also inserted inside the inner container 14 from the through hole H. Note that in order not to seal the through hole H by the engaging projection 27*e*, the engaging projection 27*e* is positioned lower side than the lower surface of the bottom part 15*c*, and a space is formed between the engaging projection 27*e* and the bottom part 15*c*.

Note that the cap 20 is screwed into the outer container 13, so that the fall amount of the valve 21 with respect to the operation amount of the cap 20 is small. Therefore, the bottom surface 27*a* of the seal opening part 27 gradually pushes the pressure receiving part 15*d*1 of the closing part 15*d*. The lid 15 is made of synthetic resin, so that when gradually pushing, the closing part 15*d* easily stretches and is not breakable by its extensibility. However, in this embodiment, the closing part 15*d* is surrounded by the annular thin part 15*f*, and the pressure receiving part 15*d*1 projects, so that the stress concentration to the thin part 15*f* increases and it can be smoothly broken. Further, the bottom surface 27*a* of the seal opening part 27 is flat, so that it is hard to be deformed by the opening operation, and the discharge member 12 can be repeatedly used.

The closing part 15*d* is provided on the center axis of the lid 15 and has almost circular-shaped pressure receiving part 15*d*1, which is thickened to the upper part, and further, abuts on the circular-shaped bottom surface 27*a* of the seal opening part 27, so that when applying the pressure by the bottom surface 27*a*, the closing part 15*d* is pushed straight down, and it is broken along the thin part 15*f*, and the broken closing part 15*d* is fallen off, and it is fallen into the bottom of the inner container 14. However, the pressure receiving part 15*d*1 or the bottom surface 27*a* of the seal opening part 27 is inclined, and the thin part 15*f* may be broken in the order from one side to the other side. Further, it is acceptable that the closing part 15*d* may not be fallen off and connected via the thin part 15*f*, etc. as long as the engaging projection 27*e* of the seal opening part is engaged with the broken edge H1.

When breaking the closing part 15*d*, there is a case in which the concentrate C is leaked from the space between the inner periphery of the bottom part 15*c* and the outer periphery of the seal opening part 27. However, the space between the fitting cylindrical part 15*a*1 and the housing 24 is sealed by the seal member 28, so that the concentrate C is stored inside the fitting cylindrical part 15*a* and it does not leak outside. Further, the reaction force at the time of breaking and the internal pressure after breaking are functioned as to push up the housing 24, but the cap 20 and the outer container 13 are screwed, and the upper bottom 20*a* of the cap 20 and the valve holder 18 are functioned in a double support manner, so that jumping out the discharge member 12 is suppressed. In this state, it can be said that the valve 21 is mounted by the cap 20. Further, the deformation of the upper bottom 20*a* of the cap 20 is suppressed.

After mounting the discharge member 12, the user presses the operation button 23 mounted in the stem 22, the stem 22 is lowered and the stem rubber 26 is bent, so as to open the stem hole. Since the concentrate C inside the concentrate chamber Sc is pressurized by the pressurizing agent P via the inner container 14, it is discharged outside via the seal opening part 27, the housing 24, the stem 22, and the operation button 23. When releasing a finger from the operation button 23, the stem 22 is raised, and the discharging stops. The pressurizing agent chamber Sp in which the pressurizing agent P is filled is closed by the lid 15, and it does not communicate with outside or the concentrate chamber Sc, so that the pressurizing agent P is not leaked outside by the discharge operation.

Further, even if the cap 20 is removed from the outer container 13, the engaging projection 27*e* of the valve 21 is engaged with the edge H1 of the through hole H of the lid 15, so that the valve 21 does not come off from the pressurized product 11*a*. If strong pull-out force is applied to the valve 21, or if the valve 21 is intentionally removed from the pressurized product 11*a*, the seal opening part 27 is removed from the housing 24, and the state of sealing the through hole H maintains (see FIG. 3C). In this state, it can be said that the seal opening part 27 maintains the mounting state of the valve 21 and the pressurized product 11*a*. That is, the discharge device 10 of the present invention is provided with an engaging means E maintaining the mounting state to the pressurized product 11*a* of the valve 21 against the pressure of the pressurizing agent P. Further, in this state, it can be said that the engaging means E maintaining the mounting state to the pressurized product 11*a* of the valve 21 against the pressure of the pressurizing agent P is configured by the engaging projection 27*e* of the valve 21 and the edge H1 of the through hole H of the pressurized product 11*a*.

In this way, the discharge device 10 of the present invention is provided with, in addition to the mounting of the valve 21 by the cap 20, a maintaining mechanism K (engaging means E) maintaining the mounting state of the valve 21 to the pressurized product 11*a*, so that in comparison with the case in which the valve 21 is fixed to the pressurized product 11*a* by only the cap 20, the unintentional removal of the valve 21 can be effectively suppressed.

After discharging the total quantity of the concentrate C, rotating the cap 20, the discharge member 12 is removed from the pressurized product 11*a*. And, the removed the discharge member 12 is mounted to a new pressurized product 11*a*. Note that since the seal opening part 27 remains in the pressurized product 11*a* side, when the discharge member 12 is mounted to the new pressurized product 11*a*, a new seal opening part 27 is mounted to the housing 24 or the valve 21 itself is replaced to a new one.

Next, another embodiment of the discharge device will be described with reference to FIGS. 4A and 4B. In the discharge device 30 of FIG. 4A, in addition to the valve 121, an engaging projection is also provided in the pressurized product 11*a*. Specifically, the engaging projections 15*h* are provided in the radial inner direction from the inner peripheral surface of the seal part 15*a* of the lid 115. The engaging projections 15*h* are not continuously provided in the circumferential direction, and a space 15*i* is formed between the engaging projections 15*h*, 15*h*. In this state, the space 15*i* is provided adjacent to the engaging projections 15*h*. The width of the space 15*i* is wider than an engaging projection 18*e* which will be described later. Further, it is preferable to provide the engaging projections 15*h*, 15*h* at equal intervals each other (see FIG. 5B).

The engaging projections 18*e* of the discharge member 112 are provided in radial outward direction from the outer peripheral surface of the valve holding part 18*a* of the valve holder 118. Further, the engaging projections 18*e* are not continuously provided, and a space 18*f* is formed between the engaging projections 18*e*, 18*e*. In this state, the space 18*f* is provided adjacent to the engaging projections 18*e*. The width of the space 18*f* is wider than the engaging projection 15*h* of the lid 15. Further, it is preferable to provide the engaging projections 18*e*, 18*e* at equal intervals each other. Further, it is preferable that the pitch is equivalent to the space 15*i* of the lid 15 (see FIG. 5A).

Figure 6:
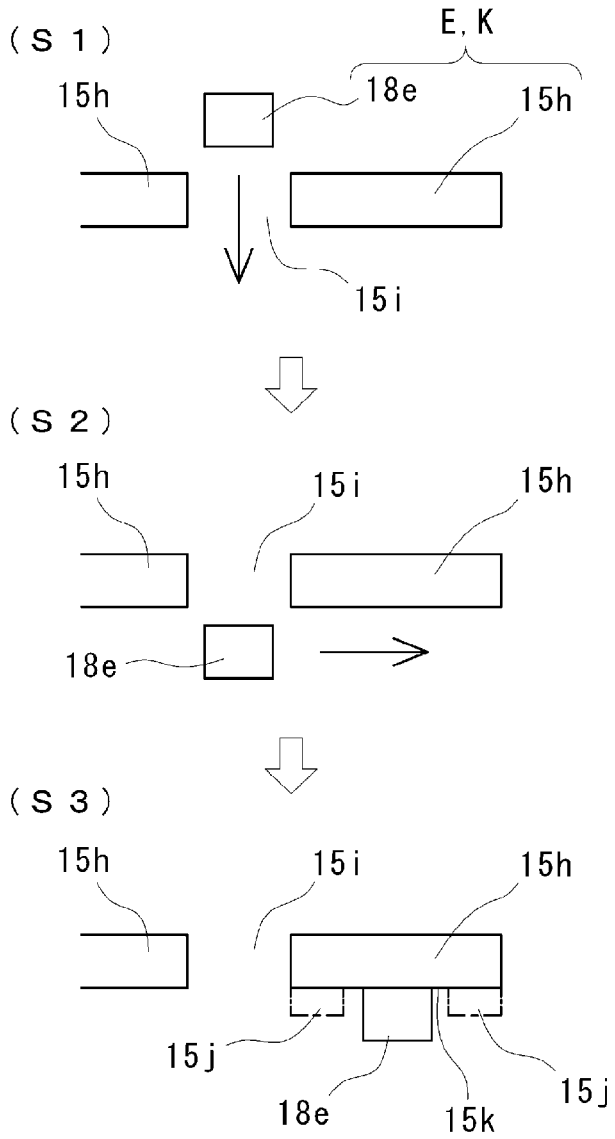
FIG. 6 is a schematic diagram of an engaging means.

The pressurized product 11*a* and the valve 121 of the aforementioned configuration are assembled as follows. First, the valve 121 is removed from the discharge member 112. The outer diameter of the flange 18*c* of the valve 121 is smaller than the diameter (inner diameter) of the inner peripheral surface of the cap 120, so that the valve 121 can be easily removed. Next, the valve 121 is inserted inside the seal part 15*a* of the lid 115. In this case, the engaging projection 18*e* of the valve holder 118 is inserted inside the seal part 15*a* through the space 15*i* between the engaging projections 15*h*, 15*h* of the lid 15 (see 51 of FIG. 6). And, the valve 121 is pushed in, and the upper end of the engaging projections 18*e* of the valve holder 118 is positioned lower than the lower end of the engaging projections 15*h* of the lid 15 (see S2 of FIG. 6), and the engaging projections 15*h*, 18*e* are engaged each other by rotating the valve 121 around the axis (see S3 of FIG. 6). In this state, the seal opening part 127 shown in FIG. 4B breaks through the closing part 15*d*. However, since the engaging projections 15*h*, 18*e* are engaged with each other, the valve 121 does not come off from the pressurized product 11*a*, and the concentrate C does not leak. After that, the cap 120 is covered so as to cover the valve 121, and the assembly is completed by screwing to the outer container 13.

In the discharge device 30 of the aforementioned configuration, even if the cap 120 is removed during its use, the engaging projections 18*e* of the valve 121 are engaged with the engaging projections 15*h* of the lid 15, so that the valve 121 does not naturally come off from the pressurized product 11*a*. That is, both of the valve 121 and the pressurized product 11*a* are provided with the engaging means E to maintain the state of mounting to the pressurized product 11*a* of the valve 121 against the pressure of the pressurizing agent P. Further, in this state, the engaging means E maintaining the state of mounting to the pressurized product 11*a* of the valve 121 against the pressure of the pressurizing agent P is configured by the engaging projections 18*e* of the valve 121 and the engaging projections 15*h* of the pressurized product 11*a*.

With this, also, in the discharge device 30 of the present invention, in addition to the mounting of the valve 121 by the cap 120, the maintaining mechanism K (engaging means E) for maintaining the mounting state of the valve 121 to the pressurized product 11*a* is provided, so that in comparison with the case in which the valve 121 is fixed to the pressurized product 11*a* by only the cap 120, the unintentional removal of the valve 121 can be effectively suppressed.

Note that the outer diameter of the flange part 18*c* of the valve holder 118 is made smaller than the inner diameter of the cap 120, so that the unintentional rotation (corotating) of the valve 121 due to the attachment and detachment of the cap 120 is suppressed, and the shifting of the position relation of the engaging projections 15*h*, 18*e* can be prevented. Further, in order not to unintentionally release the engagement state of the engaging projections 15*h*, 18*e* due to the attachment and detachment of the cap 120, the engagement maintaining means may be provided. The engagement maintaining means is, for example, projections 15*j* or recessed parts 15*k* provided on the lower surface (the surface abutting to the engaging projections 18*e* of the valve 121) of the engaging projections 15*h* of the pressurized product 11*a* (see dashed line of FIG. 6). In the case in which the engaging projections 18*e* of the valve 121 is wider than the engaging projections 15*h* of the pressurized product 11*a*, a projection or a recessed part is provided in the engaging projections 18*e* of the valve 121. Further, the surface on which the engaging projections 15*h*, 18*e* are contacted each other may be a rough surface, so that it may be hard to be slippery.

After discharging the total quantity of the concentrate C, rotating the cap 120, the discharge member 112 is removed from the pressurized product 11*a*. In this case, the valve 121 is rotated around the axis, and the engagement of the engaging projections 15*h*, 18*e* is released (engagement and disengagement) by positioning the engaging projections 18 of the valve 121 in the space 15*i* between the engaging projections 15*h*, 15*h* of the lid 15. Note that in this state, it can be said that the engaging projections 15*h* of the lid 115 are positioned at the space 18*f* between the engaging projections 18*e*, 18*e* of the valve 121, and the engagement of the engaging projections 15*h*, 18*e* is released each other. With this, when the space 15*i* (180 between the engaging projections 15*h*, 15*h* (18*e*, 18*e*) is functioned as the engagement releasing part R for releasing the engagement between the engaging projections 18*e* (15*h*), the removal of the valve 121 is facilitated. The removed discharge member 112 is properly cleaned, and is mounted to a new pressurized product 11*a*.

Figure 7:
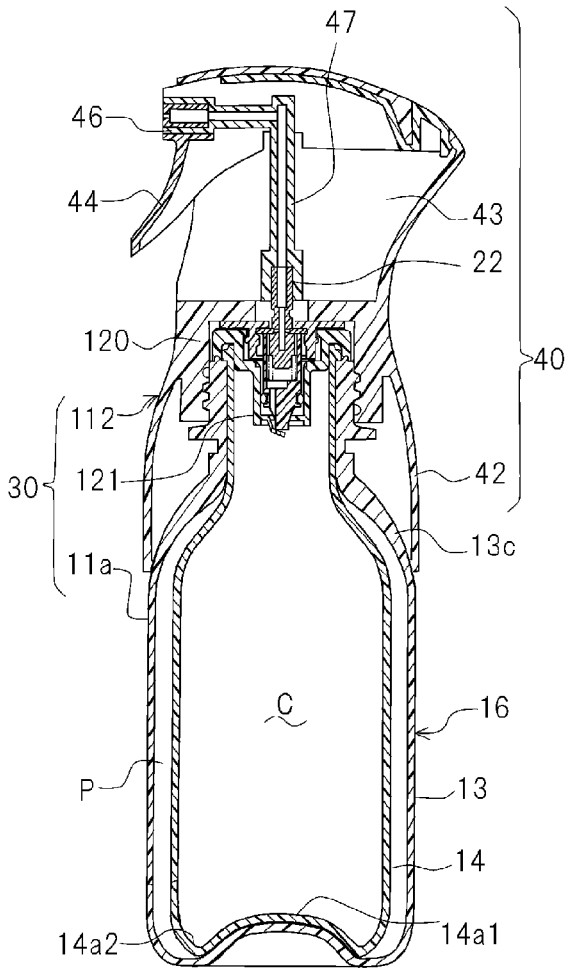
FIG. 7 is a cross-sectional view of a discharge device of FIGS. 4(A) and 4(B).

By the way, as shown in FIG. 7, the discharge member 112 is provided with a lever type operation mechanism 40 for operating the stem 22. The operation mechanism 40 has a cover part 42 which extends downward from the surrounding wall of the cap 120 and covers the shoulder part of the container body 16, and a supporting wall 43 which extends upward from the cap 120. And, the rear end of the operation lever 44 is rotatably connected to the upper rear end of the supporting wall 43 via a hinge or a pin.

A spray nozzle 46 is mounted to the upper part of the operation lever 44. The spray nozzle 46 is mounted to the front end of the L-shaped passage member 47, and the lower end of the passage member 47 is fitted to the stem 22. In the operation mechanism 40, the operation lever 44 is rotated to the lower side around the rear end by holding the cover part 42 or the container body 16 and performing a pulling-operation of the operation lever 44 by the user, so that the discharging is performed by opening the valve 121 via the passage member 47. Such lever operation type operation mechanism 40 is used for, mainly, space sprays such as insect repellent agents or deodorant aromatic air freshener, etc. Such lever type operation mechanism 40 can be used for the pressurized product 11*a* of FIG. 1A.

Note that in the present embodiment, the diameter of the seal opening part 127 is smaller than the pressure receiving part 15*d*1 or the closing part 15*d*. Further, it is slightly smaller than the diameter of the range surrounded by the thin part 15*f*. In this way, at the time of breaking, the bottom surface 27*a* of the seal opening part 127 does not block the pushing of the pressure receiving part 15*d*1 by abutting to the outer periphery part further than the thin part 15*f* of the bottom part 15*c*. Further, after breaking, the bottom surface 27*a* of the seal opening part 127 can be projected downward further than the opening formed by opening the bottom surface 27*a* of the seal opening part 127, so as to facilitate the secure of the passage of the concentrate C (see FIG. 4B).

A plurality of reinforcing plates 27*d* is radially provided between the columnar-shaped seal opening part 127 and the lower surface 24*a* of the housing 124. The number of the reinforcing plates 27*d* is preferably three to five. The reinforcing plates 27 are approximately triangular shape in the side view, and its lower end does not reach the lower end of the seal opening part 127, so that the vicinity of the lower end of the seal opening part 127 is still the columnar shape.

Regarding another configuration of the discharge device 30 of the present embodiment, it is similar to the discharge device 10 of FIG. 1. Accordingly, the same reference numerals are used for the same parts, and the descriptions thereof will be omitted.

Figure 8:
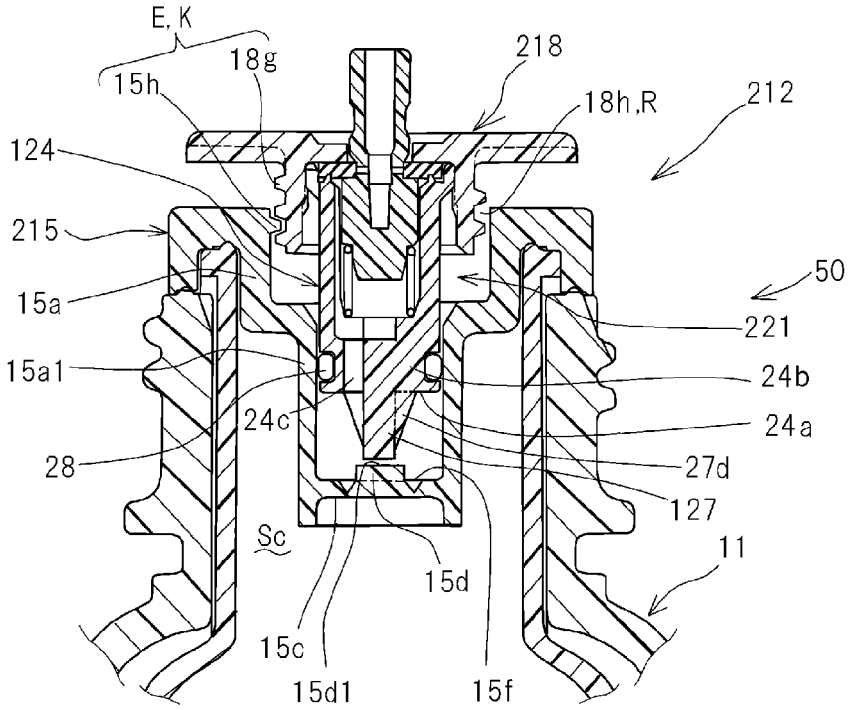
FIG. 8(A) is a cross-sectional view of major parts showing the state before opening the pressurized product according to another embodiment of the discharge device of the present invention.
FIG. 8(B) is a cross-sectional view of major parts showing the state after opening the pressurized product according to another embodiment of the discharge device of the present invention.
Figure 8:
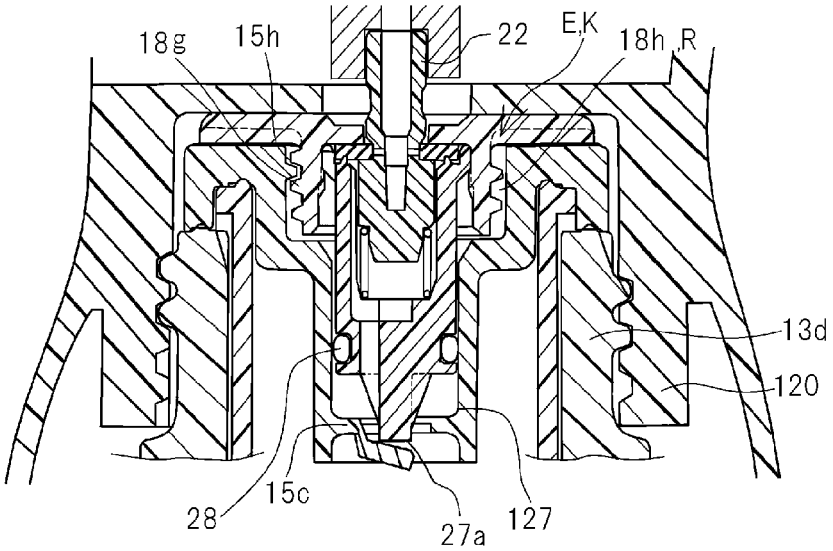

Next, another embodiment of the discharge device will be described with reference to FIGS. 8A and 8B. In the discharge device 50 of FIG. 8A, the engaging projection 18*g* of the valve 221 is a screw shape (spiral shape). The direction of screw is the same direction as the male screw 13*e* of the outer container 13, and it is, for example, right-hand screw. However, it may be the opposite direction. In this case, the corotation of the cap 120 and the valve 221 is surely prevented. The engaging projections 15*h* of the lid 215 are arranged in a manner of providing only one or in a manner of scattering in order to screw with the engaging projections 18*g* of the valve 221. Note that the engaging projections 15*h* of the lid 215 may also be a screw shape.

In the case in which the discharge device 50 of the aforementioned configuration is assembled, the valve 221 is inserted inside the seal part 15*a* of the lid 215, and the engaging projections 15*h* of the lid 215 rotate the valve holder 218 in a screwing manner with the engaging projections 18*g* of the valve 221. When the flange 18*c* of the valve holder 218 is rotated until abutting on the top surface of the lid 215, the seal opening part 127 breaks through the closing part 15*d*, and it becomes the state in which the concentrate C can be sprayed.

Further, in the discharge device 50 of the embodiment, the outer peripheral surface of the flange 18*c* of the valve holder 218 does not abut on the inner peripheral surface of the cap 120, so that even if the cap 120 is removed halfway, the valve holder 218 does not corotate. When the concentrate C inside the inner container 14 becomes empty and the valve 221 is removed, by rotating in the opposite direction from the time of screwing and mounting the valve holder 218, the engagement of the engaging projections 15*h* of the lid 215 and the engaging projections 18*g* of the valve 221 can be released.

In this embodiment, the engaging projections 15*h* of the lid 215 and the engaging projections 18*g* of the valve 221 becomes the engaging means E, so as to be able to maintain the state of being mounted to the pressurized product 11*a* of the valve 221 against the pressure of the pressurizing agent P. Further, since the engaging projections 18*g* of the valve 221 are a screw shape, by only rotating the valve holder 218 in the opposite direction, the valve 221 and the pressurized product 11*a* can be easily disengaged. Accordingly, the space 18*h* between the screw threads of the engaging projections 18*g* as a screw shape can release the engagement with the engaging projections 15*h* by rotating the valve holder 218 in the opposite direction so as to be functioned as the engagement releasing part R. The aforementioned effect is the same even when the engaging projections 15*h* of the lid 215 are a screw shape.

Note that a screw-shaped engaging projection may be provided in only one of the valve 221 (valve holder 218) or the pressurized product 11*a* (lid 215), and when screwing in, the screw groove may be provided in the other one. In this case, it is not required to preliminarily provide the engaging projection in the other side.

With this, in the discharge device 50 of the present invention, in addition to the mounting of the valve 221 by the cap 120, the maintaining mechanism K (engaging means E) in order to maintain the state of being mounted to the pressurized product 11*a* of the valve 221 is provided, so that in comparison with the case in which the valve 221 is fixed to the pressurized product 11*a* by the cap 120, the unintentional removal of the valve 221 can be effectively suppressed. Further, the discharge member 212 can be reused.

Figure 4:
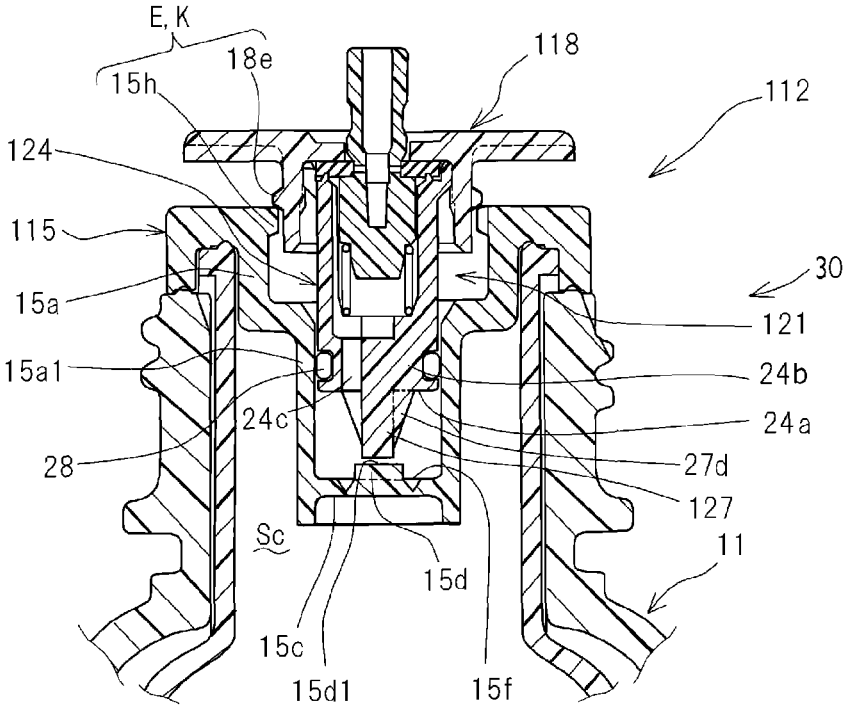
FIG. 4(A) is a cross-sectional view of major parts showing the state before opening the pressurized product according to another embodiment of the discharge device of the present invention.
FIG. 4(B) is a cross-sectional view of major parts showing the state after opening the pressurized product according to another embodiment of the discharge device of the present invention.
Figure 4:
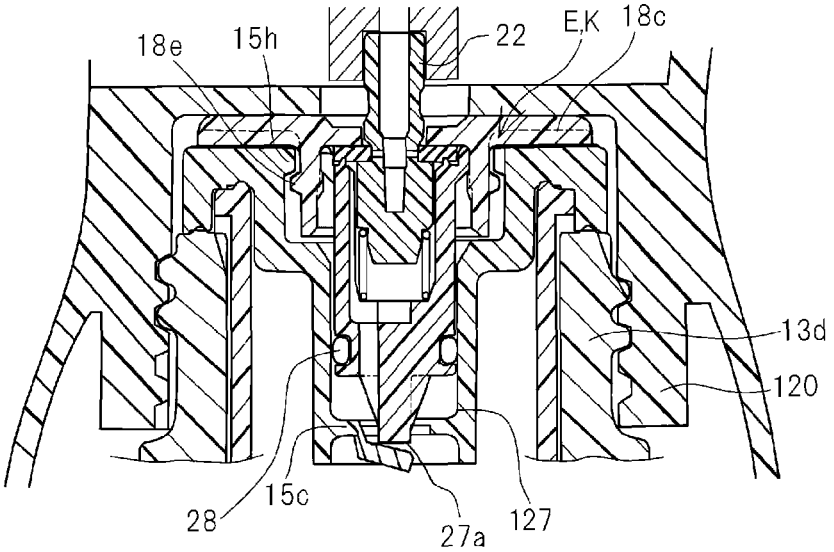
Figure 5:
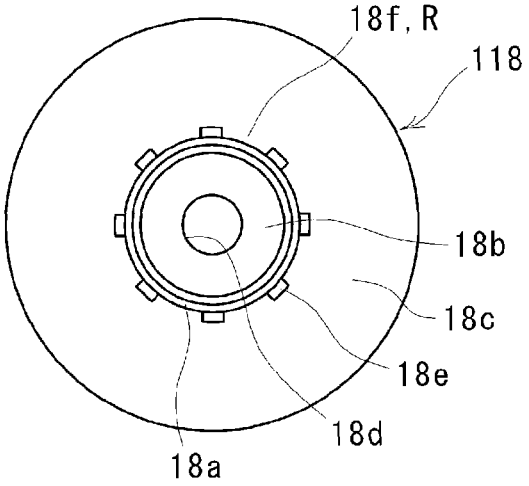
FIG. 5(A) is a diagram looking up from the lower side of a valve holder.
FIG. 5(B) is a diagram looking down from the upper side of the lid.
Figure 5:
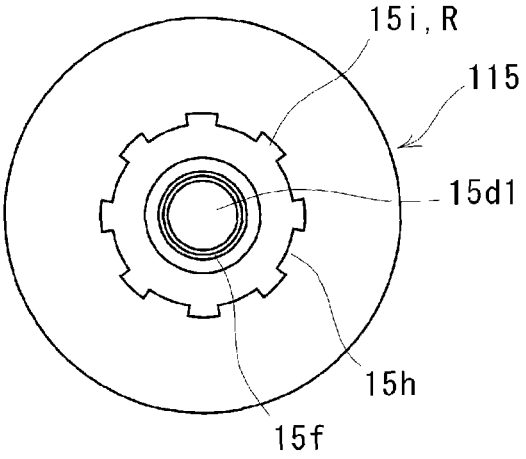

Regarding another configuration of the discharge device 50 of the present embodiment, it is similar to the discharge device 10 of FIG. 4. Accordingly, the same reference numerals are used for the same parts, and the descriptions thereof will be omitted.

Next, another embodiment of the discharge device will be described with reference to FIGS. 9A and 9B. In the discharge device 60 of FIG. 9A, the cap 320 and the operation mechanism 340 are provided as a separate body. The operation mechanism 340 is provided with an inner cylindrical part 41 positioned at outer periphery of the cap 320 as to cover the cap 320, and a cover part 42 extended downward (body part 13*b* side of the outer container 13) from the inner cylindrical part 41.

Figure 9A:
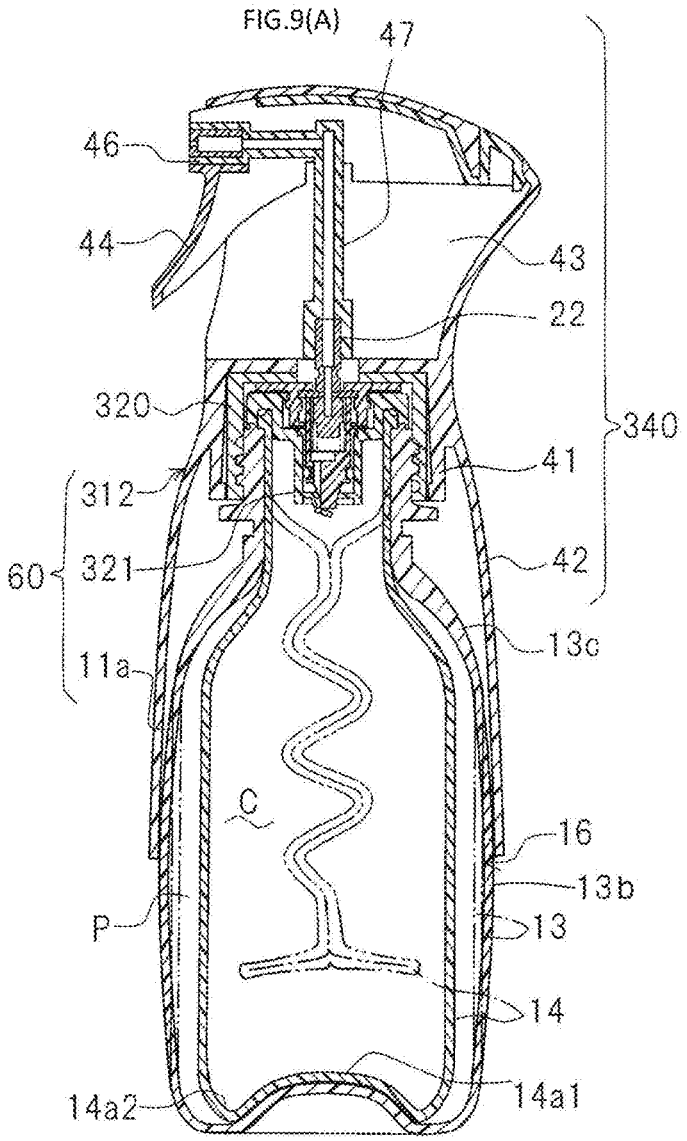
FIG. 9(A) is a cross-sectional view of whole according to still another embodiment of the discharge device of the present invention.
Figure 9B:
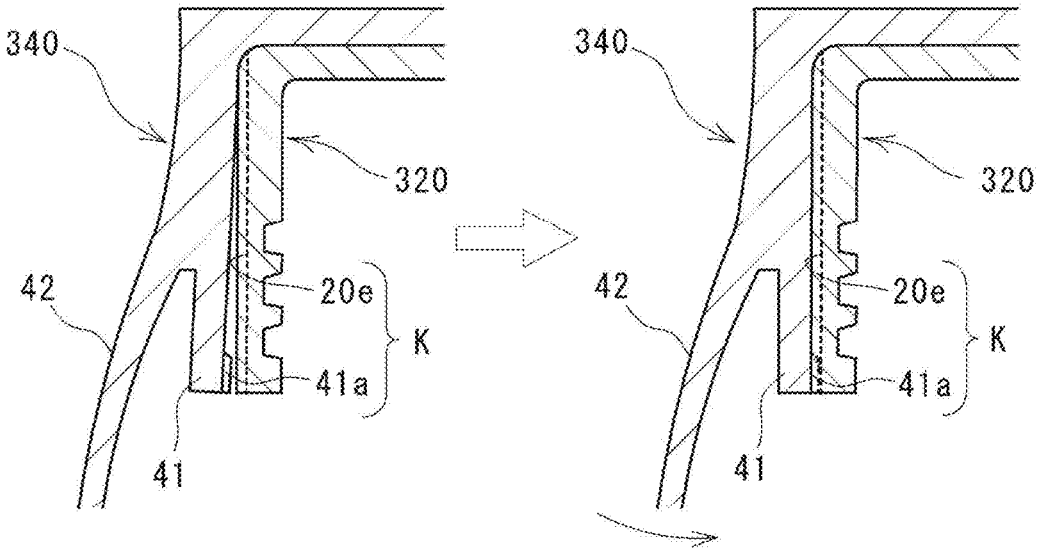
FIG. 9(B) is schematic diagram showing a change of the engagement state between the inner cylindrical part and the cap according to still another embodiment of the discharge device of the present invention.

The inner cylindrical part 41 is a substantially cylindrical shape, and as shown in FIG. 9B, an engaging projection 41*a* is provided on the inner periphery surface. The engaging projection 41*a* is preferably provided at the lower end (body part 13*b* side) of the inner cylindrical part 41. Further, it is preferably provided in a plural number in an equal interval. On the outer peripheral surface of the cap 320, grooves 20*e* engaging with the engaging projections 41*a* are provided. The grooves 20*e* are provided substantially in parallel to the axial direction of the cap 320. It is preferable that the arrangement interval is the same as or more densely than the engaging projections 41*a*.

The cover part 42 is a substantially cylindrical shape, and the upper end is connected to the outer periphery of the cylindrical part 41, and the lower end is externally fitted to the body part 13*b* of the outer container 13 of the double pressurized container 11. The inner diameter of the lower end of the cover part 42 is almost same or slightly smaller than the outer diameter of the body part 13*b* before filling the concentrate C or the pressurizing agent P.

By the way, the body part 13*b* of the outer container 13 is inflated in a manner of enlarging the outer diameter in the state in which the concentrate C and the pressurizing agent P are filled. Therefore, when the cover part 42 is externally fitted to the body part 13*b*, the cover part 42 is enlarged in diameter. And, the inner cylindrical part 41 integrated with the cover part 42 is enlarged in diameter. In this state, as shown in the left diagram of FIG. 9B, the engaging projection 41*a* is not engaged with the groove 20*e*. Accordingly, even if the operation mechanism 340 is rotated around the axis, the cap 320 cannot be rotated. Therefore, the cap 320 cannot be removed from the pressurized product 11*a*, and the mounting state of the valve 321 to the pressurized product 11*a* is maintained.

By discharging the concentrate C, when the pressure inside the double pressurized container 11 is reduced, the outer container 13 contracts, and the outer diameter of the body part 13*b* becomes small (see double-dashed line in FIG. 9A). Then, the cover part 42 is contracted, and the inner diameter of the inner cylindrical part 41 integrated with the cover part 42 becomes small. As a result, the engaging projection 41*a* of the inner cylindrical part 41 is inserted into the groove of the cap 320 (see the right diagram of FIG. 9B). That is, the cap 320 and the inner cylindrical part 41 are firstly engaged in this state. And, when the operation mechanism 340 is rotated around the axis, the cap 320 can be also rotated. Therefore, the discharge member 312 is removed from the pressurized product 11*a* and can be reused. Note that as a timing of engaging the engaging projection 41*a* to the groove 20*e*, preferably, it is after the discharge of the concentrate C is completed.

With this, in the discharge device 60 of the present invention, by the inner cylindrical part 41 in which the inner diameter is reduced by interlocking with the contraction of the double pressurized container 11 due to the reduction of the internal pressure, the maintaining mechanism K in order to maintain the mounting state of the valve 321 to the pressurized product 11*a* is formed. More specifically, by the cover part 42 externally fitted to the double pressurized container 11 and contracted due to the contraction of the double pressurized container 11 due to the reduction of the internal pressure, and the inner cylindrical part 41 integrated with the cover part 42 and contracted due to the contraction of the cover part 42, the maintaining mechanism K is formed.

Regarding another configuration of the discharge device 60 of the present embodiment, it is similar to the discharge device 30 of FIG. 7. Accordingly, the same reference numerals are used for the same parts, and the descriptions thereof will be omitted. Note that the valve 321 is the same as FIG. 4. However, the one shown in FIG. 2 or the one shown FIG. 8 may be used. Further, it may not be provided with the engaging means E. Further, an engaging projection may be provided on the outer peripheral surface of the cap 320, and a groove may be provided on the inner peripheral surface of the inner cylindrical part 41. Further, the engaging projection may be provided on each of the outer peripheral surface of the cap 320 and the inner peripheral surface of the inner cylindrical part 41, and the engaging projections may be engaged each other. Further, it is not limited to the engaging projection 41*a*, and the inner peripheral surface of the inner cylindrical part 41 or the outer peripheral surface of the cap 320 may be made as a rough surface, or a material with high friction coefficient such as a rubber, etc. may be interposed.

Figure 10:
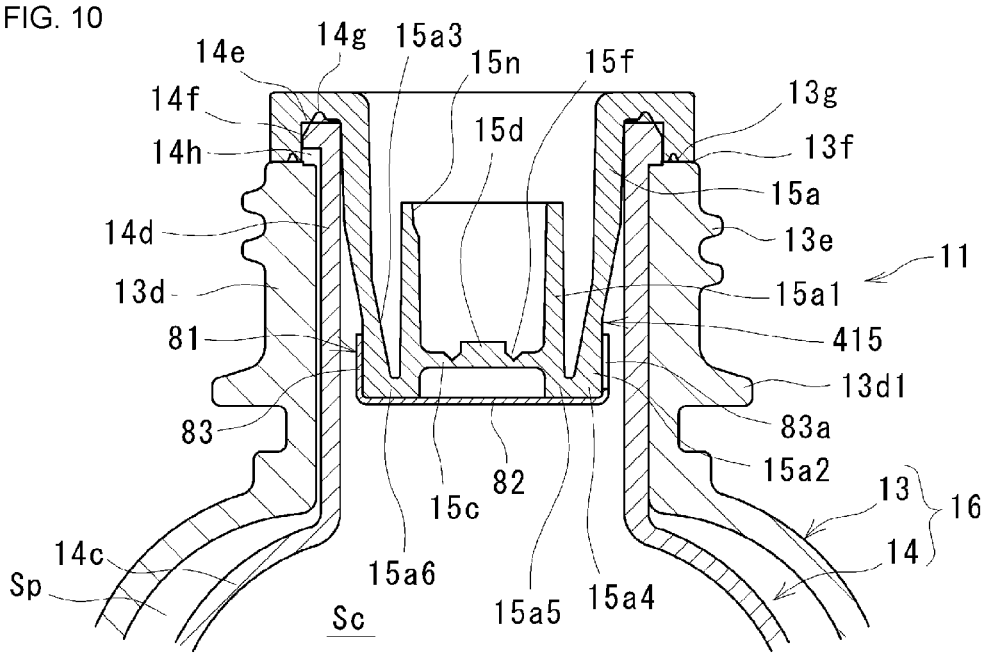
FIG. 10 is a cross-sectional view of major parts showing a pressurized product according to still another embodiment of the discharge device of the present invention.

In the double pressurized container 11 shown in FIG. 10, the shape of the lid 415 is different from the aforementioned another double pressurized container 11. Specifically, a substantially cylindrical-shaped seal part 15*a* extends to the lower side, and a fitting cylindrical part 15*a*1 is concentrically provided inside the seal part 15*a*. The fitting cylindrical part 15*a*1 is raised upward from the central part of the bottom part of the seal part 15*a*, and it opens at the upper end. And, the upper part of the seal part 15*a* is substantially cylindrical shape, and the inner surface of the lower part 15*a*3 is a tapered-shape which is tapered toward the lower side. However, it may be a cylindrical shape from the upper part to the lower part. The outer surface of the lower part 15*a*3 is a tapered-shape which is tapered toward the lower side, but the lower side is a cylindrical shape. Hereinafter, the cylindrical-shaped part is called as a cylindrical part 15*a*2.

The lid 415 is provided with the fitting cylindrical part 15*a*1 inside the seal part 15*a*, and the lower end 15*a*4 of the aforementioned tapered-shape lower part 15*a*3 and the lower end of the lower part cylindrical part 15*a*5 extending downward from the fitting cylindrical part 15*a*1 are connected by a coupling part 15*a*6. Further, the closing part 15*d* is provided at the bottom part 15*c* closing the part slightly higher than the lower end of the lower part cylindrical part 15*a*5. Therefore, when the ultrasonic wave welding is performed to the upper surface of the lid 415 by pressing a horn, the vibration of the horn easily flows to the concentrate C side from the lower end 15*a*4 through the seal part 15*a*. Further, since the closing part 15*d* is provided slightly higher than the coupling part 15*a*6, the vibration is hardly transmitted to the closing par 15*d*. Accordingly, the melting or the penetration, etc. of the weakening line 15*f* is prevented.

Further, in the lid 415, at the upper part of the fitting cylindrical part 15*a*1, a recessed groove 15*n* extending in a vertical direction is provided. The upper end of the recessed groove 15*n* reaches the upper part of the fitting cylindrical part 15*a*1. On the other hand, the lower end of the recessed groove 15*n* does not reach the bottom part 15*c*. That is, the recessed groove 15*n* is not provided at the lower part of the fitting cylindrical part 15*a*1. This is because when the closing part 15*d* is opened by the valve 21, it already becomes the state in which a liquid-tight sealing between the fitting cylindrical part 15*a*1 and the valve 21 is formed by the seal member 28 (see FIG. 11A). For example, the lower end of the recessed groove 15*n* is positioned higher (downstream) than the position of the seal member 28 in the state in which the valve 21 firstly abuts to the closing part 15*d*. The number of the recessed groove 15*n* may be one or may be more than two.

By the way, the lid 15 is provided with a movable lid 81. The movable lid 81 is a cup-shape formed by a bottom part 82, which is the same shape as the cylindrical part 15*a*2 of the seal part 15*a*, and the side wall part 83 raised from the bottom part 82. And, it is externally fitted to the cylindrical part 15*a*2 in a freely sliding manner. At the side wall part 83 of the movable lid 81, a communication passage (slit) 73*a* is provided. This slit is provided toward the lower side from the upper end of the side wall part 83, but it does not reach the bottom part 82, and the side wall part 83 continues in the circumferential direction in the vicinity of the bottom part 82. Note that the communication passage 83*a* is not limited to the slit, and it may be a hole passing through the side wall part 83.

The valve holder 18 of the present discharge device 70 is similar to the one shown in FIG. 4A except the engaging projections 18*e* are not provided. The cap 20, the valve 21, and the container body 16 are similar to the one shown in FIG. 4A.

In the discharge device 70 of the aforementioned configuration, similar to the aforementioned other discharge devices 10 to 60, the pressurized product 11*a* is opened by inserting the cap 20 to the male screw 13*e* of the outer container 13. In this case, the closing part 15*d* is pushed in the seal opening part 27, but as shown in FIG. 11A, the movable lid 81 is downwardly moved by pushing the movable lid 81 by the pushed-in closing part 15*d*. The thin part 15*f* is a C-shape, and the coupling part (part other than the thin part 15*f*) 15*g* becomes a fulcrum, so that the movable range (range) of the closing part 15*d* falls within the range. The length of the fitting part of the side wall part 83 and the cylindrical part 15*a*2 is longer than the movable range of the closing part 15*d*, so that the movable lid 81 does not fall off from the lid 15. Note that the movable lid 81 may be directly pushed down by the seal opening part 27. In the side wall part 83, the communication passage 83*a* is provided, so that when the movable lid 81 is moved downwardly, the inside of the inner container 14 and the inside of the movable lid 81 are connected via the communication passage 83*a* (see the arrow in FIG. 11A). Accordingly, when the user pushes down the stem 22, the concentrate C is discharged from the stem 22.

By the way, the seal member 28 is positioned lower (upstream) than the recessed groove 15*n* in the state in which the cap 20 is completely mounted to the pressurized product 11*a*, that is, before loosening (start removing) the cap 20. Therefore, the inside of the container 14 and the outside (outside air) do not communicate through the space between the fitting cylindrical part 15*a*1 and the valve 21. On the other hand, when loosening (start removing) the cap 20, the entire valve 21 is moved toward the upper side, and the seal member 28 is positioned at the recessed groove 15*n* before removing the cap 20 from the pressurized product 11*a* (in the state in which the cap 20 is still screwed in the male screw 13*e*), and the inside of the inner container 14 and the outside (outside air) become the communicating state (see the arrow in FIG. 11B). Then, the pressure difference between the inside of the inner container 14 and the inside of the movable lid 81 occurs. Specifically, the pressure inside the movable lid 81 becomes smaller than the pressure inside the inner container 14, so that the movable lid 81 is sucked toward the valve 21 (upper side). In other words, the movable lid 81 is pushed upward by the pressure inside the inner container 14. As a result, the communication passage 83*a* is sealed by the cylindrical part 15*a*2, and the communicating state between the inside of the inner container 14 and the outside (outside air) is eliminated. Note that in this case, the seal opening part 27 is already separated from the closing part 15*d*, and the seal opening part 27 does not disturb the sliding of the movable lid 81.

With this, in the discharge device 70, the movable lid 81 covering the closing part 15*d* from the inner container 14 side is provided, and the movable lid 81 maintains the open state by mounting the discharge member 12, and it becomes the close state by removing the discharge member 12, so that in the state in which the concentrate C remains inside the inner container 14, even if the cap 20 is loosened or even if the cap 20 is removed, the leakage of the concentrate C can be suppressed. Note that when loosened or removed cap 20 is mounted again, the movable lid 81 is pushed in to the inner container 14 side again by the seal opening part 27, it is possible to discharge the concentrate C from the stem 22.

Figure 12:
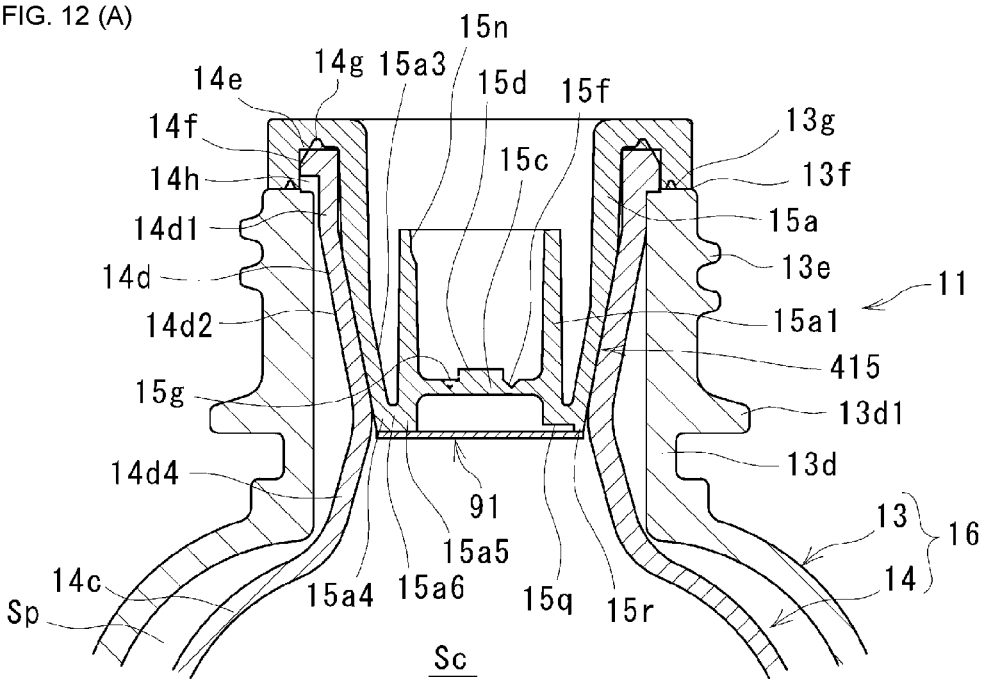
FIG. 12(A) is a cross-sectional view of major parts in the pressurized product used in still another embodiment of the discharge device of the present invention.
FIG. 12(B) is a diagram looking up from the lower side of the movable lid in the pressurized product used in still another embodiment of the discharge device of the present invention.
Figure 12:
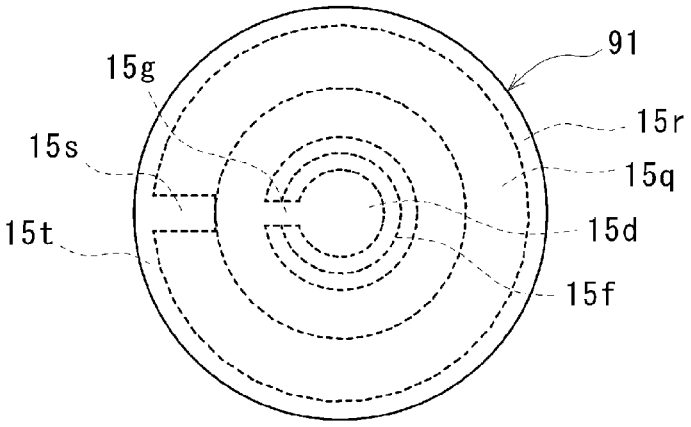

The neck part 14*d* of the inner container 14 of the double pressurized container 11 shown in FIG. 12A is shaped as to almost tightly contact with the outer peripheral surface of the seal part 15*a*, and it is provided with a cylindrical-shaped upper part 14*d*1, a tapered part 14*d*2 which is tapered toward the lower side than the upper part 14*d*1, and an enlarged diameter part 14*d*4 which gradually enlarge the diameter from the lower end of tapered part 14*d*2. The lower end of the enlarged diameter part 14*d*4 continues to the shoulder part 14*c*. That is, the tapered part 14*d*2 of the neck part 14*d* of the inner container 14, the enlarged diameter part 14*d*4, and the upper part of the shoulder part 14*c* form the narrowed part. This narrowed part tightly contacts with the lower part 15*a*3 of the lid 415. Therefore, when the concentrate C is filled to the inner container 14, the gas-phase part (head space) becomes small. Note that the lid 415 is not provided with the cylindrical part 15*a*2.

The movable lid 91 is film-like. The thickness is, for example, 0.2 to 2 mm. The material is preferably the same material as, for example, the lid 415. However, it may be a different material. This movable lid 91 is welded to the lower end of the lid 415 as shown in FIG. 12B. However, it may be bonded. A notch 15*q* is provided at the lower end of the lid 415. The notch 15*q* is provided in approximately C-shape in the state of looking up the lid 415 from the lower side. Further, it is provided to avoid the outer edge of the lid 415. Therefore, the part in which the notch 15*q* is not provided continues annularly. The part in which the notch 15*q* is not provided is defined as an annular wall 15*r*, and only a part of the annular wall 15*r* is made wide toward the center of the circle. The wide portion 15*s* and the coupling part 15*g* to be a fulcrum at the time of the rotation of the closing part 15*d* are provided and aligned on the same straight line viewed from the center of the lid 415. The movable lid 91 is welded both of the wide portion 15*s* and the narrow portion 15*t* which is narrower than the wide portion 15*s*.

Figure 13A:
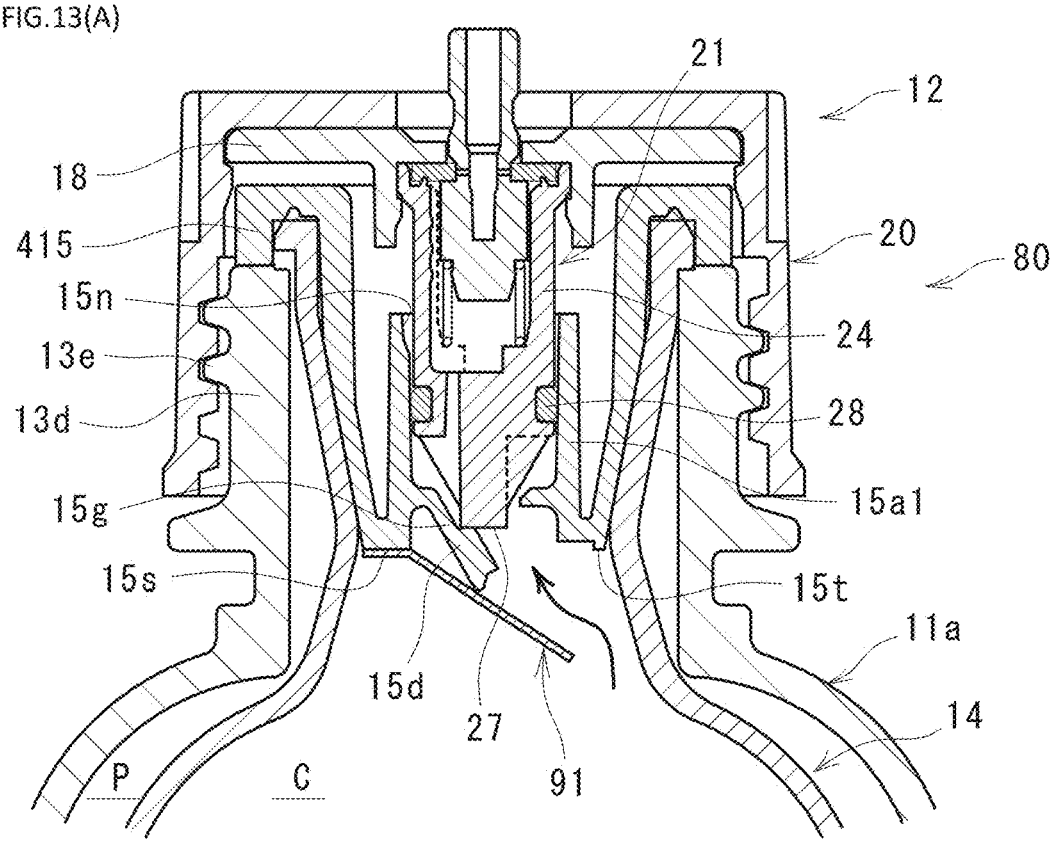
FIG. 13(A) is a cross-sectional view of major parts showing the state after opening the pressurized product of FIGS. 12(A) and 12(B).

In the discharge device 80 of the aforementioned configuration, similar to the aforementioned other discharge devices 10 to 70, the pressurized product 11*a* is opened by screwing the cap 20 to the male screw 13*e* of the outer container 13. In this case, the closing part 15*d* is pushed in to the seal opening part 27, but as shown in FIG. 13A, the movable lid 91 is pushed down by the pushed-in closing part 15*d*. Since the coupling part 15*g* and the wide portion 15*s* are aligned on the same straight line (same direction viewed from the center of the lid 415), mainly, the pushing-down force is applied to the narrow portion 15*t*, not the wide portion 15*s*. Further, in the narrow portion 15*t*, the small portion of the welding area is easily separated in comparison with the wide portion 15*s*. Therefore, the movable lid 91 is gradually separated from the narrow portion 15*t*, and the inside of the inner container 14 and the inside of the movable lid 91 are communicated (see the arrow of FIG. 13A). In this state, when the user pushes down the stem 22, the concentrate C is discharged from the stem 22. Note that the wide portion 15*s* is close to the coupling part 15*g*, and the force is almost not received, so that the movable lid 91 maintains the welding with at least the wide portion 15*s*, and it does not fall down from the lid 415.

Figure 13B:
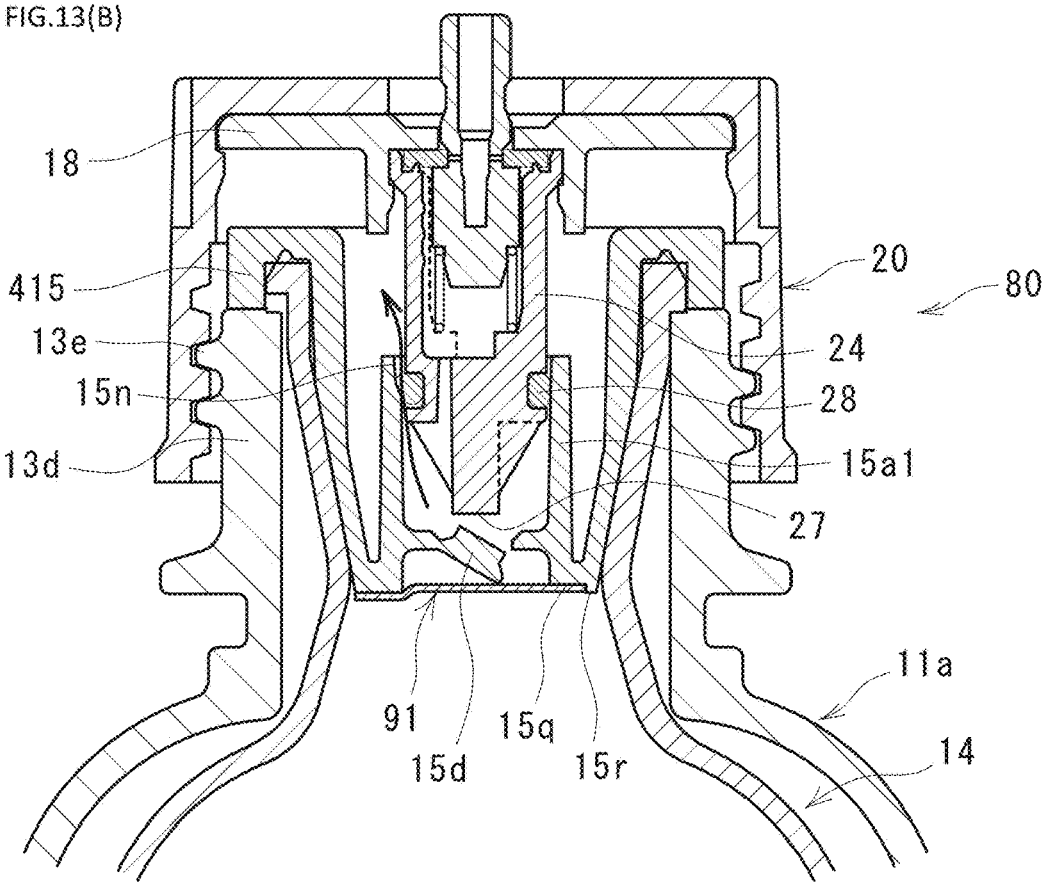
FIG. 13(B) is a cross-sectional view of major parts showing the state of removing the valve from the pressurized product of FIGS. 12(A) and 12(B).

In the discharge device 80, when loosening (start removing) the cap 20, the entire valve 21 is moved upward, and the seal member 28 is positioned at the recessed groove 15*n* before the cap 20 is removed from the pressurized product 11*a* (in the state in which the cap 20 is still screwed in the male screw 13*e*), and the inside of the inner container 14 and the outside (outside air) becomes the communicating state (see the arrow in FIG. 13B). Then, the movable lid 91 is sucked toward the valve 21 (upper side). In other words, the movable lid 91 is pushed upward by the pressure inside the inner container 14. As a result, the movable lid 91 abuts to the lower end of the lid 415. Specifically, the outer peripheral surface of the movable lid 91 abuts to the inner side of the annular wall 15*r*, and the communicating state between the inside of the inner container 14 and the outside (outside air) is eliminated. Note that in this case, the seal opening part 27 is already separated from the closing part 15*d*, and the seal opening part 27 does not disturb the sliding of the movable lid 91.

With this, in this discharge device 80, the movable lid 91 covering the closing part 15*d* from the inner container 14 side is provided, and the movable lid 91 maintains the open state by mounting the discharge member 12, and it becomes the close state by removing the discharge member 12, so that even if the cap 20 is loosened or the cap 20 is removed at the state in which the concentrate C remains inside the inner container 14, the leakage of the concentrate C can be suppressed. Note that when loosened or removed cap 20 is mounted again, the movable lid 91 is pushed in to the inner container 14 side again by the seal opening part 27, it is possible to discharge the concentrate C from the stem 22.

Figure 11:
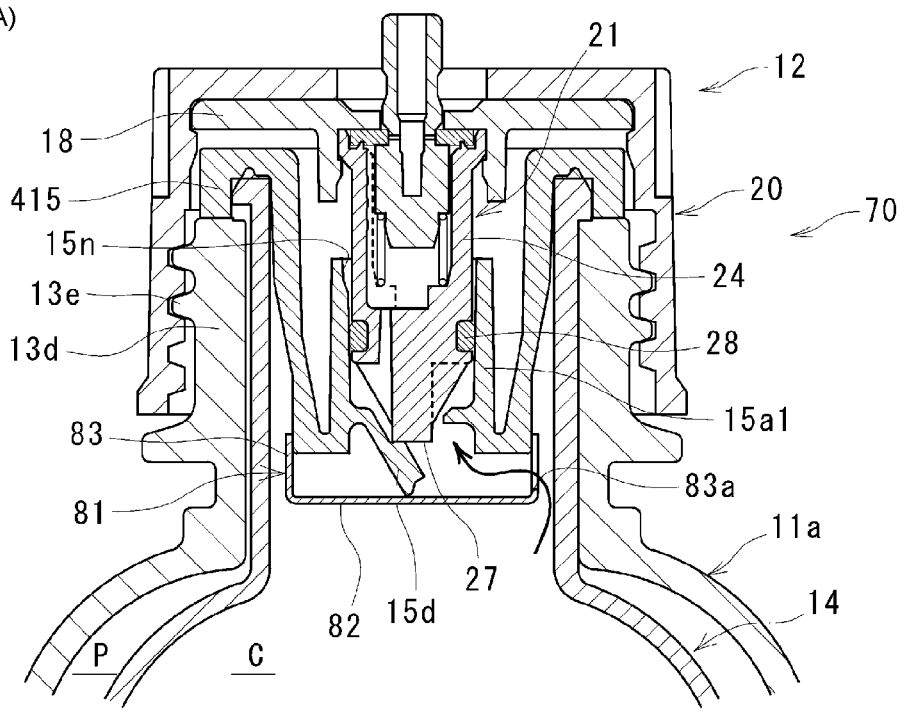
FIG. 11(A) is a cross-sectional view of major parts showing the state after opening the pressurized product of FIG. 10.
FIG. 11(B) is a cross-sectional view of major parts showing the state of removing the valve from the pressurized product of FIG. 10.
Figure 11:
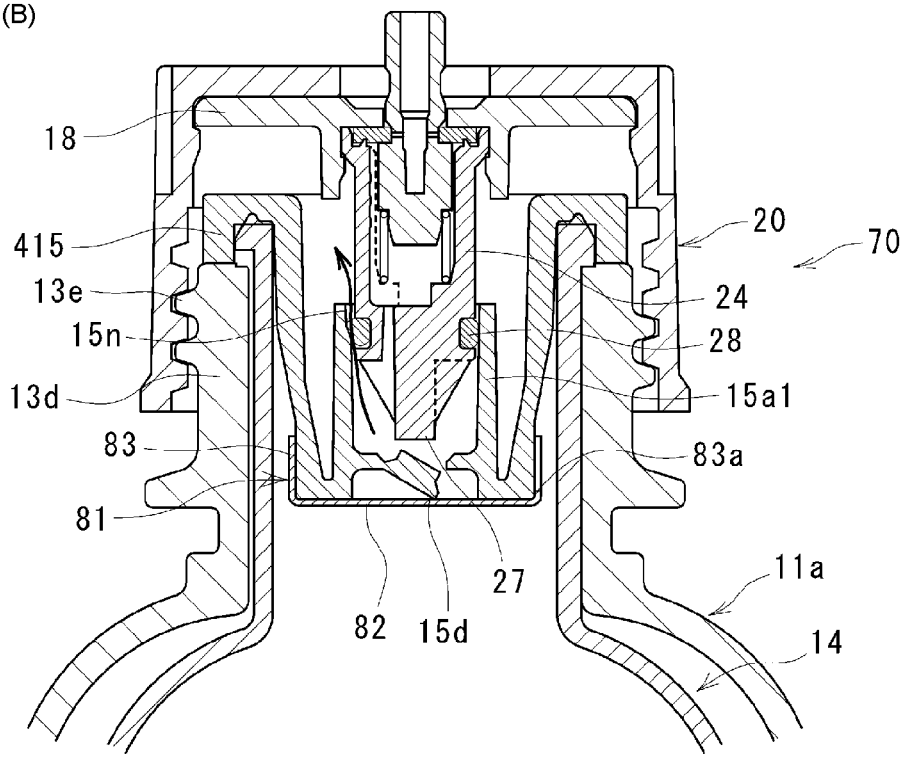

Regarding another configuration, it is similar to the discharge device of FIG. 11, and therefore, the same reference numerals are used for the same parts, and the descriptions thereof will be omitted.

Figure 14:
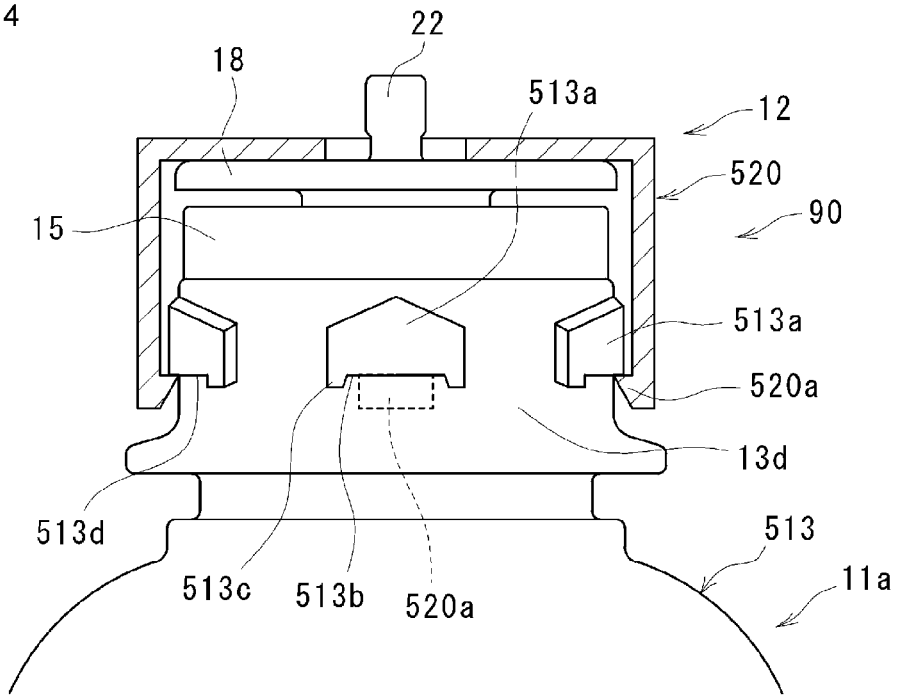
FIG. 14 is a partial cross-sectional view showing still another embodiment of the discharge device of the present invention.

In the discharge device 90 shown in FIG. 14, the engaging projections 513*a* are provided on the outer peripheral surface of the neck part 13 of the outer container 513, and the engaging claw 520*a* engaging with the engaging projections 513*a* is provided on the inner peripheral surface of the cap 520. The engaging projections 513*a* are the engaging part, so that its lower surface engages with the engaging claw 520*a*. The lower surface forms a recessed part 513*b* which is recessed toward the upper side. In other words, the guide part 513*c* projected downward is provided at both end portions in the right and left direction, so that the engagement state is not released by only moving the engaging claw 520*a* in the right and left direction. The upper surface of the engaging projection 513*a* is formed as a roof-shape as a projection at the central part. A plurality of engaging projections 513*a* is provided in the circumferential direction of the neck part 13*d*. The width of the engaging claw 520*a* is defined as to be inserted into the recessed part 513*b* of the engaging projection 513*a*. Further, a plurality of the engaging claws 520*a* is provided in the same interval as the engaging projections 513*a*.

When the pressurized product 11*a* is opened, the cap 520 is pushed down toward the lower side in the mounting state of the valve 21 to the cap 520. In this case, the engaging claws 520*a* are preferably positioned at the space between the engaging projections 513*a*. When the 520 is completely pushed down, the closing part 15*d* is pushed by the seal opening part 27, and the pressurized product 11*a* is opened (see FIG. 11A). And, when the engaging claws 520*a* are positioned lower than the engaging projections 513*a*, the engaging claws 520*a* and the engaging projections 513*a* are engaged by rotating the cap 520 in the horizontal direction. After the pressurized product 11*a* is opened, the pressure of the pressurizing agent P is continuously applied to the cap 520 via the valve 21, so that it becomes the state in which the engaging claws 520*a* are pushed to the bottom 513*d* of the recessed part 513*b*, and even if the user tries to release the engagement between the engaging projections 513*a* and the engaging claws 520*a*, it cannot be easily released. Therefore, the removal of the cap 520 from the pressurized product 11*a* in the state in which the concentrate C remains can be suppressed. Note that in the case in which the engaging projections 513*a* are provided in the cap 520 and the engaging claws 520*a* are provided in the outer container 513, the same effect is obtained. That is, in the case in which the recessed parts 513*b* are provided in any one of the cap 520 and the double pressurized container 511, and the projecting parts (520*a*) inserted inside the recessed parts 513*b* are provided in the other one, the same effect is obtained.

In the discharge device 90 of the aforementioned configuration, since the pressure of the pressurizing agent P is reduced when the concentrate C is entirely discharged, the cap 520 is easily removed. After use, the cap 520, the valve holder 18, and the valve 21 are removed, and it is mounted to a separate new pressurized product.

Regarding another configuration, it is similar to the discharge device of FIG. 11, and therefore, the same reference numerals are used for the same parts, and the descriptions thereof will be omitted.

Figure 15:
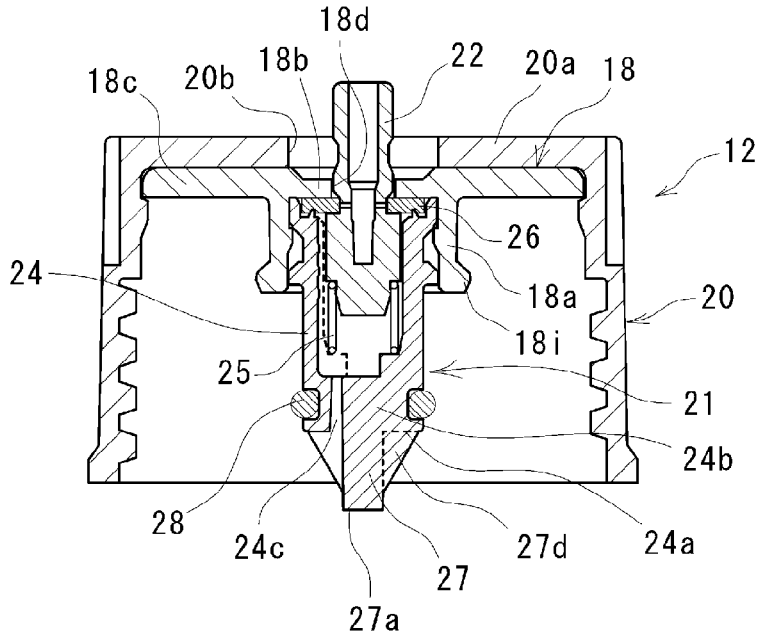
FIG. 15(A) is a cross-sectional view of major parts of the discharge member.
FIG. 15(B) is a cross-sectional view of major parts of the pressurized product.
Figure 15:
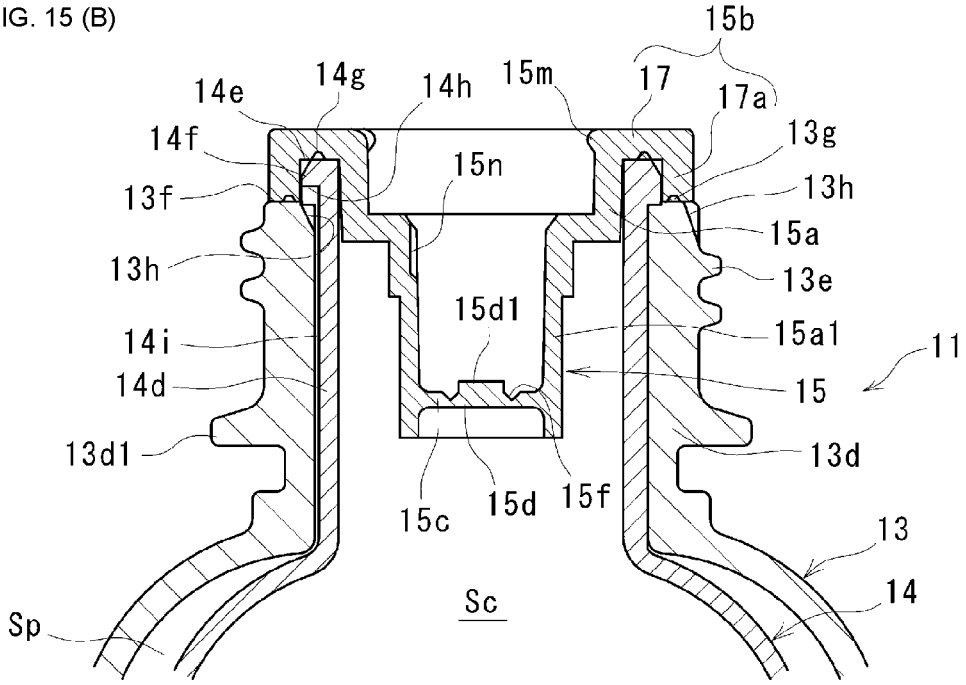
Figure 16:
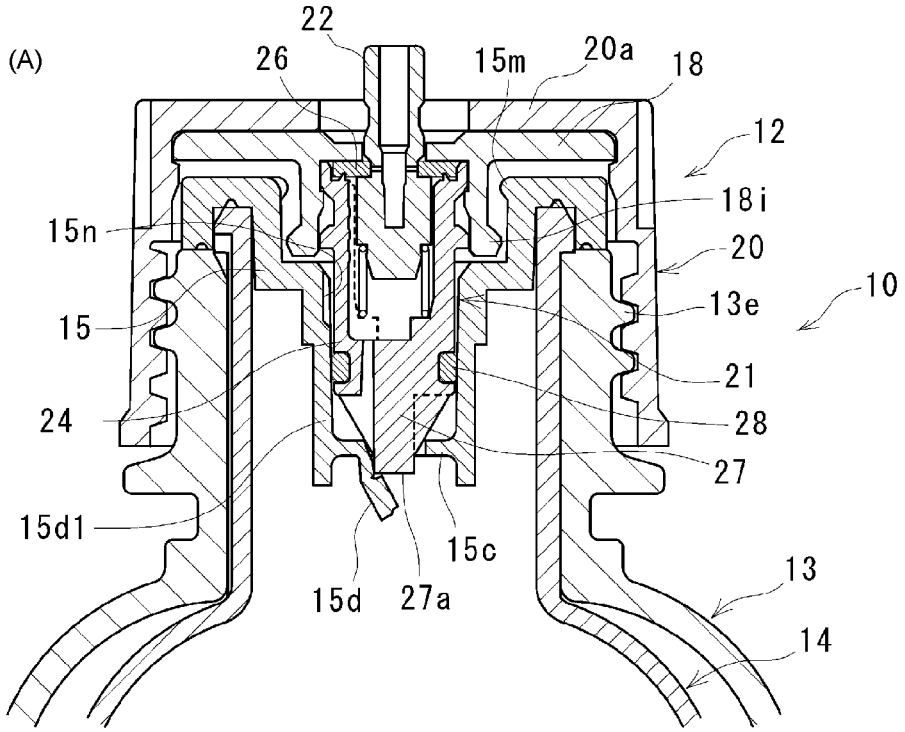
FIG. 16(A) is a cross-sectional view of major parts showing the opening state of the pressurized product.
FIG. 16(B) is a cross-sectional view of major parts showing the state in which the cap is loosened after opening.
Figure 16:
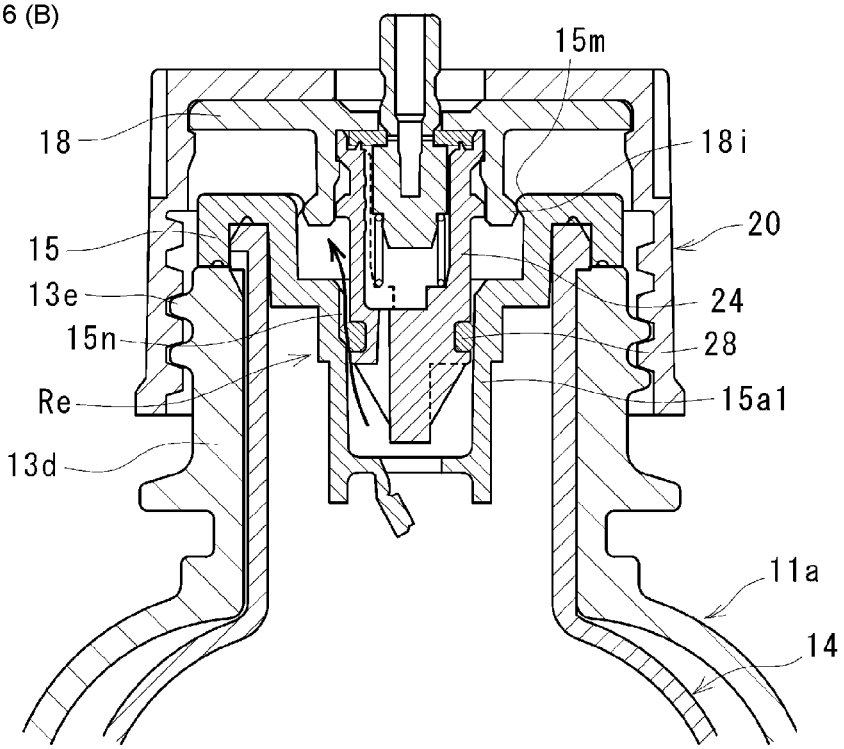

In the pressurizing device 10 shown in FIGS. 15 and 16, on the inner peripheral surface of the upper part of the seal part 15*a*, the first projection (projection) 15*m* projecting in a radially inward direction is provided. The first projection 15*m* may be only one, or may be more than two in the circumferential direction. Further, it may continue in the circumferential direction.

It is preferable that the inner peripheral surface of the fitting cylindrical part 15*a*1 is basically a smooth cylindrical surface in order not to leak the concentrate C by tightly contacting with the seal member 28 of the valve 21 when opening the closing part 15*d*. It may be a tapered shape in which the diameter is reduced toward the lower side. However, in the upper part of the fitting cylindrical part 15*a*1, a recessed groove 15*n* extending in the vertical direction is provided. The upper end of the recessed groove 15 reaches the upper part of the seal part 15*a*, and communicates with the upper part of the seal part 15*a*. On the other hand, the lower end of the recessed groove 15*n* does not reach the bottom part 15*c*, and it stops at the position approximately ½ to ⅓ of the length of the vertical direction of the fitting cylindrical part 15*a*1. That is, the recessed groove 15*n* is not provided in the lower part of the fitting cylindrical part 15*a*1. This is because when the closing part 15*d* is opened by the valve 21, it already becomes the state in which the liquid-tight seal between the fitting cylindrical part 15*a*1 and the valve 21 is formed by the seal member 28. For example, the lower end of the recessed groove 15*n* may be positioned further upward (downstream) than the position of the seal member 28 in the state that the valve 21 firstly abuts to the closing part 15*d*. The number of the recessed groove 15*n* may be one, or may be more than two.

The cap 20 is a bottomed cylindrical shape, and a female screw is formed on the inner peripheral surface, and it is so-called screw cap. The cap 20 and the valve 21 are integrated, and the valve 21 moves to the inside of the fitting cylindrical part 15*a*1 by interlocking with the fastening condition of the cap 20. That is, when fastening the cap 20, the valve 21 is pushed in the inside of the fitting cylindrical part 15*a*1, and when loosening the cap 20, the valve 21 moves in the direction of pulling off from the fitting cylindrical part 15*a*1.

The valve 21 is provided with a bottomed cylindrical shaped housing 24, the aforementioned stem 22 freely moved vertically stored the inside of the housing, a spring 25 energizing the stem 22 upwardly, a stem rubber 26, and a valve holder 18 provided with a cylindrical valve holding part 18*a* holding the upper part of the housing 24, and it configures the discharge passage of the concentrate C. A valve mechanism is configured to switch the discharge state and the non-discharge state of the concentrate C by the stem 22, the spring 25, and the stem rubber 26, and the housing 24 and the valve holder 18 configures a storing space storing the valve mechanism.

In this embodiment, the columnar-shaped seal opening part 27 projecting downward is provided at the lower end of the housing 24, and the seal member 28 such as an O-ring, etc. is mounted on the lower part outer circumference of the housing 24. The seal member 28 is compressed between the inner surface of the fitting cylindrical part 15*a*1 and the outer surface of the housing 24 which are almost equal interval in the vertical direction, so that even if it slightly moves in the vertical direction, the sealing can be maintained.

The vertical hole 24*c* is formed between with adjacent the reinforcing plate 27*d*. Thus, the reinforcing plate 27*d* does not disturb the discharge of the contents. The number of the vertical holes 24*c* is the same as the number of the reinforcing plates 27*d*. However, it may be one to two, etc., or it may be less than that.

A second projection (projection) 18*i* projecting in the radially outward direction is provided on the outer peripheral surface of the valve holding part 18*a* of the valve holder 18. The projection length of the second projection 18*i* is determined in order to contact with the first projection 15*m*. The number of the second projection 18*i* may be one, or it may be more than two in the circumferential direction. Further, the second projection 18*i* may continue in the circumferential direction.

When the user uses the purchased discharge device 10, first, the cap 20 is screwed in the male screw 13*e* of the outer container. With this, the entire cap 20 and the valve 21 are lowered, and the bottom surface 27*a* of the seal opening part 27 pushes down the closing part 15*d*. With this, the thin part 15*f* is broken, and the pressurized product 11*a* is opened. A part of the closing part 15*d* is connected with the bottom part 15*c*, or it tears off from the fitting cylindrical part 15*a*1, so as to be separated and fallen off from the bottom part 15*c*.

When the closing part 15*d* is broken, there is a case in which the concentrate C is leaked from the space between the inner periphery of the bottom part 15*c* and the outer periphery of the seal opening part 27. However, at the position further downstream than the closing part 15*d*, the space between the fitting cylindrical part 15*a*1 and the housing 24 is sealed by the seal member 28, so that the concentrate C is stored inside the fitting cylindrical part 15*a*1 and it does not leak outside.

By the way, as described above, the lid 15 is provided with the recessed groove 15*n*. When the seal member 28 is positioned at the recessed groove 15*n*, at the part overlapping with the recessed groove 15*n*, the compression of the seal member 28 by the inner surface of the lid 15 (fitting cylindrical part 15*a*1) and the outer surface of the valve 21 (housing 24) is loosened. In this state, it can be said that the sealing by the seal member 28 is partially released by the recessed groove 15*n*. Therefore, the concentrate C is leaked from the inner container 14 through the recessed groove 15*n*. The leaked concentrate C is leaked outside the discharge device 10 passing through the space between the lid 15 and the valve holder 18 or the space between the inner surface of the cap 20 and the outer surface of the neck part 13*d* of the outer container 13. Since the leaked concentrate C is slowly leaked without momentum, it is not scattered around, and it adheres to the hand of the user who tries to remove the cap 20 or it can be visually recognized.

Before the cap 20 is loosened (starts removing), that is, the seal member 28 is positioned lower (upstream) than the recessed groove 15*n* in the state in which the cap 20 is completely mounted to the pressurized product 11*a*. Therefore, the concentrate C is not leaked from the recessed groove 15*n*. On the other hand, when loosening the cap 20 (starts removing), the entire valve 21 moves toward the upper side, and the seal member 28 is positioned at the recessed groove 15*n* before removing the cap 20 from the pressurized product 11*a* (in the state in which the cap 20 is still screwed in the male screw 13*e*), and the concentrate C leaks (see the arrow in FIG. 16B). With this, by moving the valve 21 due to the operation in which the cap 20 is loosened (starts removing), the discharge device 10 of the aforementioned configuration is provided with a part releasing mechanism Re which partially release the sealing by the seal member 28, so that by leaking the concentrate C, the user can be notified that the concentrate C still remains, and the removal of the cap 20 in the state in which the concentrate C remains can be suppressed. Note that when fastening the cap 20 again when realizing the leakage of the concentrate C, the seal member 28 is positioned lower than the recessed groove 15*n*, and the leakage of the concentrate C stops, so that it can be reused.

Further, the lid 15 (container 11) is provided with the first projection 15*m*, and the valve 21 (valve assembly) is provided with the second projection 18*i*. In the state in which the cap 20 is completely mounted to the pressurized product 11*a* (before the cap 20 is loosened (starts removing)), the second projection 18*i* is positioned lower than the first projection 15*m*, and the first projection 15*m* and the second projection 18*i* are not contacted. On the other hand, when loosening (start removing) the cap 20, the entire valve 21 moves toward the upper side, and before the cap 20 is removed from the pressurized product 11*a* (the state in which the cap 20 is still screwed in the male screw 13*e*), the first projection 15*m* and the second projection 18*i* are contacted. Therefore, the cap 20 becomes hard to be rotated. This timing when the rotation becomes hard is matched with the timing when the concentrate C is leaked from the recessed groove 15*n*, and in other words, by setting an equal the loosening condition (removal condition: number of rotations or rotational angle) of the cap 20 when contacting the first projection 15*m* and the second projection 18*i*, and the loosening condition (removal condition: number of rotations or rotational angle) of the cap 20 when the seal member 28 is positioned at the recessed groove 15*n* (when the part releasing mechanism Re is operated), it easily gives uncomfortable feeling to the user, and the removal of the cap 20 in the state in which the concentrate C remains can be further suppressed.

After totally discharging the concentrate C, the discharge member 12 is removed from the pressurized product 11*a* by rotating the cap 20. And, the removed discharge member 12 is mounted to a new pressurized product 11*a*. The pressurized product 11*a* in which the concentrate C is entirely discharged remains the pressurizing agent P in the pressurizing agent chamber Sp, but the pressurizing agent P is gradually discharged outside from the closing part 15*d* in which the lid 15 is opened by passing through the inner container 14. When discharging the pressurizing agent P to the outside, the pressurized container 11 is easily deformed, so that it is easily recognized by the consumer and the pressurized container 11 can be safely recycled. Further, in the pressurized container 11, the lid 15 and the container body 16 can be made of a single material, so that the consumer does not have to separate it when recycling and it is easily recycled.

In the double pressurized container 11 shown in FIG. 17A, the substantially cylindrical-shaped seal part 15*a* extends to the lower side, and the fitting cylindrical part 15*a*1 is concentrically provided in the inner side of the seal part 15*a*. The fitting cylindrical part 15*a*1 is raised upward from the central part of the bottom part and it opens at the upper end. The upper part of the seal part 15*a* is a substantially cylindrical shape, and the lower part 15*a*3 is a tapered shape which is tapered toward the lower side. Note that it may be a cylindrical shape from the upper part to the lower part.

On the other hand, the neck part 14*d* of the inner container 14 is shaped as to almost tightly contact with the outer peripheral surface of the seal part 15*a*, and it is provided with a cylindrical-shaped upper part 14*d*1, a tapered part 14*d*2 which is tapered toward the lower side than the upper part 14*d*1, and a cylindrical part 14*d*3 extending to the lower side from the lower end of the tapered part 14*d*2. The lower end of the cylindrical part 14*d*3 continues to the shoulder part 14*c*. That is, the tapered part 14*d*2 of the neck part 14*d* of the inner container 14, the cylindrical part 14*d*3, and the upper part of the shoulder part 14*c* forms a narrowed part.

The point in which the closing part (unsealing part) 15*d* surrounded by the weakening line 15*f* at the bottom part 15*c* of the fitting cylindrical part 15*a*1 is similar to the double pressurized container 11 of FIG. 15A. Note that in the double pressurized container 11 of FIG. 17A, a notch 15*h*1 is provided on the outer periphery of the upper surface of the lid 15. By providing the notch 15*h*1, when performing the ultrasonic wave welding to the upper surface of the upper surface of the lid 15 by pressing the horn, the vibration of the horn is easily concentrated to the annular projection 13*g* of the upper end of the neck part of the outer container 13.

The lid 15 shown in FIG. 17A is provided with a fitting cylindrical part 15*a*1 inside the seal part 15*a*, and the lower end 15*a*4 of the aforementioned tapered-shaped lower part 15*a*3 and the lower end of the lower part cylindrical part 15*a*5 extending in the lower side from the fitting cylindrical part 15*a*1 are connected by the coupling part 15*a*6. Further, the closing part 15*d* is provided at the bottom part 15*c* closing the part which is slightly higher than the lower end of the lower part cylindrical part 15*a*5. Therefore, when performing the ultrasonic wave welding by pressing the horn to the upper surface of the lid 15, the vibration of the horn passes through the seal part 15*a*, and easily flows from the lower end 15*a*4 of the seal part 15*a* to the concentrate C side. Further, since the closing part 15*d* is provided at the position higher than the coupling part 15*a*6, the vibration hardly transmits to the closing part 15*d*. Therefore, the melting or the penetration, etc. of the weakening line 15*f* is prevented.

In the double pressurized container 11 of FIG. 17A, a narrowed part is formed by the tapered part 14*d*2 and the cylindrical part 14*d*3 in the neck part 14*d* of the inner container 14, and the narrowed part tightly contacts with the seal part 15*a* of the lid 15, so that when the concentrate C is filled in the inner container 14, the gas-phase part Gp (head space) becomes small. Accordingly, it is hard to cause the problems such that when the consumer starts using, the concentrate C is discharged and scattered energetically by the air compressed by the gas-phase part Gp, or the air is mixed with the concentrate C at the time of discharging, and the concentrate C is not continuously discharged, etc., so that the discharge becomes smooth. Specifically, even when a post-foaming gel composition or a post-foaming cream composition including a foaming agent, in which the boiling point is 10 to 35° C., such as isopentane or 1-chloro-3,3,3-trifluoropropene, etc. in the concentrate is filled, the gas-phase part Gp is small, so that the foaming right after the filling is prevented, and it can be discharged in the gel state or the cream state.

In the double pressurized container 11 of FIG. 17A, the neck part 14*d* of the inner container 14 and the lower part 15*a*3 of the seal part 15*a* of the lid 15 can be a straight cylindrical shape. However, it is preferable that a narrowed part is provided in the neck part 14*d* of the inner container 14, and the lower part 15*a*3 of the seal part 15*a* of the lid 15 is a tapered-shape, so that the diameter and the volume of the gas-phase part Gp can be small. Further, a rib 15*p* press-contacting to the tapered-shaped lower part 15*a*3 with the tapered part 14*d*2 of the neck part of the inner container is provided, and by forming a line seal when the lid 15 covers the container body 16, it prevents the inside of the inner container 14 from mixing when the pressurizing agent P is filled. Further, even when the concentrate C is atomized by the ultrasonic vibration when welding the lid 15, the leakage to the welding part side from the space between the tapered-shaped lower part 15*a*3 and the tapered part 14*d*2 of the neck part of the inner container is prevented, and the welding is not inhibited. Note that instead of the rid 15*p*, a line seal can be formed by forming the outer peripheral surface of the tapered-shaped lower part 15*a*3 in a spherical shape and abutting to the tapered part 14*d*2 of the neck part.

Also, in the discharge device 10 of FIG. 17B, the recessed groove 15*n* is provided in the lid 15. When the seal member 28 is positioned at the recessed groove 15*n*, in the part overlapping with the recessed groove 15*n*, the compression of the seal member 28 by the inner surface of the lid 15 (fitting cylindrical part 15*a*1) and outer surface of the valve 21 (housing 24) is weakened. In this state, it can be said that the sealing by the seal member 28 is partially released by the recessed groove 15*n*. Thus, the concentrate C is leaked from the inner container 14 through the recessed groove 15*n*. The leaked concentrate C is leaked outside the discharge device 10 through the space between the lid 15 and the valve holder 18, and the space between the inner surface of the cap 20 and the outer surface of the neck part 13*d* of the outer container 13. The leaked concentrate C is not discharged energetically, but it is discharged slowly, so that it is not scattered, and it adheres to the hand of the user who tries to remove the cap 20 or it can be visually recognized.

Before the cap 20 is loosened (starts removing), that is, in the state in which the cap 20 is completely mounted to the pressurized product 11*a*, the seal member 28 is positioned lower (upstream) than the recessed groove 15*n*. Therefore, the concentrate C is not leaked from the recessed groove 15*n*. On the other hand, when the cap 20 is loosened (starts removing), the entire valve 21 moves upward, and before removing the cap 20 from the pressurized product 11*a* (the state in which the cap 20 is screwed in the male screw 13*e*), the seal member 28 is positioned at the recessed groove 15*n*, and the concentrate C is leaked (see the arrow in FIG. 17B). With this, in the discharge device of the aforementioned configuration, a part releasing mechanism Re in which a part of the sealing by the seal member 28 is released by moving the valve 21 due to the loosening (starting to remove) of the cap 20 is provided, so that the user can be notified that the concentrate C still remains by the leakage of the concentrate C, and the removal of the cap 20 in the state in which the concentrate C remains can be suppressed. Note that when fastening the cap 20 again at the time the user realizes the leakage of the concentrate C, the seal member 28 is positioned lower (upstream) than the recessed groove 15*n*, and the leakage of the concentrate C stops, so that it can be reused.

Further, the lid 15 is provided with the first projection 15*m*, and the valve 21 is provided with the second projection 18*i*. In the state in which the cap 20 is completely mounted to the pressurized product 11*a* (before the cap 20 is loosened (starts removing)), similar to the case of FIG. 16A, the second projection 18*i* is positioned lower than the first projection 15*m*, and the first projection 15*m* and the second projection 18*i* are not contacted. On the other hand, when the cap 20 is loosened (starts removing), the entire valve 21 moves upward, and before removing the cap 20 from the pressurized product 11*a*, the first projection 15*m* and the second projection 18*i* are contacted. Therefore, the cap 20 becomes hard to be rotated. This timing when the rotation becomes hard is matched with the timing when the concentrate C is leaked from the recessed groove 15*n*, and in other words, by equalizing the loosening condition (removal condition: number of rotations or rotational angle) of the cap 20 when contacting the first projection 15*m* and the second projection 18*i*, and the loosening condition (removal condition: number of rotations or rotational angle) of the cap 20 when the seal member 28 is positioned at the recessed groove 15*n* (when the part releasing mechanism Re is operated), it easily gives uncomfortable feeling to the user, and the removal of the cap 20 in the state in which the concentrate C remains can be further suppressed.

Regarding another configuration, it is similar to the discharge device 10 of FIG. 15, and therefore, the same reference numerals are used for the same parts, and the descriptions thereof will be omitted.

Figure 18:
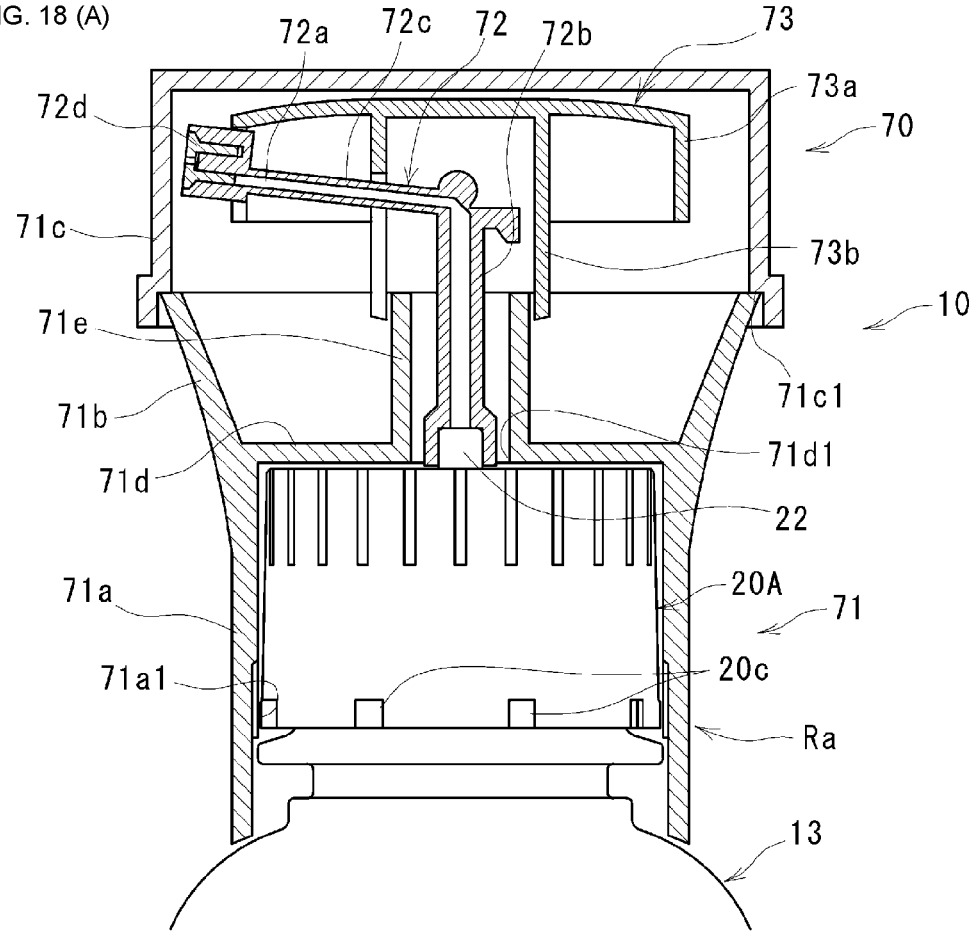
FIG. 18(A) is a cross-sectional view of major parts showing the state in which an exterior part is mounted in the pressurized product.
FIG. 18(B) is a horizontal cross-sectional view of the cover part and the cap.
Figure 18:
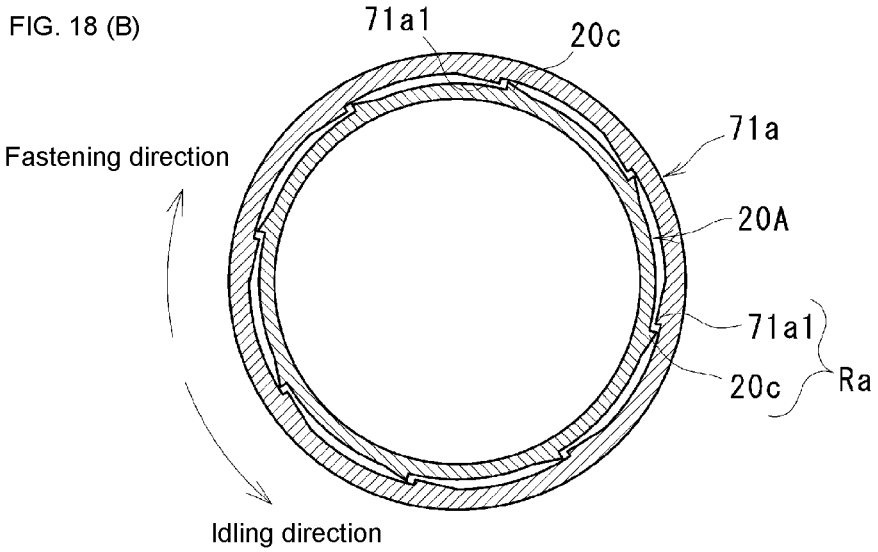

In the discharge device 10 of FIG. 18, instead of the operation button 23, an exterior part 70 is mounted. The exterior part 70 is provided with a cover part 71 mounted in the cap 20A, a nozzle 72 mounted in the stem 22, and a button 73 for pushing down the stem 22 via the nozzle 72 (performing a spray operation). The cap 20A is a bottomed cylindrical shape, and the female screw is formed on the inner peripheral surface, and it is so-called "screw cap". Accordingly, the cap 20A is detachable to the pressurized product 11*a*. Further, the valve 21 mounted to the pressurized product 11*a* by the cap 20A is also naturally removed from the pressurized product 11*a* when the cap 20A is removed from the pressurized product 11*a*. That is, the valve 21 is also detachable to the pressurized product 11*a*.

The cover part 71 is provided with a lower cylindrical part 71*a* covering the cap 20A, an upper cylindrical part 71*b* extending toward the upper side from the upper end of the lower cylindrical part 71*a*, a lid part 71*c* which covers the upper cylindrical part 71*b*, a partition wall 71*d* partitioning the lower cylindrical part 71*a* and the upper cylindrical part 71*b*, and a support cylinder 71*e* raised from the partition wall 71*d*. The lower cylindrical part 71*a* is a substantially cylindrical shape, and the inner diameter is almost equal to the outer diameter of the cap 20A. The upper cylindrical part 71*b* is a substantially cylindrical shape, and the diameter is gradually enlarged toward the upper side. The lid part 71*c* is a bottom cylindrical shape, and the lower end opens. At the lower end part, an engaging step part 71*c*1 engaging with the upper end of the upper cylindrical part 71*b* is provided. The partition wall 71*d* is a substantially disk shape, and a through hole 71*d*1 in which the nozzle 72 and the stem 22 pass through is provided at the central part. The support cylinder 71*e* is a substantially cylindrical shape, and extends toward the upper side from the periphery of the through hole 71*d*1.

An inside of a nozzle 72 is provided with a passage 72*a* passing through the concentrate C. This nozzle 72 is provided with a vertical part 72*b* extending in the upper direction, and a horizontal part 72*c* extending in the horizontal direction from the upper end of the vertical part 72*b*. The lower end of the vertical part 72*b* is detachably mounted to the stem 22. Therefore, it can be removed from the stem 22 and it can be cleaned-up. The inside of the passage 72*a* connects to the stem 22. The passage 72*a* opens at the top end of the horizontal part 72*c*. At the top end of the horizontal part 72*c*, a spray nozzle 72*d* having an injection hole is mounted.

The button 73 is provided with a bottomed cylindrical shape pushing part 73*a*, and a cylindrical-shaped covering cylinder 73*b* extending downward from the center of the pushing part 73*a*. The pushing part 73*a* engages with the horizontal part 72*c* of the nozzle 72, and it is configured to push down the stem 22 via the nozzle 72 by pushing down the pushing part 73*a*. Further, when the nozzle 72 is removed from the stem 22, it is configured to be removed with the nozzle 72. The covering cylinder 73*b* is externally fitted to the support cylinder 71*e* in a freely sliding manner, and the wobbling of the button 73 when pushing down the pushing part 73*a* is suppressed.

FIG. 18B shows the state in which the lower cylindrical part 71*a* covers the cap 20A. As shown in the drawing, the first claw part 71*a*1 is provided on the inner peripheral surface of the lower cylindrical part 71*a*, and the second claw part 20*c* is provided on the outer peripheral surface of the cap 20A. The first claw part 71*a*1 and the second claw part 20*c* are engaged each other, for example, only when rotating the cover part 71 (lower cylindrical part 71*a*) clockwise with respect to the axis of the cap 20A. Specifically, each of the first claw part 71*a*1 and the second claw part 20*c* is a serrated shape, and when rotating clockwise, these parts are hooked, but when rotating counterclockwise, the first claw part 71*a*1 climbs over the second claw part 20*c*, so as not to be hooked each other. Therefore, when the cover part 71 is rotated clockwise, the cap 20A is also rotated clockwise. On the other hand, when the cover part 71 is rotated counterclockwise, the first claw part 71*a*1 and the second claw part 20*c* are not engaged. Thus, even when the cover part 71 is rotated counterclockwise, the cap 20A is not rotated, and the cover part 71 is only turned idlingly. That is, a ratchet mechanism Ra is configured to corotate the lower cylindrical part 71*a* and the cap 20A in only one direction. The corotating direction is the same direction as the direction of fastening the cap 20A. Thus, even when the cover part 71 rotates, it cannot be rotated in the direction of loosening (removing) the cap 20A, and the removal of the cap 20A from the pressurized product 11*a* can be suppressed. On the other hand, since the cap 20A can be fastened by rotating the cover part 71, in the state in which the cap 20A and the valve 21 are inserted in the lower cylindrical part 71*a*, the exterior part 70 covers the pressurized product 11*a*, and by rotating the exterior part 70, the pressurized product 11*a* can be opened.

Figure 19A:
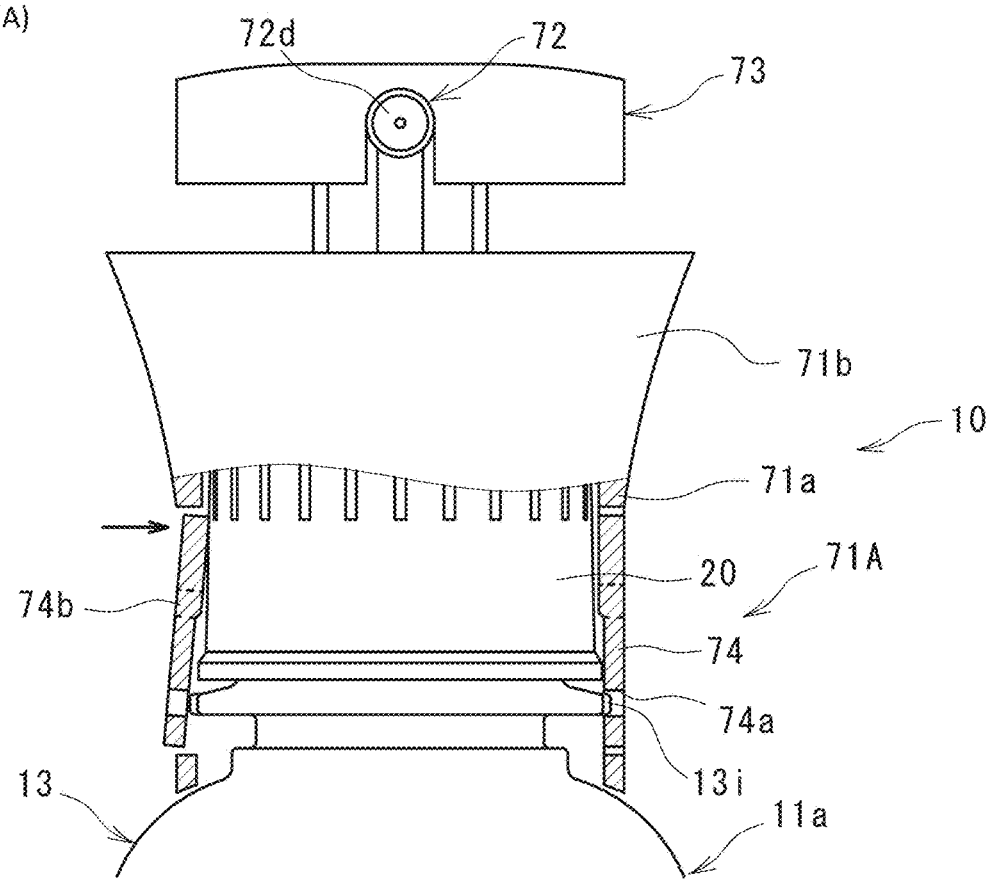
FIG. 19(A) is a cross-sectional view of major parts showing the state in which the exterior part is mounted in the pressurized product.

In order to discharge concentrate C, first, the engagement between the upper cylindrical part 71*b* and the lid part 71*c* is released, and the lid part 71*c* is removed (see FIG. 19A). And, by pushing down the exposed button 73 downwardly, the stem 22 is pushed down via the nozzle 72, and the concentrate C is discharged from the nozzle 72. After the total quantity of the concentrate C is discharged, the exterior part 70 is removed in the upper side and then, the cap 20A is rotated, and the valve 21 is removed from the pressurized product 11*a*. And, the removed discharge member 12 (cap 20A, valve 21, seal member 28, exterior part 70) is mounted to a new pressurized product 11*a*.

Figure 17:
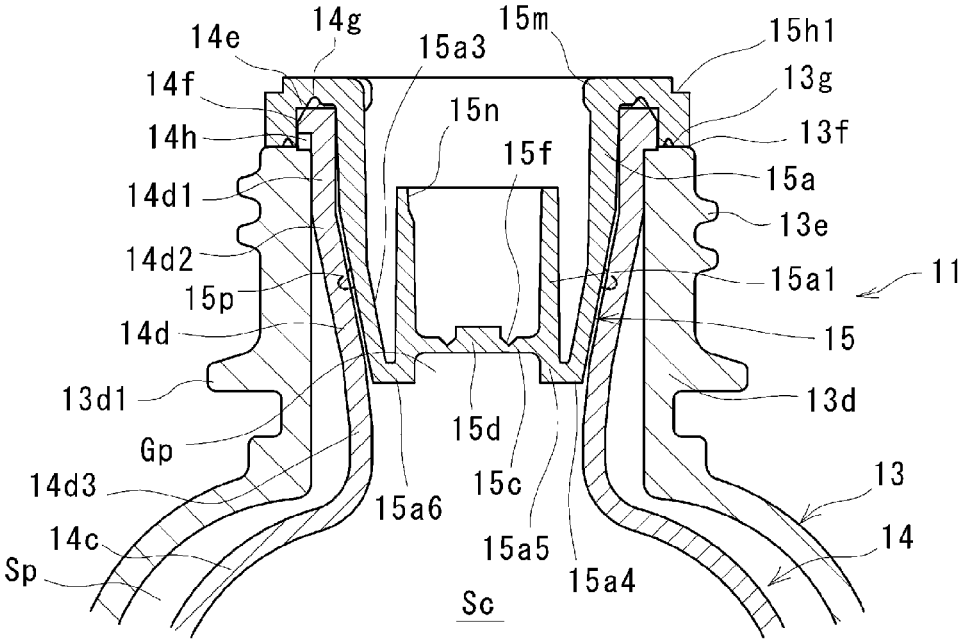
FIG. 17(A) is a cross-sectional view of major parts showing the pressurized product.
FIG. 17(B) is a cross-sectional view of major parts showing the state in which the cap is loosened after opening the pressurized product.
Figure 17:
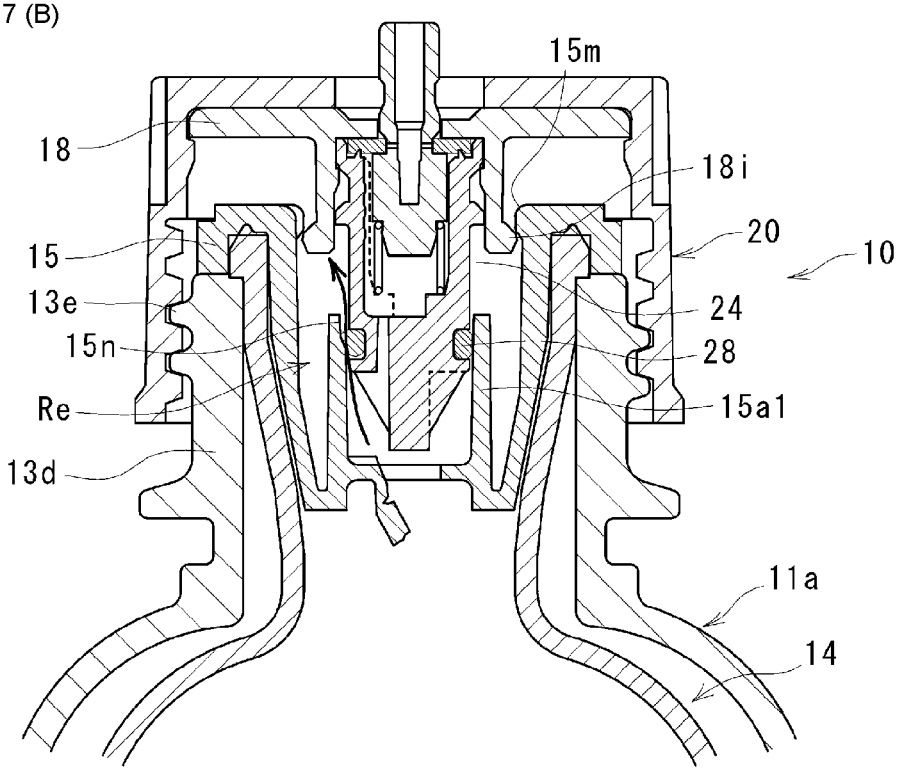

Regarding another configuration, it is similar to the discharge device 10 of FIGS. 15 and 17, and therefore, the same reference numerals are used for the same parts, and the descriptions thereof will be omitted.

Figure 19B:
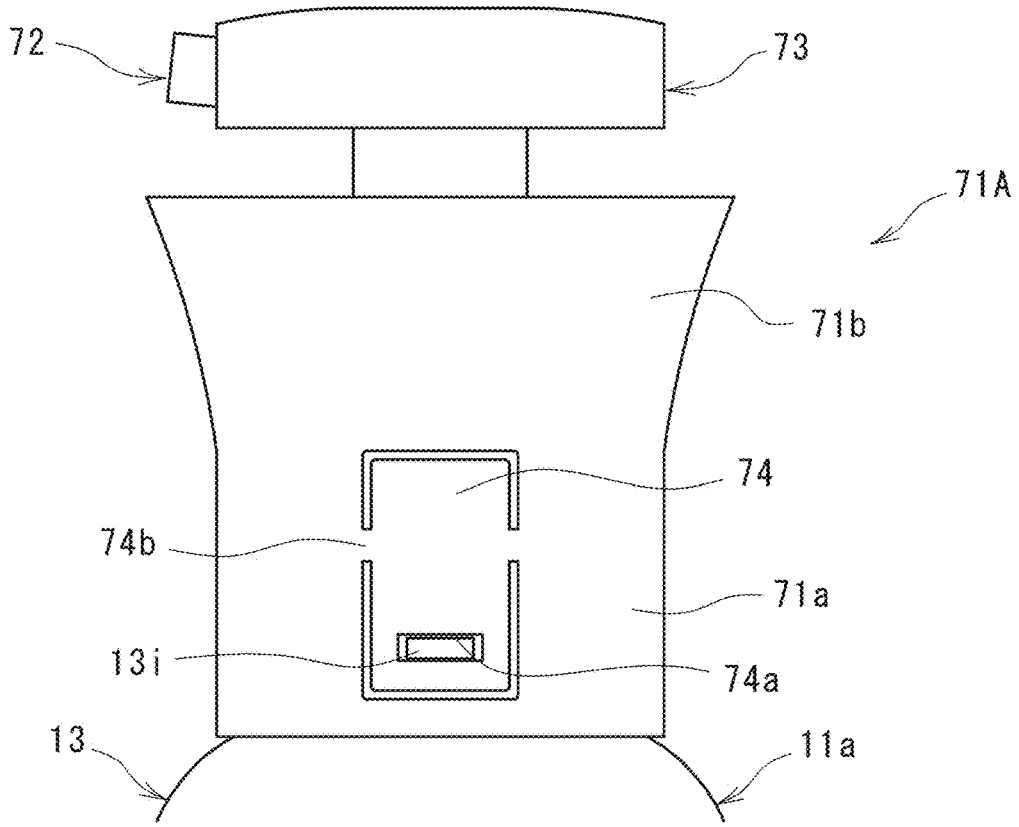
FIG. 19(B) is a side view showing the state in which the exterior part is mounted in the pressurized product.

In the discharge device 10 of FIG. 19, the exterior part 70 and the cap 20 are not engaged, and the exterior part 70 and the pressurized product 11*a* are engaged. Specifically, an engaging hole 74*a* is provided in the lower cylindrical part 71*a* of the cover part 71A, and the projecting piece 13*i* engaging with the engaging hole 74*a* is provided in the support part 13*d*1 of the outer container 13, and by inserting the projecting piece 13*i* into the engaging hole 74*a*, the exterior part 70 and the outer container are engaged. With this, in the case in which the exterior part 70 and the cap 20 are not engaged, even when the exterior part 70 is rotated, the cap 20 is not loosened, and the removal of the cap 20 from the pressurized product 11*a* can be suppressed. Note that the engaging hole 74*a* is positioned at the movable part 74 which is nearly separated from the lower cylindrical part 71*a*. In the movable part 74, only two parts (coupling part 74*b*) of the middle part in the vertical direction are connected with the lower cylindrical part 71*a*, and when the upper part of the movable part 74 is pushed in, the lower part of the movable part 74 is configured to be projected outside. The engaging hole 74*a* is provided at the lower part of the movable part 74, and in order to release the engagement between the engaging hole 74*a* and the projecting piece 13*i*, the upper part of the movable part 74 is pushed in.

Regarding another configuration, it is similar to the discharge device 10 of FIG. 18, and therefore, the same reference numerals are used for the same parts, and the descriptions thereof will be omitted.

Figure 20:
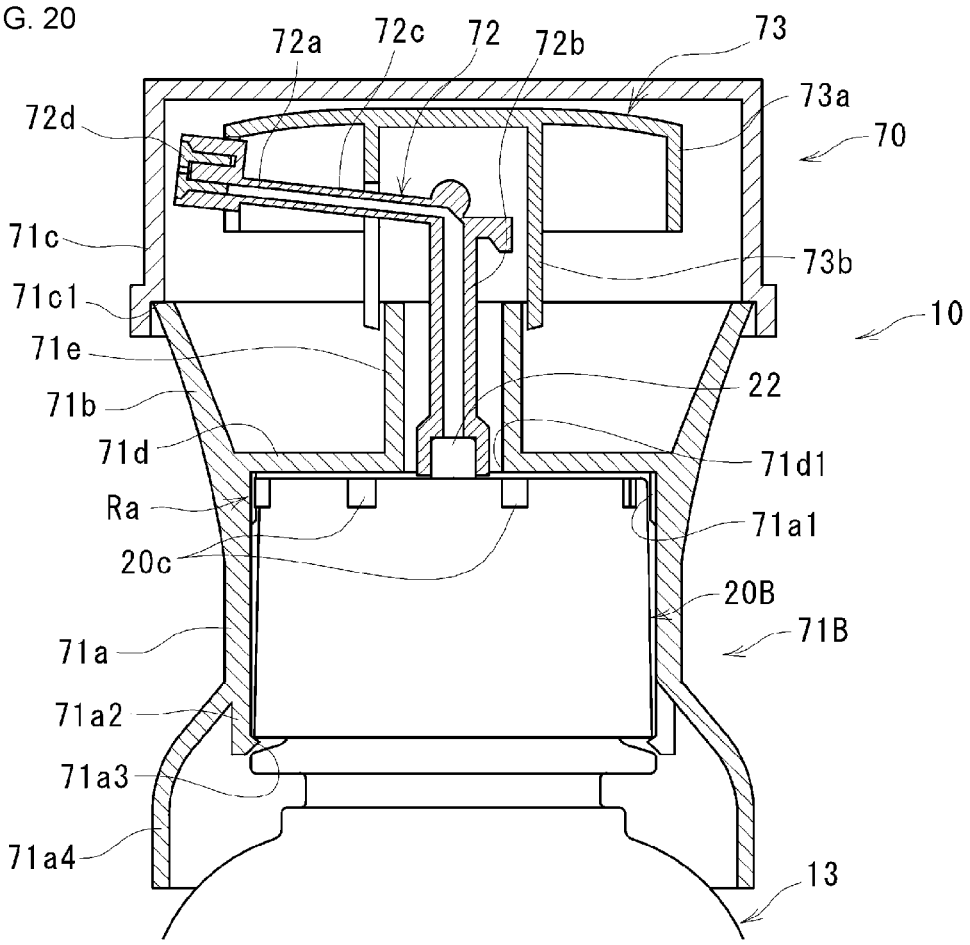
FIG. 20 is a cross-sectional view of major parts showing the state in which an exterior body is mounted in the pressurized product.

In the discharge device 10 of FIG. 20, the cover part 71B is provided with engaging parts 71*a*3 in which the cover part 71B is rotatably engaged with the cap 21B around the axis of the cap 20B. Specifically, first, the lower cylindrical part 71*a* of the cover part 71B is provided with a plurality of engagement pieces 71*a*2 extended downward, and an engaging projection (engaging part) 71*a*3 provided inside the engagement pieces 71*a*2. The engaging projections 71*a*3 are engaged with the lower end of the cap 21B, but the lower end of the cap 21B is flat and smooth. Therefore, even when the cover part 71B is rotated around the axis of the cap 21B, the engaging projections 71*a*3 do not hook the cap 21B in the rotation direction. That is, the engaging projections 71*a*3 suppress the falling-down of the cover part 71B from the cap 21B, and it does not limit the rotation of the cover part 71B. Note that it can be said that a slit is provided between the engagement pieces 71*a*2, 71*a*2, and the engagement pieces 71*a*2 are easily deformed in a radially outer direction of the lower cylindrical part 71*a*, and the engaging projections 71*a*3 are easily engaged with the lower end of the cap 21B.

The engagement pieces 71*a*2 are covered by a skirt part 71*a*4 extended downward from the base end of the engagement piece 71*a*2. The skirt part 71*a*4 continues in the circumferential direction, and it exceeds the engagement pieces 71*a*2 and extends to the vicinity of the shoulder part 13*c* of the outer container 13.

By the way, the discharge device 10 of FIG. 20 is provided with a ratchet mechanism Ra. Note that it is different from the discharge device 10 of FIG. 18A, and the first claw part 71*a*1 is provided in the upper part of the lower cylindrical part 71*a* (the vicinity of the lower surface of the partition wall 71*d*), and the second claw part 20*c* is provided in the upper part of the cap 21B (the vicinity of the lower surface of the partition wall 71*d*). As the mechanism, it is similar to the one shown in FIG. 18A or FIG. 18B. That is, in the direction of fastening (mounting) the cap 21B, the first claw part 71*a*1 and the second claw part 20*c* are engaged, and in the direction of loosening (removing) the cap 21B, the first claw part 71*a*1 and the second claw part 20*c* are not engaged. Therefore, even when the cover part 71B rotates around the axis of the cap 21B, the cap 21B is not loosened (removed). On the other hand, in order to open the unopened pressurized product 11*a*, in the state in which the cap 21B is inserted inside the lower cylindrical part 71*a*, the cap 21B and the cover part 71B cover the pressurized product 11*a*, and it only rotates the cover part 71B in the direction of fastening the cap 21B. Note that in order to engage the engaging projections 71*a*3 to the lower end of the cap 21B, the falling-off of the cap 21B from the cover part 71B can be prevented, and it makes the working easy.

After the total amount of the concentrate C is discharged, first, the exterior part 70 is removed to the upper side. The engaging projections 71*a*3 are engaged with the lower end of the cap 21B, and the engaging projections 71*a*3 are existed at multiple positions, and the engagement pieces 71*a*2 are separated each other, so that the engagement can be released by relatively small force. After that, the valve 21 is removed from the pressurized product 11*a* by rotating the cap 20B. And, the removed discharge member 12 (the cap 20B, the valve 21, the seal member 28, the exterior part 70) is mounted to a new pressurized product 11*a*.

Regarding another configuration, it is similar to the discharge device 10 of FIG. 18, and therefore, the same reference numerals are used for the same parts, and the descriptions thereof will be omitted.

Figure 21:
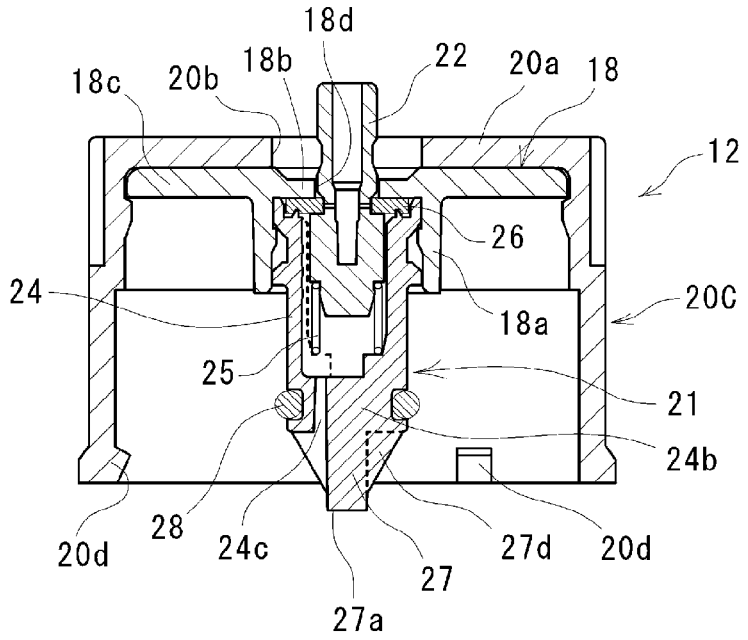
FIG. 21(A) is a cross-sectional view of major parts of the discharge member.
FIG. 21(B) is a side view of the pressurized product.
Figure 21:
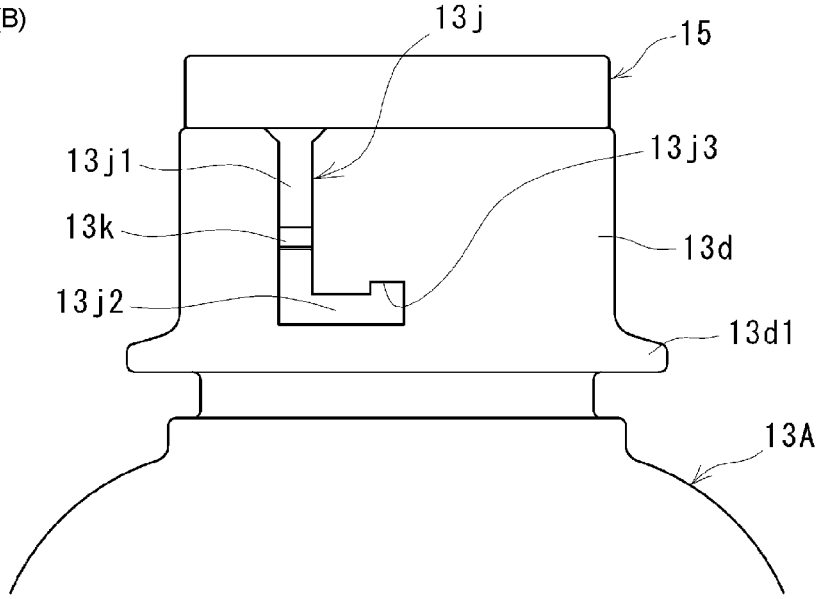
Figure 22:
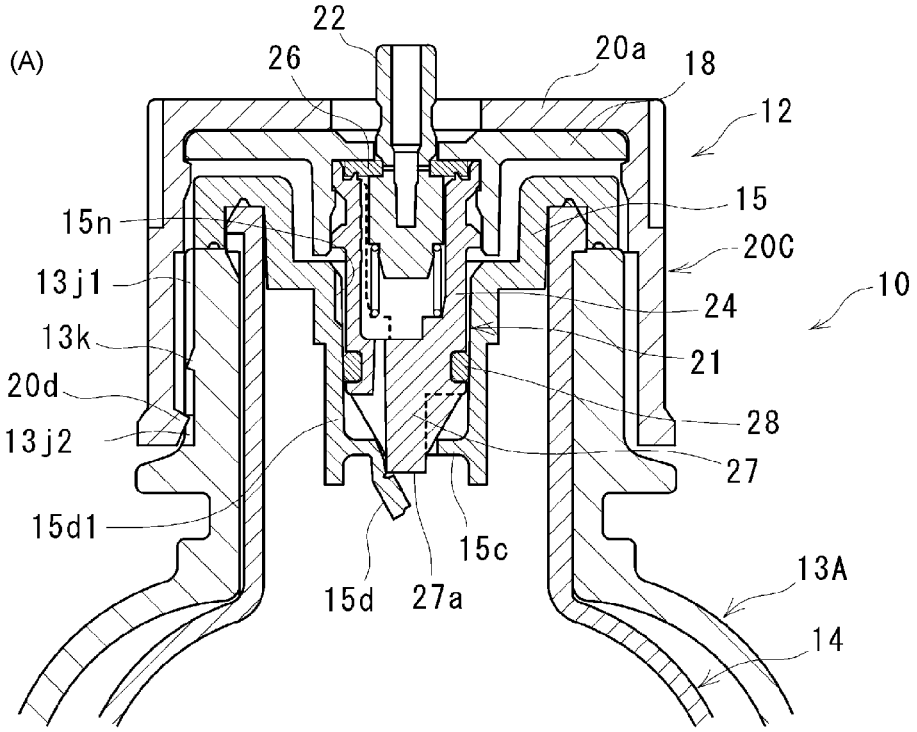
FIG. 22(A) is a cross-sectional view of major parts showing the opening state of the pressurized product.
FIG. 22(B) is a cross-sectional view of major parts showing the state in which the cap is loosened after opening.
Figure 22:
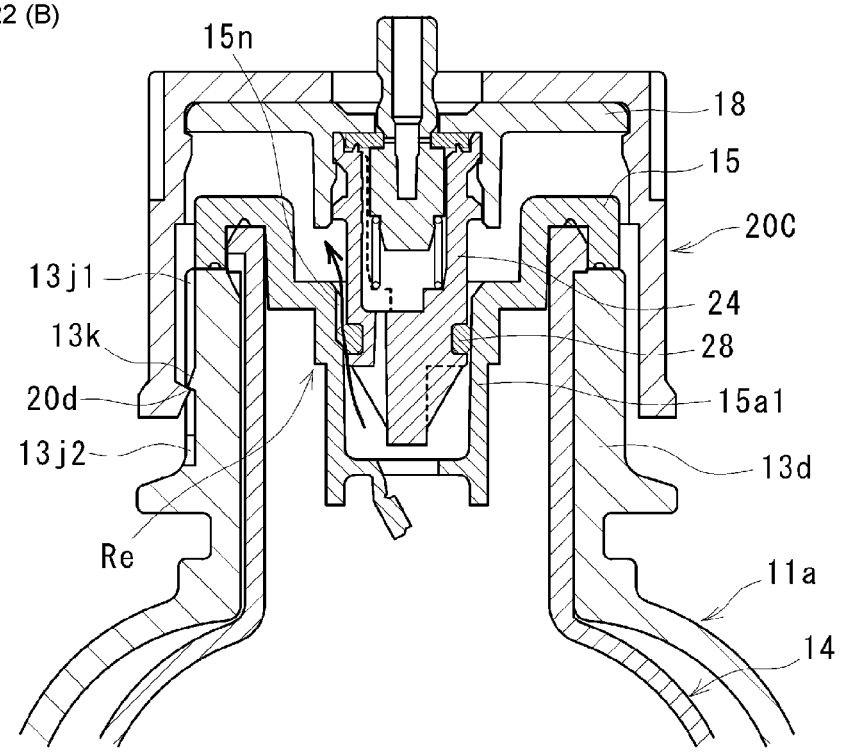

FIGS. 21 and 22 show the discharge device 10 which does not use a screw cap as a cap. As shown in FIG. 21A, a screw is not provided on the inner peripheral surface of the cap 20C, and as shown in FIG. 21B, a male screw is not provided in the neck part 13*d* of the outer container 13A. In this discharge device 10, the cap 20C is locked in the outer container 13A by a groove part 13*j* and the engaging projection (projection) 20*d* engaging with the groove part 13*j*. It can be said that the engaging projection 20*d* is provided in the valve assembly.

The groove part 13*j* is provided on the outer peripheral surface of the neck part 13*d* of the outer container 13A. The groove part 13*j* is provided with a longitudinal groove 13*j*1 extended downward from the upper end of the neck part 13*d*, a horizontal groove 13*j*2 extended in the horizontal direction from the lower end of the longitudinal groove 13*j*1, and a holding part 13*j*3 which is recessed upward in the terminal end of the horizontal groove 13*j*2. It is preferable to provide a plurality of groove parts 13*j*. Further, the groove parts 13*j* are preferably provided at equal intervals.

The engaging projection 20*d* is provided in the lower part of the inner peripheral surface of the cap 20C. The engaging projection 20*d* is projected in a radially inner direction, and the top end in the radially inner direction of the engaging projection 20*d* is positioned in the inner side than the outer peripheral surface of the neck part 13*d* (except the groove part 13*j*). It is preferable to provide a plurality of engaging projections 20*d*. For example, the number of the engaging projections 20*d* is preferably the same number as the groove parts 13*j*. Further, the engaging projections 20*d* are preferably provided in the same interval as the groove parts 13*j*.

In order to mount the cap 20C in the outer container 13A, first, the positions of the engaging projection 20*d* and the longitudinal groove 13*j*1 are matched. And, the cap 20C is pushed down. When pushing down the cap 20C, the closing part 15*d* of the lid 15 is pushed down by the seal opening part 27 of the valve 21, and the pressurized product 11*a* is opened. After opening, the cap 20C is rotated around the axis, and the engaging projection 20*d* is moved from the longitudinal groove 13*j*1 to the horizontal groove 13*j*2. After the pressurized product 11*a* is opened, the valve 21 receives the pressure of the pressurizing agent P, but by positioning the engaging projection 20*d* at the horizontal groove 13*j*2, the cap 20C is not removed from the pressurized product 11*a*. Note that when the engaging projection 20*d* is positioned at the holding part 13*j*3, it becomes the state in which the engaging projection 20*d* is recessed, and the rotation around the axis of the cap 20C is suppressed.

By the way, a locking projection (projection) 13*k* is provided in the longitudinal groove 13*j*1 (container 11). The locking projection 13*k* is not hooked when pushing down the cap 20C, or it is hardly hooked, and it is hooked in the direction of pulling the cap 20C off. Specifically, the inclination of the upper surface with respect to the outer peripheral surface of the neck part 13*d* is moderate, and the inclination of the lower surface is steep. Further, the position in the vertical direction of the locking projection 13*k* is determined in the manner in which the locking projection 13*k* is engaged with the engaging projection 20*d* at the position where the part releasing mechanism Re is operated by the recessed groove 15*n* and the seal member 28. Therefore, after the pressurized product 11*a* is opened, even when the engaging projection 20*d* is positioned at the longitudinal groove 13*j*1 (the cap 20C starts removing from the pressurized product 11*a*), the cap 20C is not immediately removed from the pressurized product 11*a*, and once, it may be stopped by the locking projection 13*k*. In this case, when the concentrate C inside the inner container 14 remains, the concentrate C is slightly leaked outside the discharge device 10 by the part releasing mechanism Re. Even when the part releasing mechanism Re operates, by pushing the cap 20C down again, the discharge device 10 can be continuously used. After all of the concentrate C is completely discharged, the concentrate C is not leaked. In this case, the engagement between the locking projection 13*k* and the engaging projection 20*d* is released by strongly pulling the cap 20C upward, so that the cap 20C or the valve 21 can be removed from the pressurized product 11*a*. The removed discharge member 12 can be mounted to a new pressurized product 11*a*.

Note that in the aforementioned discharge device 10, the first projection 15*m* is not provided in the lid 15, and the second projection 18*i* is not provided in the valve holder 18. Regarding another configuration, it is similar to the discharge device 10 of FIG. 15, and therefore, the same reference numerals are used for the same parts, and the descriptions thereof will be omitted.

Figure 23:
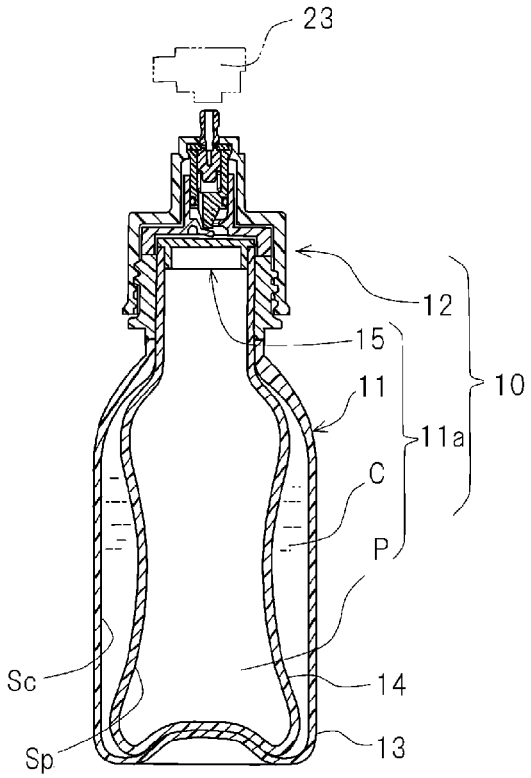
FIG. 23(A) is a cross-sectional view showing another discharge product.
FIG. 23(B) is a cross-sectional view showing the opening state of the discharge product.
Figure 23:
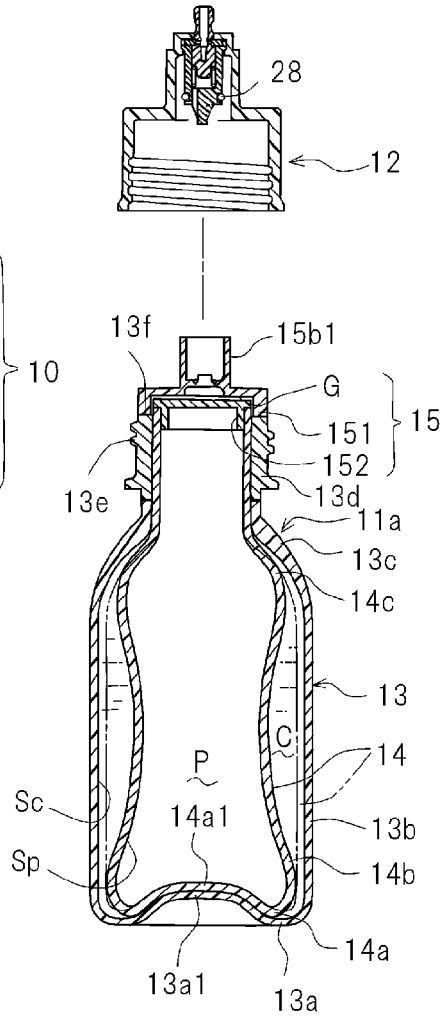

FIGS. 23A and 23B show another discharge device. As shown in the drawings, in the discharge device 10, the inside of the inner container 14 is the pressurizing agent chamber Sp in which the pressurizing agent P is filled, and the space between the outer container 13 and the inner container 14 is the concentrate chamber Sc in which the concentrate C is filled. And, the pressurizing agent P is filled inside the inner container 14, and the concentrate C is filled in the space between the outer container 13 and the inner container 14. The outer container 13 and the inner container 14 are sealed by the lid 15. In this embodiment, the lid 15 is separated into an outer lid 151 sealing the outer container 13 and an inner lid 152 sealing the inner container 14. A concentrate passage G is existed between the outer lid 151 and the inner lid 152.

The outer container 13 is similar to the aforementioned another discharge device 10. The inner container 14 is partially different from the aforementioned another discharge device 10. Specifically, a flange engaging with the upper end surface 14*e* of the neck part 13*d* of the outer container 13 is not provided. However, the flange may be provided.

On the outer peripheral surface of the neck part 14*d* of the inner container 14, as shown in FIG. 24B, a longitudinal groove 14*i* communicating between the concentrate chamber Sc and the concentrate passage G is formed. The neck part 14*d* of the inner container 14 is fitted to the inner peripheral surface of the neck part 13*d* of the outer container 13 except the longitudinal groove 14*i*. Further, in the case of performing a blow-molding at the same time, the outer surface of the shoulder part 14*c* of the inner container 14 is tightly contacted with the inner surface of the shoulder part 13*c* of the outer container 13, so that there is a case in which the concentrate C hardly flows. In order to fill the pressurizing agent (gas) P, when the outer lid 151 is welded, the inner container 14 is deformed downward from the neck part 14*d* to the shoulder part 14*c* by pushing the upper end of the neck part 14*d* of the inner container 14 into the inside of the neck part 13*d* of the outer container 13, and the outer surface of the shoulder part 14*c* of the inner container 14 is peeled off from the inner surface of the shoulder part 13*c* of the outer container 13, so that the channel of the concentrate C can be enlarged and it is hardly clogged.

As shown in FIG. 24B, the inner lid 152 is provided with a cylindrical fitting part 152*a* inserted and fitted inside the neck part 14*d* of the inner container 14, a disk-shaped lid part 152*b* sealing the opening of the upper end of the fitting part 152*a*, and a flange 152*c* expanding outward from the upper end of the fitting part 152*a*. The fillet part for welding may be provided in the root of the fitting part 152*a* and the lid part 152*b*.

The outer lid 151 is provided with a cylindrical-shaped outer cylindrical part 151*a* welded to the upper end surface 13*f* of the neck part 13*d* of the outer container 13, an annular disk part 151*b* sealing the opening of the upper end of the outer cylindrical part 151*a*, and a fitting cylindrical part 15*b*1 raised from the central part of the annular disk part 151*b*. The outer cylindrical part 151*a* is inserted to the outer periphery of the flange 152*c* of the inner lid 152 with a space. The opening of the lower part of the fitting cylindrical part 15*b*1 is sealed by the bottom plate 15*c*, and a closing part 15*d*, which is opened when it is used, is provided in the bottom plate 15*c*. The periphery of the closing part 15*d* is surrounded by an annular thin part or a weakening line 15*f*. The weakening line 15*f* has sufficient sealing function in the unopened state, and it is the shape to be easily broken. In this embodiment, the weakening line 15*c* is formed in a V-groove. The bottom plate 15*c* is provided in the upper side than the annular disk part 151*b* and a space is formed in the lower side, because the closing part 15*d* is fallen down or it is easily deformed downwardly. Further, in the case in which the outer lid 151 is welded to the upper end surface 13*f* of the outer container, the horn applying the ultrasonic vibration is pressed to, but since the closing part 15*d* of the bottom plate is provided in the upper side than the annular disk part 151*b*, the ultrasonic vibration hardly flows to the closing part 15*d*, and the melting of the weakening line 15*f* of the closing part which is made thin can be prevented.

In the upper surface side of the closing part 15*d*, a pressure receiving part 15*d*1 which is thickened so as to be hardly bent at the time of opening is provided. Further, in order to prevent the closing part 15*d* from falling-off or disengaging after opening, a coupling part 15*g* extended in a radial direction across the weakening line 15*f* may be provided. Further, the fitting cylindrical part 15*b*1 or the closing part 15*d* may be partially made hard by cooling condition, etc. at the time of molding, so that the elongation at the time of opening is suppressed, and it may be easily breakable.

The inner peripheral surface of the fitting cylindrical part 15*d*1 is the part where the sealing material 28 of the discharge member 12 abuts in order not to leak the concentrate C when opening the closing part 15*d*, and it is preferable to be made smooth cylindrical surface, and it may be a tapered shape which is reduced downwardly in diameter. However, in the upper part of the fitting cylindrical part 15*b*1, a recessed groove 15*n* extending in the vertical direction is provided. The upper end of the recessed groove 15*n* reaches the upper end of the fitting cylindrical part 15*b*1. On the other hand, the lower end of the recessed groove 15*n* does not reach the bottom part 15*c*, and it stops at the position which is approximately ¼ to ⅕ of the length of the vertical direction of the fitting cylindrical part 15*b*1. That is, the recessed groove 15*n* is not provided in the lower part of the fitting cylindrical part 15*b*1. This is because when the closing part 15*d* is opened by the valve 21, it becomes the state in which the liquid-tight seal between the fitting cylindrical part 15*b*1 and the valve 21 is already formed by the seal member 28. For example, the lower end of the recessed groove 15*n* may be positioned higher (downstream) than the position of the seal member 28 in the state in which the valve 21 firstly abuts to the closing part 15*d*. The number of the recessed groove 15*n* may be one or may be more than two.

In the space between the inner peripheral surface of the outer cylindrical part 151*a* of the outer lid 151 and the outer peripheral surface of the inner lid 152, a vertical passage G1 configured by the space in which the concentrate C passes through is provided. The height of the outer cylindrical part 151*a* of the outer lid 151 is defined as a dimension remaining a space (horizontal passage G2) in which the concentrate C passes through between the lower surface of the annular disk part 151*b* and the upper surface of the lid part 152*b* of the inner lid 152 after the inner lid 152 and the outer lid 151 are welded to the inner container 14 and the outer container 13. The concentrate passage G is configured by the aforementioned vertical passage G1 and horizontal passage G2.

The procedure for filling the pressurizing agent P and the concentrate C in the double pressurized container 11 of the aforementioned configuration will be described. In order to fill the pressurizing agent P into the pressurizing agent chamber Sp, first, the inner lid 152 covers to the inner container 14, and the pressurizing agent P is filled from the space between the flange 152*c* and the upper end surface 14*e* of the neck part 14*d* of the inner container 14. Next, the flange 152*c* is welded to the upper end surface 14*e* of the neck part 14*d* by pressing the horn of the ultrasonic wave welding to the upper surface of the inner lid 152. With this, the inner lid 152 is fixed to the inner container 14, and the pressurizing agent chamber Sp is sealed.

Next, the outer lid 151 covers the outer container 13, and the concentrate C is filled to the concentrate chamber Sc from the space between the lower surface of the outer cylindrical part 151*a* and the upper end surface 13*f* of the neck part 13*d* of the outer container 13. At this time, the concentrate chamber Sc expands. Next, the lower surface of the outer cylindrical part 151*a* is welded to the upper end surface 13*f* of the neck part 13*d* of the outer container 13 by pressing the horn of the ultrasonic wave welding to the upper surface of the outer lid 151. With this, the concentrate chamber Sc is sealed. At this time, the concentrate passage G (the vertical passage G1, the horizontal passage G2) is formed between the outer lid 151 and the inner lid 152.

In the aforementioned production method, the pressurizing agent P is filled in the inner container 14 and the welding for sealing the inner container 14 is performed, and after that, the concentrate C is filled and the welding for sealing the concentrate chamber Sc is performed, so that the production steps become simple and easy. Specifically, the outer lid 151 is provided with the outer cylindrical part 151*a* in which the inner lid 152 is inserted, so that the welding with the outer container 13 is not inhibited by the inner lid 152 and the inner container 14 which are welded first.

As the material of the outer lid 151 or the inner id 152, thermoplastic resin having high thermal bondability with the outer container 13 or the inner container 14 is used. When fixing by the welding, it is preferable that the outer container 13 and the inner container 14 use a same material. The outer lid 151 and the inner lid 152 are welded to the outer container 13 and the inner container 14, respectively, and it may be adhered by an adhesive. The concentrate chamber Sc and the pressurizing agent chamber Sp are sealed by the outer lid 151 and the inner lid 152, and by fixing to one of the inner container 14 and the outer container 13, or both, the contents (concentrate C, pressurizing agent P) can be safely secured for a long period of time without any leakage.

Figure 24:
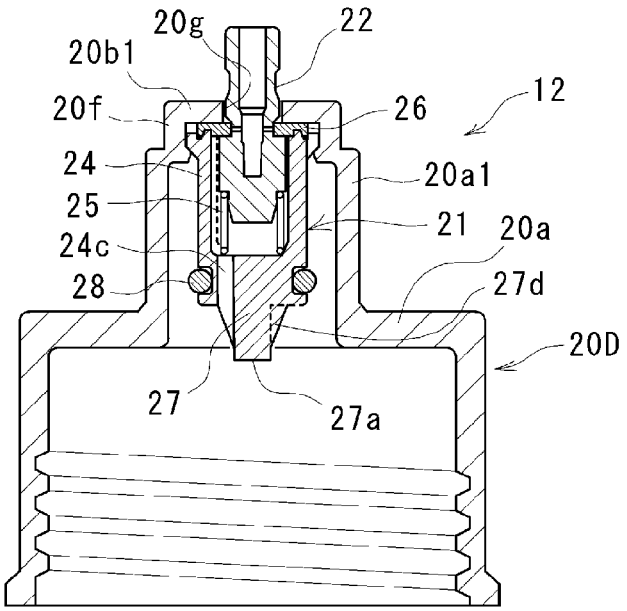
FIG. 24(A) is a cross-sectional view of the discharge member.
FIG. 24(B) is a cross-sectional view of major parts of the pressurized product.
Figure 24:
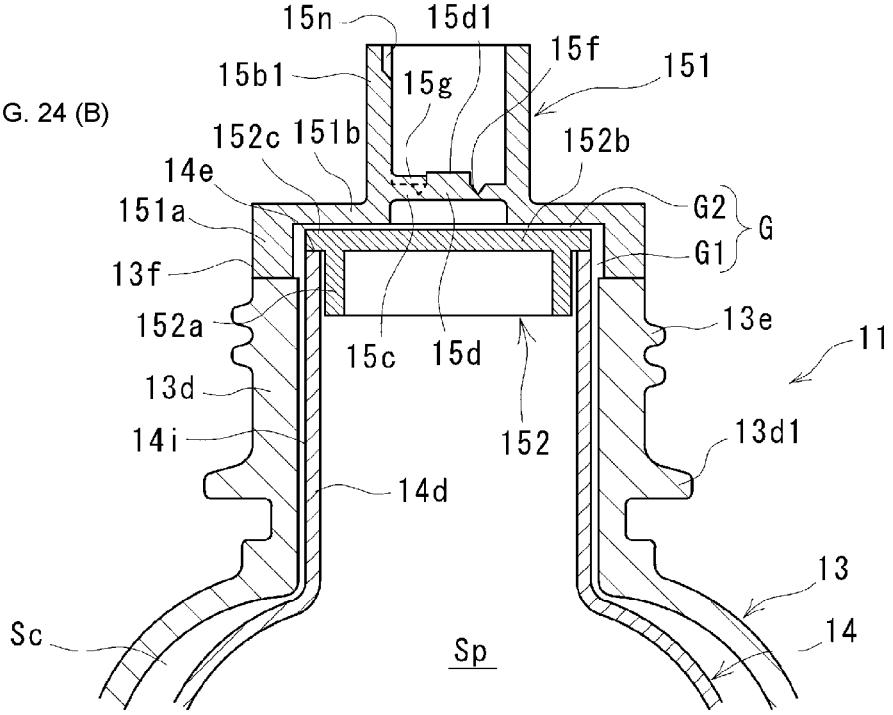
Figure 25:
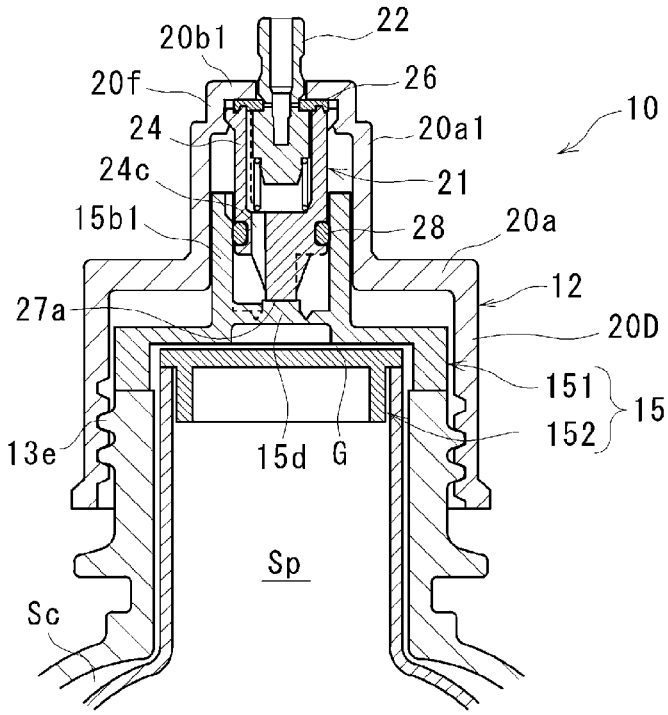
FIG. 25(A) is a cross-sectional view of major parts of the discharge product before opening.
FIG. 25(B) is a cross-sectional view of major parts of the discharge product after opening.
FIG. 25(C) is a cross-sectional view of major parts showing the state in which the cap is loosened after opening.
Figure 25:
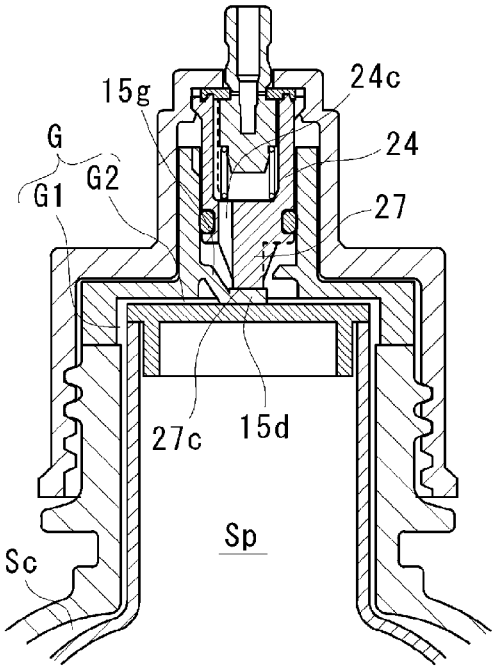
Figure 25:
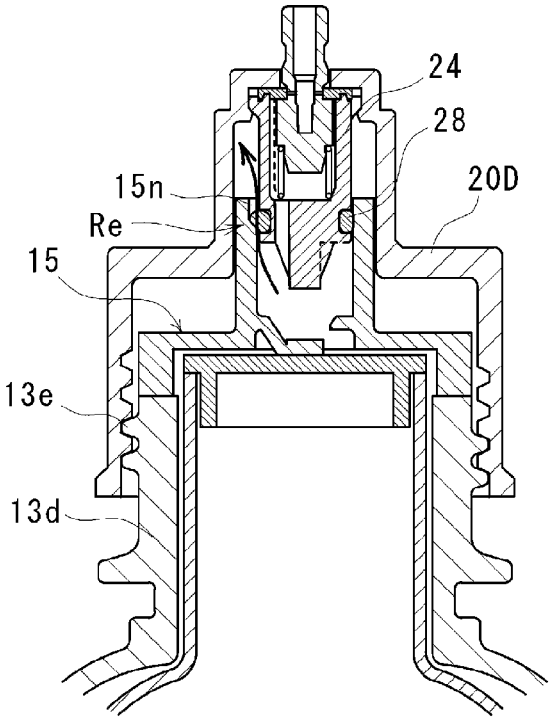

The use method of the discharge product 11*a* will be described with reference to FIGS. 24 and 25. The discharge member 12 is provided with a cap (mounting part) 20D screwing with the male screw 13*e* of the neck part 13*d* of the outer container 13, and a valve (valve) 21 held by the cap 20D. In the stem 22 of the valve 21, an operation device in which the discharging is performed by an operation button provided with a nozzle (reference numeral 23 of FIG. 23A, operation part) or an operation lever is mounted. The cap 20D is a bottomed cylindrical shape, and a female screw is formed on the inner peripheral surface. And, a bottomed cylindrical shaped center cylinder 20*a*1 in which the fitting cylindrical part 15*b*1 of the outer lid 151 is stored in the upper bottom 20*a* is provided in the upward projection manner. The upper end of the center cylinder 20*a*1 is a valve holding part 20*f* holding the housing 24 of the valve 21. A hole 20*g* passing through the stem 22 in the center of the upper bottom 20*b*1 of the valve holding part 20*f* is formed.

In the seal opening part 27, the vertical hole 24*c* communicating between the inside of the housing 24 and the inside of the concentrate passage G after opening is formed. The vertical hole 24*c* may be provided at one place, but it can be provided in multiple places. By providing it at multiple places, even if one of the vertical holes is clogged, the concentrate can be discharged from another vertical hole 24*c*. Note that the vertical hole 24*c* may be formed at the center of the seal opening part 27.

In the lower end 27*a* of the seal opening part 27, a flat end surface brought close to or abutting the upper surface of the closing part 15*d*, that is, the upper surface of the pressure receiving part 15*d*1 is formed. By making the lower end 27*a* flat, the lower end is hardly collapsed even when it is used multiple times. As shown in FIG. 25A, the position of the lower end 27*a* is the position abutting the closing part 15*d* when the cap 20D is screwed to the male screw of the outer container 33 approximately one to two times. Therefore, at the time of the delivery, the cap 20D is loosely screwed and the closing part 15*d* is not broken, and it can be a temporary mounting to connect the discharge member 12 and the double pressurized container 11 in the sealing state.

At the time of distribution and sales, when the cap 20D is mounted to the outer container 13 and it is temporarily connected by loosely screwing as shown in FIG. 25A, the customer who purchases it can easily perform an opening operation. Note that as shown in FIG. 23B, it may sell or distribute as a set in which the discharge product 11*a* and the discharge member 12 are not assembled.

When the user rotates the cap 20D, the entire cap 20D and the valve 21 are lowered, as shown in FIG. 25B, the lower end 27*a* of the seal opening part 27 pushes down the closing part 15*d*, and the weakening line 15*f* is broken so that it is opened. However, since it is not broken by the coupling part

15*g*, the closing part 15*d* is not fallen off, and it remains in the state in which it is hanged from the bottom plate 15*c*. Therefore, the opened hole, etc. is not clogged by the closing part 15*d*. Instead of providing the coupling part 15*g*, the weakening line 15*f* may be formed at only one place, or the V-groove may be made shallow. The inside of the housing 24 and the concentrate chamber Sc are connected via the concentrate passage.

The concentrate C inside the concentrate chamber Sc is compressed by the pressurizing agent P via the inner container 14, so that when the user pushes the operation button 23 mounted in the stem 22, the stem rubber 26 is deflected by lowering the stem 22, and the stem hole opens, and the concentrate C inside the concentrate chamber Sc is discharged outside via the longitudinal groove 14*i* of the neck part 14*d* of the inner container 14, the vertical passage G1, the horizontal passage G2, the seal opening part 27, the housing 24, stem 22, and the operation button 23. When stop pushing, the stem 22 is raised, and the discharge stops. The pressurizing agent chamber Sp in which the pressurizing agent P is filled is closed by the inner lid 152, and it does not communicate with the outside or the concentrate chamber Sc, so that the pressurizing agent P is not leaked outside.

By the way, as described above, the outer lid 151 is provided with the recessed groove 15*n*. When the seal member 28 is positioned at the recessed groove 15*n*, at the part overlapping with the recessed groove 15*n*, the compression of the inner surface of the lid 15 (fitting cylindrical part 15*b*1) and the outer surface of the valve 21 (housing 24) is weakened. In this state, it can be said that the sealing by the seal member 28 is partially released by the recessed groove 15*n*. Therefore, the concentrate C is leaked from the concentrate chamber Sc through the recessed groove 15*n*. The leaked concentrate C is leaked outside of the discharge device 10 through the space between the inner surface of the cap 20D and the outer surface of the neck part 13*d* of the outer container 13. The leaked concentrate C is not discharged energetically, but it is discharged slowly, so that it is not scattered, and it adheres to the hand of the user who tries to remove the cap 20 or it can be visually recognized.

Before loosening (start removing) the cap 20D, that is, in the state in which the cap 20D is completely mounted to the pressurized product 11*a*, the seal member 28 is positioned in the lower side (downstream) than the recessed groove 15*n*. Thus, the concentrate C is not leaked from the recessed groove 15*n*. On the other hand, when the cap 20D is loosened (start removing), the entire valve 21 is moved upward, and before the cap 20D is removed from the pressurized product 11*a* (in the state in which the cap 20D is screwed in the male screw 13*e*), the seal member 28 is positioned at the recessed groove 15*n*, and the concentrate C is leaked (see the arrow in FIG. 25C). With this, since the discharge device 10 of the aforementioned configuration is provided with the part releasing mechanism Re which partially releases the sealing by the seal member 28 by moving the valve 21 due to the operation in which the cap 20D is loosened (starts removing), so that the user can be notified that the concentrate C still remains by the leakage of the concentrate C, and the removal of the cap 20D in the state in which the concentrate C remains can be suppressed. Note that when fastening the cap 20D again at the time the user realizes the leakage of the concentrate C, the seal member 28 is positioned lower than the recessed groove 15*n*, and the leakage of the concentrate C stops, so that it can be reused.

When the concentrate C is low, the inner container 14 is enlarged, and the concentrate chamber Sc is contracted. And, it is enlarged so as to be close to the original shape every time the concentrate is discharged, and after all of the concentrate is discharged, the container 14 does not have wrinkling or twisting so as to tightly and almost fit to the inner surface of the outer container 13. At this time, since the appearance changes to a transparent from the concentrate C, it is easy to know the removal period of the discharge member 12. In this state, the cap 20D is removed from the outer container 13. Since the double pressurized container 11 uses a compressed gas as the pressurizing agent P, when the concentrate C is empty, the pressure becomes low as approximately 0.01 to 0.2 MPa (gauge pressure), but in order to release the pressurizing agent P inside the inner container 14, it is preferable to provide an unsealing part for releasing gas in the inner lid 152. With this, the pressurizing agent P inside the outer container 13 can be safely released, and the outer container 13 is reduced by crushing and can be discarded. Note that the removed discharge member 12 is reused so as to be mounted to a new discharge product 11*a*.

Figure 26:
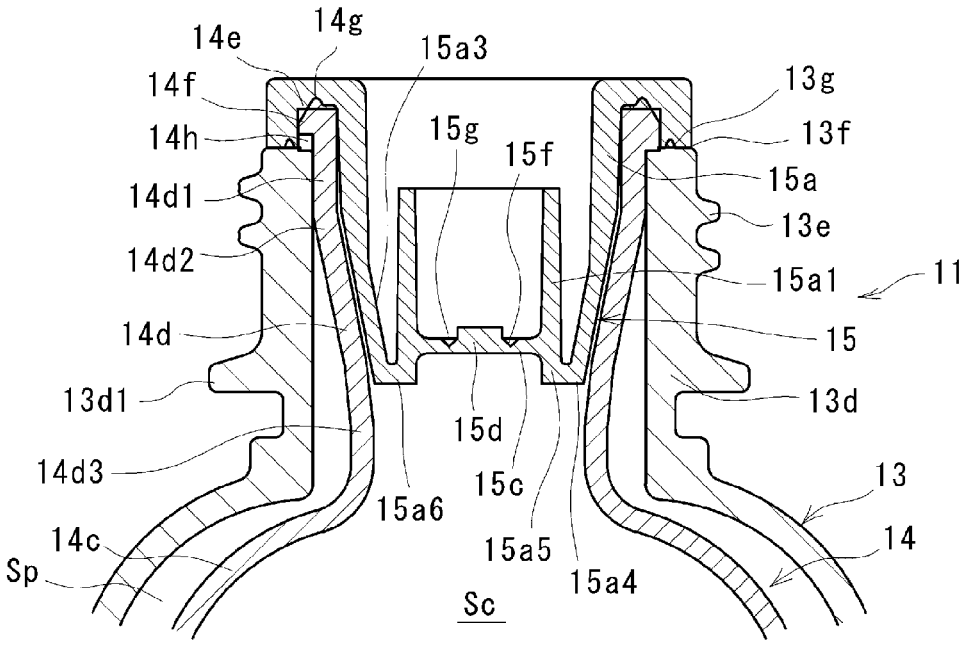
FIG. 26(A) is a cross-sectional view of major parts in a pressurized product used in still another embodiment of the discharge device of the present invention.
FIG. 26(B) is a diagram looking up from the lower side of the lid in a pressurized product used in still another embodiment of the discharge device of the present invention.
Figure 26:
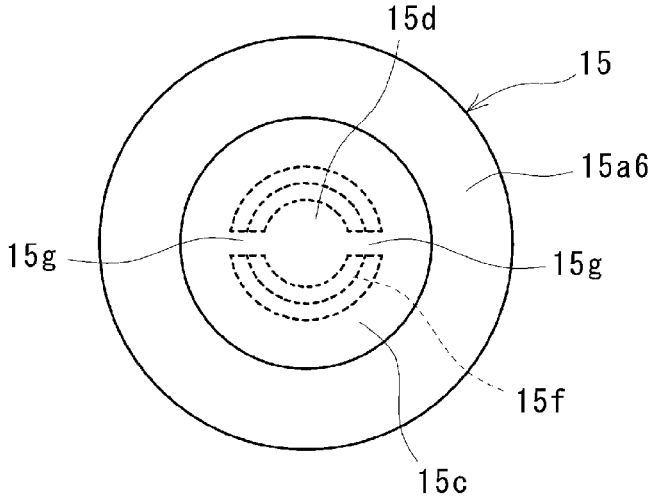

In the double pressurized container 11 of FIG. 26A, in order not to continue the thin part 15*f* annularly, a plurality of coupling parts 15*g* is provided. The coupling parts 15*g* are preferably provided in equal intervals in the circumferential direction. The coupling parts 15*g* are made thicker than the thin part 15*f*.

Figure 27:
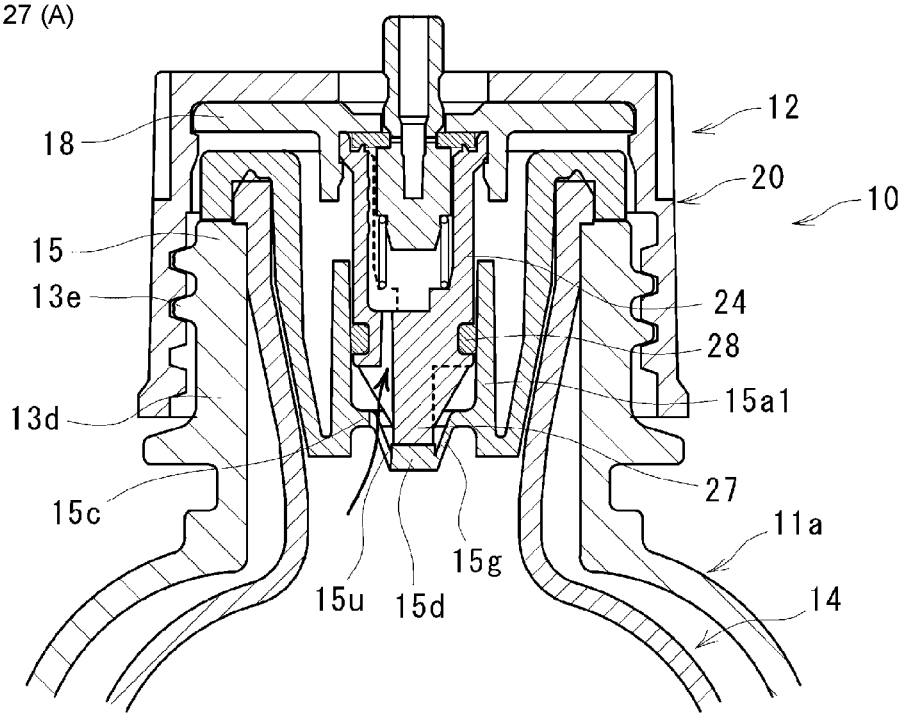
FIG. 27(A) is a cross-sectional view of major parts showing the state after opening the pressurized product of FIGS. 26(A) and 26(B).
FIG. 27(B) is a cross-sectional view of major parts showing the state of removing the valve from the pressurized product of FIGS. 26(A) and 26(B).
Figure 27:
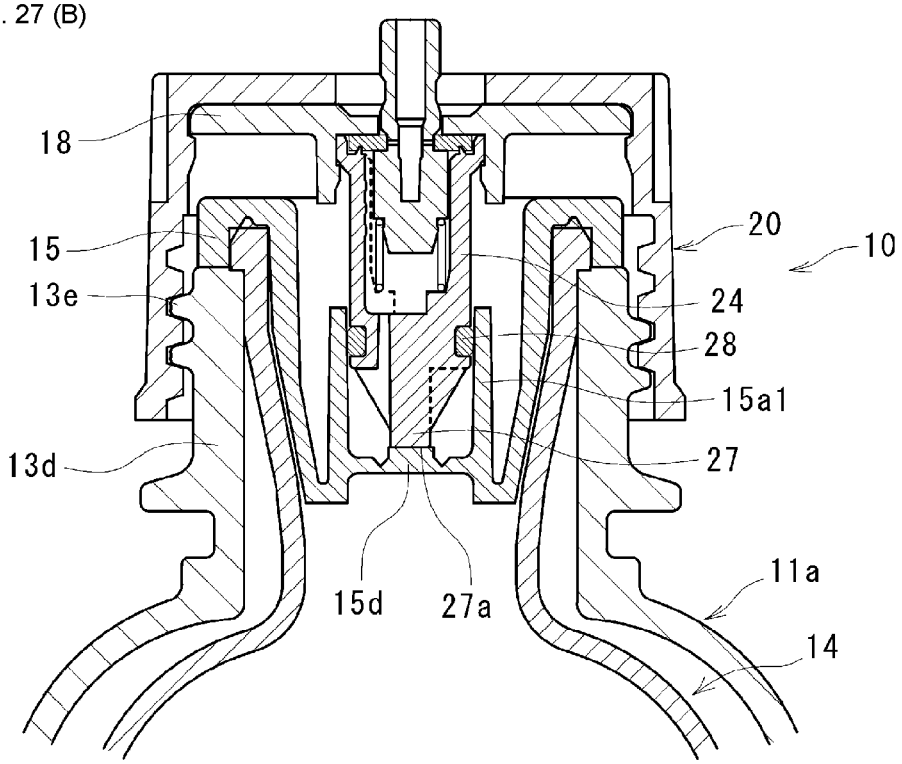

In the discharge device 10 using the double pressurized container 11 of the aforementioned configuration, as shown in FIG. 27A, when the closing part 15*d* is pushed down by the seal opening part 27, the thin part 15*f* is broken, and a through hole 15*u* is formed around the closing part 15*d*. However, the coupling part 15*g* is not broken, and the closing part 15*d* is still connected with the bottom part 15*c*, so that it is not fallen off. Specifically, a plurality of coupling parts 15*g* is provided, so that the closing part 15*d* is not inclined, and it maintains the state in which the upper surface of the seal opening part 15*d* and the bottom surface 27*a* of the seal opening part 27 are always abutted. Further, it is the state in which the coupling part 15*g* is elastically elongated. Accordingly, the coupling part 15*g* has resilience to be returned to the original length. Therefore, when the cap 20 is removed and the seal opening part 27 is moved upward, the elongated coupling part 15*g* becomes short together with the movement of the seal opening part 27. When the coupling part 15*g* is returned to the original length, naturally, the through hole 15*u* is sealed (see FIG. 27B). Further, depending on a type of the concentrate C, by reducing the contractibility of the coupling part 15*g*, etc. influenced by the concentrate, there is a case in which the coupling part 15*g* is hardly returned to the original length. However, since the closing part 15*d* receives the pressure by the pressurizing agent P, it is the state in which the coupling part 15*g* is always energized upwardly, so that the closing part 15*d* easily seals the through hole 15*u*.

With this, the thin part 15*f* for forming the through hole 15*u* is provided around the closing part 15*d*, and a plurality of the coupling parts 15*g* is provided around the closing part 15*d*, so that the through hole 15*u* maintains the open state by mounting the discharge member 12, and by removing the discharge member 12, an opening/closing mechanism is formed, so that the through hole 15*u* becomes the close state or the opening area of the through hole 15*u* becomes small significantly. Therefore, in the discharge device 10 of the aforementioned configuration, even if the cap 20 is removed in the state in which the concentrate C remains, the leakage of the concentrate C can be suppressed.

Regarding another configuration, it is similar to the discharge device 10 of FIG. 17, and therefore, the same reference numerals are used for the same parts, and the descriptions thereof will be omitted.

As described above, each of the discharge devices 10, 30, 50, 60, 70, 80, 90 of the present invention is provided with a suppressing means (the maintaining mechanism K, the movable lid 81, 91, pressing to the bottom 513*d* of the recessed part 513*b* of the projecting part 520*a*, the part releasing mechanism Re, the ratchet mechanism Ra, the thin part 15*f* and a plurality of coupling parts 15*g* (opening/closing mechanism)) for suppressing the leakage of the concentrate C due to the removal of the valve 21, 121, 221, 321, so that the leakage of the concentrate can be effectively suppressed.

In the above, the preferable embodiments of the present invention were described. However, the present invention is not limited to the aforementioned embodiments, and various modifications may be made within the scope of the present invention. For example, the outer container 13 and the cap 20, 120, 320 may not be connected by screwing each other. For example, a male screw or a groove is provided in the outer container 13, and a plurality of projections is provided in the cap 20, 120, 320, and the cap is fastened by twisting in the state in which the projections are placed along the male screw, that is, it may be a twist cap structure. Further, the well-known various structures may be employed as long as it is the assembly method in which the cap 20, 120, 320 is detachable with respect to the pressurized product 11*a*.

The recessed groove 15*n* may be provided in the valve 21, and the seal member 28 may be mounted to the lid 15. In this case, the recessed groove 15*n* is provided downward. By loosening the cap 20 and gradually moving the valve 21 upward, the seal member 28 is positioned at the recessed groove 15*n*, and the concentrate C is leaked outside via the recessed groove 15*n*.

Further, in the discharge device 10 shown in FIGS. 21 and 22, the cap 20C may be provided with a groove part 13*j* and a locking projection 13*k*, and the outer container 13A may be provided with an engaging projection 20*d*. In this case, it also has a similar effect.

Further, the exterior part 70 shown in FIG. 18 or FIG. 20 and the pressurized product 11*a* shown in FIGS. 11, 13, 15, 17, 21, 24, 25, 27 can be freely assembled. For example, similar to the cap 20A or the cap 20B, when the second claw part 20*c* is provided on the outer surface of the cap 20C of FIG. 21, and the exterior part 70 shown in FIGS. 18 and 20 is covered by the cap 20C, the ratchet mechanism Ra corotating in only one direction is configured. In the case in which the corotating direction is defined as the same direction from the longitudinal groove 13*j*1 to the holding part 13*j*3, even when the cover part 71 is rotated to the direction from the holding part 13*j*3 to the longitudinal groove 13*j*1 (that is, the direction of removing the cap 20C), the cap 20C cannot be removed, and the removal of the cap 20C from the pressurized product 11*a* can be suppressed. On the other hand, since the cover part 71 can rotate in the direction from the longitudinal groove 13*j*1 to the holding part 13*j*3, when the exterior part 70 covers the pressurized product 11*a* and the exterior part 70 is rotated in the state in which the cap 20 and the valve 21 are inserted in the lower cylindrical part 71*a*, the cap 20C can be mounted to the pressurized product 11*a*. Further, the cap 20C and the outer container 13A of FIG. 21 may be applied to another discharge device such as the discharge device 10 of FIG. 17, etc.

Further, the lid 15 is welded to both of the inner container 14 and the outer container 13, but it may be fixed to one of the containers, and the other one may be sealed (seal) by, simply, an O-ring, etc. Further, in the aforementioned embodiments, the inner container 14 and the outer container 13 are produced by performing the blow-molding at the same time, but it may be produced separately, and after that, the inner container may be stored inside the outer container, or the inner container may be formed by performing the brow-molding inside the molded outer container. In the aforementioned embodiments, the columnar-shaped opening part 27 is used, but it may be a rod shape such as a pillar shape, etc.

Effect of the Invention

The discharge device of the present invention is provided with a suppressing means (a maintaining mechanism, a movable lid, pressing to the bottom of the recessed part of the projecting part, a part releasing mechanism, a ratchet mechanism, a thin part and a plurality of coupling parts) for suppressing the leakage of the concentrate caused by removing the valve.

Further, in addition to mounting the valve by the cap, a maintaining mechanism for maintaining the mounting state to the pressurized product of the valve is provided. That is, in the case in which a plurality of safety devices which suppress unintentional removal from the pressurized product of the valve are provided, the leakage of the concentrate caused by removing the valve can be suppressed.

Further, in the case in which the maintaining mechanism is provided any one of the valve and the pressurized product, and the engaging means for maintaining the state in which the valve is mounted to the pressurized product against the pressure of the pressurizing agent, even when the cap is removed from the pressurized product, the valve is not naturally removed from the pressurized product. Therefore, even when the concentrate remains inside the container, the leakage of the concentrate can be suppressed.

In the case in which the engaging means is provided in any one of the valve and the pressurized product, and the engaging projection engaging with the other one is provided, it can maintain the state in which the valve is mounted to the pressurized product with a simple structure. In the case in which the engaging projection is a screw-shape, the valve and the pressurized product can be screwed, the state in which the valve is mounted to the pressurized product becomes stable. In the case in which the engaging projection is provided in the valve and the valve breaks through the pressurized product and the engaging projection is engaged to the edge of the through hole made by breaking through, there is no need to perform a special operation for engaging the valve and the pressurized product.

In the case in which the valve has a housing and an engaging projection, and a seal opening part which is detachable to the housing is provided, the mounting state of the seal opening part can be maintained. When the valve can be engaged with and disengaged from the pressurized product, the valve can be reused. The engaging projection is provided in the valve and the pressurized product, and by engaging the engaging projection of the valve and the engaging projection of the pressurized product, the valve and the pressurized product are engaged, and when the engagement releasing part for releasing the engagement of the engaging projections each other is provided in a position adjacent to any one of the engaging projections of the valve and the pressurized product, by only shifting the valve relative to the pressurized product, the engaging state and the disengaging state can be easily switched.

In the case in which the maintaining mechanism makes the inner diameter smaller by interlocking with the contraction of the container due to the reduction of the internal pressure, and the inner cylindrical part is provided at the outer periphery position of the cap, the cap and the inner cylindrical part are not engaged when the internal pressure is high, and the cap and inner cylindrical part can be engaged at the first time the internal pressure becomes low, so that the removal of the cap from the pressurized product in the high internal pressure state cannot be performed. In the case that the engaging projection, which engages with the other one at the first time the inner diameter of the inner cylindrical part becomes small, is provided in any one of the inner cylindrical part and the cap, the cap is easily removed from the pressurized product after the discharging of the concentrate is completed.

In the case in which the lid is provided with a movable lid which covers the closing part and maintains the open state by the mounting of the discharge member and becomes the close state by removing the discharge member, the leakage of the concentrate can be suppressed even when the discharge member is removed in the state in which the concentrate remains.

In the case in which the projecting part is pushed to the bottom of the recessed part by the pressure of the pressurizing agent, a force more than the pressure of the pressurizing agent is required in order to remove the cap, and unintentional removal of the valve from the pressurized product can be suppressed.

In the case in which the part releasing mechanism for releasing a part of sealing by the seal member by the movement of the valve due to the operation in which the cap starts removing, the small amount of the concentrate is leaked when the cap starts removing in the remaining state of the concentrate. Thus, before the cap is completely removed, the user can realize that there still remains the concentrate, so that the removal of the cap or the valve in the remaining state of the concentrate can be suppressed.

In the case in which the part releasing mechanism is provided with the seal member mounted on any one of the outer surface of the valve and the inner surface of the fitting cylindrical part, and the recessed groove provided in the other one to communicate with the outside, and the recessed groove is provided in a position shifting in the moving direction of the valve from the position of the seal member before the cap starts removing, or in the case in which the part releasing mechanism is provided with the seal member mounted on the outer surface of the valve, and the recessed groove communicating with the outside provided on the inner surface of the fitting cylindrical part, and the recessed groove is provided further downstream than the position of the seal member before the cap starts removing, the concentrate does not leak when the cap does not start removing. Further, even when the cap starts removing, if the cap returns to the original position, it is sealed by the seal member, so that it can be reused.

In the case in which the valve assembly including the valve and the cap is provided, and the valve assembly is configured not to contact with the projection of the container before the cap starts removing and to contact with the projection of the container when the cap starts removing, the resistance is applied when the cap starts removing, and the unintentional removal of the cap can be suppressed.

In the case in which the removing condition of the cap when the part releasing mechanism operates and the removing condition of the cap when the projections contact with the projections of the container are equal, the user easily realizes abnormality by changing the operational feeling due to the leakage of the concentrate and the resistance.

In the case in which the discharge member is further provided with the cover part covering the cap, and a ratchet mechanism is formed on the inner surface of the cover part and the outer surface of the cap so as to perform idling when the cover part is rotated in the removing direction of the cap, the cap cannot be rotated in the removing direction of the cap even when rotating the cover part. Thus, the unintentional removal of the cap can be suppressed.

In the case in which the discharge member is further provided with the cover part covering the cap, and the cover part is engaged with the pressurized product, even when rotating the cover part, the cap cannot be rotated, so that the unintentional removal of the cap can be suppressed. Alternatively, in the case in which the discharge member is further provided with the cover part covering the cap, and the cover part is provided with an engaging part in which the cover part is rotatably engaged with the cap around the axis of the cap, the falling-off of the cover part is suppressed and the case in which the user directly touches the cap is suppressed, and even when rotating the cover part, the removal of the cap can be suppressed.

In the case in which the container body is provided with an outer container and an inner container having flexibility to be stored inside the outer container, and the inside of the inner container is a concentrate chamber filling the concentrate, and a space between the outer container and the inner container is a pressurizing agent chamber filling the pressurizing agent, or in the case in which the inside of the inner container is a pressurizing agent chamber filling the pressurizing agent, and a space between the outer container and the inner container is a concentrate chamber filling the concentrate, when the concentrate is filled in the concentrate chamber and the pressurizing agent is filled in the pressurizing agent chamber, the elasticity of the outer container becomes higher by the pressure of the pressurizing agent, so that it becomes strong against impact such as falling-off, etc., and the effect of impact, etc. to the inner container is reduced.

In the case in which the lid is provided with an annular disk part covering the upper end surface of the outer container, a lid part closing the opening of the inner container, a fitting cylindrical part provided at the central part of the annular disk part, a closing part provided at the bottom part of the fitting cylindrical part, and a concentrate passage communicating between the inside of the fitting cylindrical part and the concentrate chamber when opening the closing part, the closing part is located inside, so that without a special discharge member, the consumer hardly opens or discharges. Therefore, the safety is enhanced.

In the case in which the ratchet mechanism is formed so as to perform idling when the cover part is rotated in the removing direction of the cap, even when rotating the cover part, the cap cannot be rotated in the removing direction. Thus, the unintentional removal of the cap can be suppressed. On the other hand, when removing the cover part, the valve can be removed from the pressurized product by removing the cap from the pressurized product, and the valve can be reused.

Further, by integrating the valve and the cap, when the cap is removed from the pressurized product, also, the valve is naturally removed from the pressurized product. In the case in which the cover part is provided with an engaging part in which the cover part is rotatably engaged with the cap around the axis of the cap, the falling-off of the cover part is suppressed and it can suppress that the user directly touches the cap.

In the case in which the lid is provided with the closing part pushing down by the mounting of the discharge member, a thin part provided around the closing part and forming a through hole by the mounting of the discharge member, and a plurality of coupling parts restricting the falling-off from the lid of the closing part, the through hole can be sealed by the closing part which was not fallen off, and the leakage of the concentrate can be suppressed.

The terms and descriptions used herein are used only for explanatory purposes and the present invention is not limited to them. Accordingly, the present invention allows various design-changes falling within the claimed scope of the present invention.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, the terminology "present invention" or "invention" is meant as a non-specific, general reference and may be used as a reference to one or more aspects within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features.

The invention claimed is:

1. A discharge device comprising:

a pressurized product including a container filled with a concentrate and a pressurizing agent and sealing the concentrate and the pressurizing agent; and a discharge member configured to discharge the concentrate, the discharge member breaking through the pressurized product when the discharge member is mounted on the pressurized product, wherein the discharge member comprises:

a valve, and a cap which covers the valve and is detachably mounted to the pressurized product, and wherein the container comprises:

a container body, and a lid sealing an opening of the container body, and wherein the lid comprises:

a closing part which is broken and pushed through by the discharging member when the discharge member is mounted on the pressurized product, and a movable lid which is pushed to an open state by the closing part or the discharge member when the discharge member is mounted on the pressurized product, allowing the concentrate to discharge through the closing part, and which is pushed to closed state by the pressure of the pressurizing agent as the discharge member is removed from the pressurized product, preventing the concentrate from discharging through the closing part, wherein the valve has a housing that houses a stem, the housing has a seal opening part at the lower end to break through the closing part, the lid has a fitting cylinder part into which the housing is inserted, the closing part is located at the bottom of the fitting cylinder part, a sealing member is attached to the outer circumference of the housing to form a seal between the inner circumference of the fitting cylinder part and the outer circumference of the housing.

2. A discharge device according to claim 1, comprising:

a pressurized product including a container filled with a concentrate and a pressurizing agent and sealing the concentrate and the pressurizing agent; and a discharge member configured to discharge the concentrate, the discharge member breaking through the pressurized product when the discharge member is mounted on the pressurized product, wherein the discharge member comprises:

a valve, and a cap which covers the valve and is detachably mounted to the pressurized product, and wherein the container comprises:

a container body, and a lid sealing an opening of the container body, and wherein the lid comprises:

a closing part which is broken and pushed through by the discharging member when the discharge member is mounted on the pressurized product, and a movable lid which is pushed to an open state by the closing part or the discharge member when the discharge member is mounted on the pressurized product, allowing the concentrate to discharge through the closing part, and which is pushed to closed state by the pressure of the pressurizing agent as the discharge member is removed from the pressurized product, preventing the concentrate from discharging through the closing part, wherein the entirety of the movable lid moves downward when pushed by the closing part or the discharge member, and moves upward when pushed by the pressure of the pressurizing agent.

3. The discharge device according to claim 1, wherein the container body is provided with an outer container and an inner container housed inside the outer container, the inner container is filled with the concentrate, the pressurizing agent is filled between the outer container and the inner container.

4. The discharge device according to claim 2, wherein the container body is provided with an outer container and an inner container housed inside the outer container, the inner container is filled with the concentrate,
the pressurizing agent is filled between the outer container and the inner container.

* * * * *